US011020315B2

(12) United States Patent
Konstantakis et al.

(10) Patent No.: US 11,020,315 B2
(45) Date of Patent: Jun. 1, 2021

(54) PIPELESS WATER JET ASSEMBLY

(71) Applicant: Brooks Stevens, Inc., Allenton, WI (US)

(72) Inventors: George C. Konstantakis, Franklin, WI (US); Roberto Berritta, Rovereto (IT); Ryan M. Damm, Theresa, WI (US); Steven M. Lippincott, Van Dyne, WI (US); Brian W Hubbard, West Bend, WI (US)

(73) Assignee: Brooks Stevens, Inc., Allenton, WI (US)

( * ) Notice: Subject to any disclaimer, the term of this patent is extended or adjusted under 35 U.S.C. 154(b) by 0 days.

(21) Appl. No.: 16/542,530

(22) Filed: Aug. 16, 2019

(65) Prior Publication Data

US 2020/0078264 A1 Mar. 12, 2020

Related U.S. Application Data

(63) Continuation-in-part of application No. 15/988,469, filed on May 24, 2018, now Pat. No. 10,517,795, which is a continuation of application No. 14/733,049, filed on Jun. 8, 2015, now Pat. No. 9,980,877.

(60) Provisional application No. 62/008,661, filed on Jun. 6, 2014.

(51) Int. Cl.
*A61H 33/00* (2006.01)

(52) U.S. Cl.
CPC ..... *A61H 33/6057* (2013.01); *A61H 33/0087* (2013.01); *A61H 33/6063* (2013.01)

(58) Field of Classification Search
CPC ..... A61H 33/6021; A61H 33/6031; A61H 33/6036; A61H 33/6042; A61H 33/6047; A61H 33/6052; A61H 33/6057; E04H 4/0006
USPC ..... 4/541.1–541.6
See application file for complete search history.

(56) References Cited

U.S. PATENT DOCUMENTS

| | | | | |
|---|---|---|---|---|
| 2,312,524 A | | 3/1943 | Cox | |
| 5,742,954 A | | 4/1998 | Idland | |
| 6,065,161 A | * | 5/2000 | Mateina | A61H 33/6063 4/492 |

(Continued)

OTHER PUBLICATIONS

Experiments on Bounded Vortex Flows and Related Particle Transport; Y. Huang and J.S. Marshall; J. Fluids Eng. 133 (7), 071204 (Jul. 22, 2011) (9 pages)doi:10.1115/1.4004453History: Received Dec. 14, 2010; Revised Jun. 17, 2011; Published Jul. 22, 2011; Online Jul. 22, 2011—(1) page.

(Continued)

*Primary Examiner* — Janie M Loeppke
(74) *Attorney, Agent, or Firm* — Boyle Fredrickson S.C.

(57) ABSTRACT

A water jet assembly includes a faceplate with at least one opening, a housing constructed to cooperate with the faceplate, and a mover disposed within a chamber of the housing. The mover is configured to move between a first position adjacent the at least one opening of the face plate and a second position offset from the faceplate to provide a variable volume within the chamber. The water jet assembly also includes an exciter connected to the housing and configured to transition the mover between the first position and the second position to increase and decrease the volume to move fluid into and out of the chamber via the at least one opening.

22 Claims, 32 Drawing Sheets

(56) References Cited

U.S. PATENT DOCUMENTS

| | | | | |
|---|---|---|---|---|
| 6,123,145 | A * | 9/2000 | Glezer | F21V 29/677 165/104.33 |
| 6,295,662 | B1 * | 10/2001 | Idland | A61H 33/6047 4/492 |
| 6,317,903 | B1 | 11/2001 | Brunelle et al. | |
| 2006/0236448 | A1 | 10/2006 | Ciechanowski | |

OTHER PUBLICATIONS

Formation process of the vortex ring generated by an impulsively started circular disc Yang, An-long; Jia, Lai-bing; Yin, Xie-zhen. Journal of Fluid Mechanics 713 (Dec. 25, 2012): 61-85—(1) page.

* cited by examiner

PIPELESS WATER JET ASSEMBLY

CROSS REFERENCE TO RELATED APPLICATIONS

This application is a continuation-in-part and claims priority to U.S. Utility patent application Ser. No. 15/988,469 filed on May 24, 2018 titled "Pipeless Water Jet Assembly", which is a continuation of U.S. Utility patent application Ser. No. 14/733,049 filed on Jun. 8, 2015 titled "Pipeless Water Jet Assembly", which claims priority to U.S. Provisional Patent Application No. 62/008,661 filed on Jun. 6, 2014 titled "Pipeless Water Jet Assembly" and the disclosures of which are incorporated herein.

FIELD OF THE INVENTION

The present invention relates to a jet assembly for generating a massaging pulse of water commonly associated with whirlpools, hot tubs, pedicure spas, swimming pools, bathtubs, medical tubs, and other such devices that are commonly subsequently cleaned and/or disinfected prior to subsequent use.

BACKGROUND OF THE INVENTION

It is generally known to provide a jet stream of water in such products as health and swim spas, whirlpools, jet stream exercisers, foot spas, bathtubs, etc. such that the stream of water can provide a massaging effect to the person positioned proximate the outflow of the jet. Such jet producing systems have been in commercial use for decades. However, all of the water jet producing devices in existence today have disadvantages including being difficult and sometimes almost impossible to thoroughly clean and/or disinfect. While it is accepted that diligent adherence to published procedures for cleaning and/or treatment can often maintain a desired level of clarity and sanitary condition of the water associated with such appliances, many such processes are commonly complicated, costly and time consuming such that such cleaning procedures are rarely strictly adhered to and/or followed.

More aggressive cleaning protocols can require the user or service personnel to disassemble pump and jet assemblies such that disassembly of pump impellers, screens and/or stators, etc, such that the cleaning process takes an inordinate amount of time and associated with the inability to use the respective appliance. Such service and cleaning down time considerations cost commercial users of such devices to lose income as well as endure the expense associated with such services and the intermediate chemical treatments. In the case of consumers, complicated cleaning procedures of piped or even pipe free water jet systems are hardly, if ever, strictly adhered to. Such inattention can result in the collection of the undesired matter in the jet system which is expelled into the user environment upon subsequent operation of the jet system.

Several actions can be taken in an attempt to overcome the difficulty of sanitation, including the addition of chemicals (e.g., bleach, chlorine, bromine) into the water to help control bacteria growth. Despite such efforts, however, water quality is sometimes still difficult to maintain. For example, bacteria can develop simple defense mechanisms such as the formation of a protective barrier or layer to counter chemical attacks. The destruction of the outer coating or barrier is generally successful with chemicals alone but most often times chemicals are only effective in destroying the outer barrier when used for extended periods of time, sometimes hours. Therefore, the preferred method of eliminating bacteria from jet pumping systems is through mechanical means such as abrasion (e.g., removal with a rag and a chemical cleanser that has anti-bacterial capabilities).

Unfortunately, many spa devices have intricate and elaborate systems of passages, cavities, orifices and pipes that move water from a pump, through a filtering system, and ultimately to one or more nozzles (e.g., openings) that deliver water back to a basin for re-circulation. In the case of a pedicure basin or whirlpool, the process of cleaning after each use involves draining the water from the system, spraying the basin with an anti-bacterial cleanser, circulating the water for a period of time, discarding the cleaning fluid, rinsing the basin, refilling with fresh water, re-circulating and draining once again. The various pipes and fittings often render it difficult if not impossible to mechanically scrub every component that comes into contact with the circulated water. Further, after a system is drained, some water commonly remains within the piping system, usually in cracks, crevices, and low portions of the circulation loop. For example, the pump itself is usually a sealed unit that may be difficult to completely drain. It is within these areas that bacteria tend to grow the outer barrier coating as a defensive mechanism against attack from anti-bacterial chemicals, especially when the system is not used for extended periods (e.g., overnight, weekends, etc.). Consequently, water quality may be diminished in conventional piped systems that are not effectively cleaned.

Another consideration to jet system constructions is that the jet streams produced by all systems in existence today rely on a high velocity, low mass flow stream to impart a massaging effect. The jet streams produced are harsh and can become uncomfortable after only a few minutes of use. Generally, people will sit in the jet stream for only a short period of time and then turn the jets off or remove themselves from the stream or, for those systems that include adjustable jets, reduce the velocity of the jet stream to levels that can be tolerated for longer durations. Such actions commonly satisfy the desires of one user to the detriment of the desires of other users.

The sometimes harsh massaging effect associated with many spa systems is commonly generated by pointing a small number of nozzles (e.g., openings) toward the body of the user. These nozzles are generally connected via pipes and hoses to a single centrifugal pump that produces a very high pressure (20-40 psi) and a relatively low volume of water. Many customers often complain that the jets of water produced in this manner are too rough, in some cases even producing pain or discomfort. Although the jets can be partially closed to reduce the force of the water stream, this also reduces the volume of water communicated from the discrete jets. Consequently, the massage effect is reduced since the jets are often a considerable distance away from the body (e.g., in the walls of the basin).

U.S. Pat. No. 2,312,524 to Cox discloses one example of a foot bathing device that utilizes foot rests that consist of a disk of heavy wire screening or a perforated plate. This type of system can have several disadvantages including producing unrestricted streams of water. For example, Cox discloses the use of a flat foot rest containing a uniform pattern of openings across the entire foot rest that is not capable of directing the water in any particular direction (e.g., a foot rest that includes a uniform grid pattern across the entire foot rest).

Therefore, there is a need for jet assembly that generates a desired massage effect and that mitigates some of the sanitation problems disclosed above. Further, it would be advantageous to provide an apparatus that does not require disassembly in order to achieve adequate disinfection. It would be further advantageous to have a device that produced a very large volume of water flow with very little pressure so that the massaging effect would not become uncomfortable after relatively short periods of exposure to same. It would also be advantageous to provide a massaging jet assembly that can be fluidly isolated for the contents of the basin to simplify winterization of such devices. Finally, it would also be advantageous to more efficiently create a pulsation of water so that the cost associated with operation of the water movement or pumping apparatus could be reduced.

SUMMARY OF THE INVENTION

The present invention discloses a water jet pumping apparatus or device that overcomes one or more of the shortcomings discussed above. One aspect of the invention discloses a water jet assembly that includes a faceplate with at least one opening, a housing constructed to cooperate with the faceplate, and a mover disposed within a chamber of the housing. The mover is configured to move between a first position adjacent the at least one opening of the face plate and a second position offset from the faceplate to provide a volume within the chamber. The water jet assembly also includes an exciter connected to the housing and configured to transition the mover between the first position and the second position to increase and decrease the volume to move fluid in and out of the chamber via the at least one opening. The at least one opening is shaped and oriented to generate a toroidal waveform associated with operation of the exciter.

In accordance with another aspect of the invention, the exciter may be at least one of a solenoid, a pneumatic system, and a rotational actuator. A rotational actuator includes a rotational shaft and a cam disposed at a distal end of the rotational shaft. The cam is coupled to a linkage that translates motion of the rotational actuator to the mover. A pneumatic system includes a pneumatic valve, a pneumatic chamber, and a pneumatic relief valve. The pneumatic valve is configured to provide air or another fluid to a pneumatic chamber within the housing. The pneumatic relief valve is disposed in the mover and configured to relieve pressure within the pneumatic chamber. When the pressure is increased within the pneumatic chamber, the mover transitions to the first position. When the pressure is decreased within the pneumatic chamber, the mover transitions to the second position.

In accordance with yet another aspect of the invention, the mover may include a piston and a diaphragm coupled together. In one instance, a ferromagnetic plate may be disposed in either the second end of the diaphragm or the first end of the piston, and a magnet may be disposed in the other of the second end of the diaphragm or the first end of the piston. The piston and diaphragm may then be joined via the ferromagnetic plate and the magnet.

Another aspect of the invention useable with one or more of the features or the aspects above discloses a method of manufacturing a water jet assembly that includes providing a housing having a chamber disposed therein, disposing a mover within the chamber, and securing a faceplate to the first end of the housing, the faceplate having at least one opening formed therein to access the accessible volume. The mover is configured to move between a first position adjacent a first end of the housing and a second position offset from the first end of the housing to provide an accessible volume within the chamber. An exciter may be connected to the housing and configured to transition the mover between the first position and the second position to increase and decrease the accessible volume and move fluid in and out of the chamber via the at least one opening.

In accordance with one embodiment of the invention, the mover may be formed as a piston and a diaphragm. A first end of the diaphragm is secured to the first end of the housing, and a second end of the diaphragm is secured to a first end of the piston. In one instance, the method may include disposing a ferromagnetic plate in one of the second end of the diaphragm and the first end of the piston and disposing a magnet in the other of the second end of the diaphragm and the first end of the piston. The ferromagnetic plate and the magnet are configured to interact to secure the second end of the diaphragm to the first end of the piston.

In accordance with yet another embodiment of the invention, the exciter may be formed as at least one of a solenoid, a rotational actuator, and a pneumatic system. The rotational actuator is formed by providing a rotational shaft powered by a motor, coupling a cam to a distal end of the rotational shaft, and coupling the cam to a linkage. The linkage may then be coupled to the mover. The pneumatic system may be formed as a pneumatic valve coupled to the housing to provide air into a pneumatic chamber and increase pressure therein and a pneumatic relief valve disposed in the mover to decrease pressure within the pneumatic chamber.

Preferably, the water jet apparatus according to the present invention provides a means for pumping fluid while utilizing a toroidal soliton effect. Another feature of the present invention is to provide a means to pump water with a device that does not require disassembly to maintain proper cleaning or a desired sanitation of the jet assembly. Another feature of the present invention is to provide a means to create the effect of pumping large volumes of water without actually pumping large volumes of water. Another feature of the present invention is to provide a means to provide a massaging feel that is greatly improved over current technology. Another feature of the present invention is to force nearly or all of the entrained water out of the jet assembly when not operating.

Another feature of the present invention provides a means to destroy bacteria that may remain in the pumping mechanism through the use of silver or other suitable alternative plating or antibacterial materials on the internal surfaces associated with the pumping activity. Another feature of the present invention is to provide a water jet apparatus that does not require circulation pipes or pumps between the inlet and the outlet of the discrete jet assemblies. Such a consideration mitigates bacterial problems common to spa and hot tub assemblies that include a plurality of jets whose operation is associated with a primary pump associated with hidden plumbing features.

Another feature of the present invention is to provide an apparatus that can be properly disinfected after use without physical scrubbing or cleaning and/or without disassembly of the discrete jet flow generating devices. Another feature of the present invention is to provide a spa apparatus that does not have a single continuous elongated flow of water directed into and then out of the respective water jet devices and which can cause undesirable materials to be delivered and/or re-circulated by water and/or air jet systems. Another aspect or feature of the device is to provide a massaging effect that is unlike any other device in use today and which commonly requires high volume and high velocity water flows.

These and other aspects and features of the present invention will be more fully understood from the following detailed description and the enclosed drawings.

Figure 1:
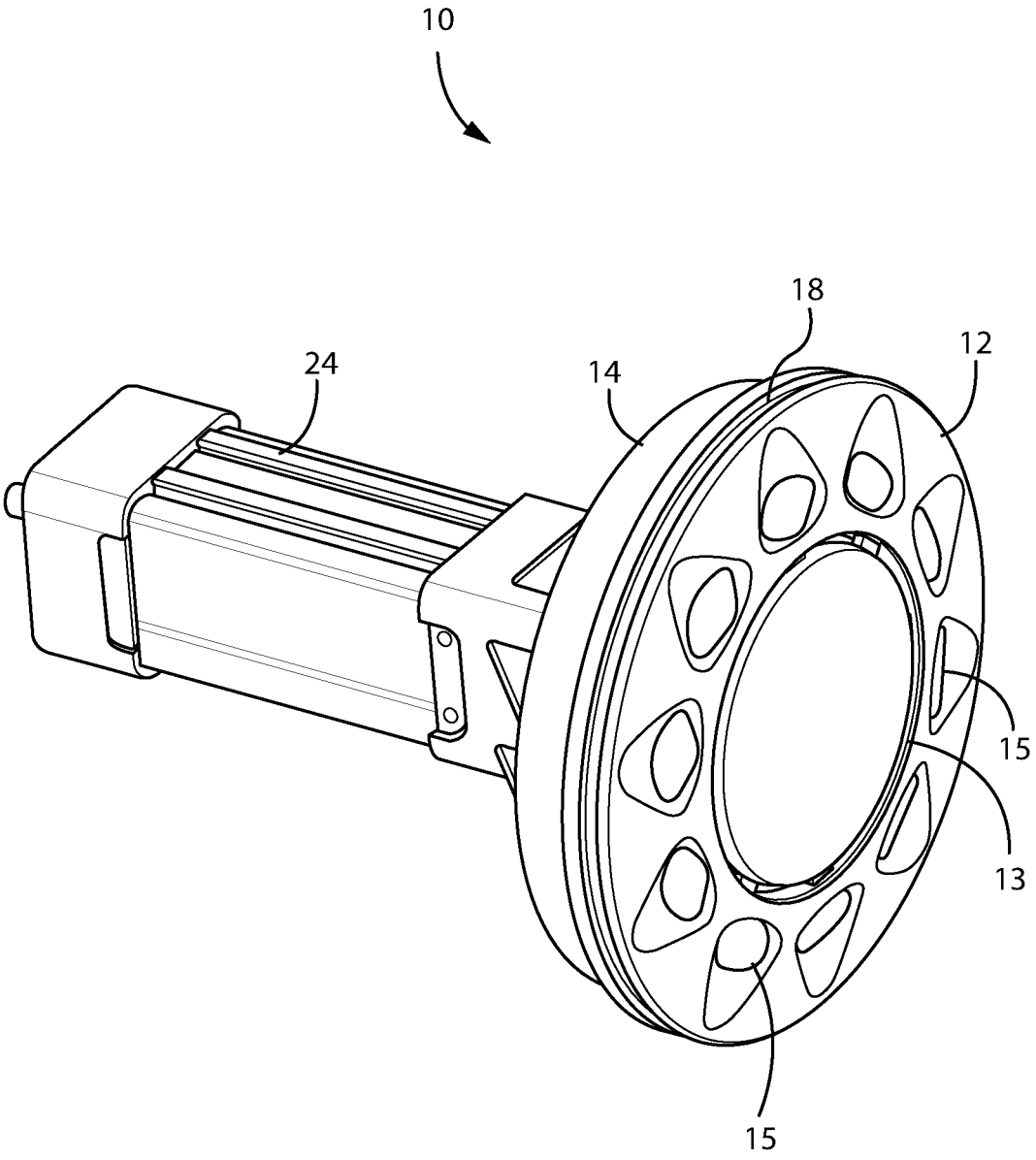
FIG. 1 is a perspective view of a jet assembly according to one embodiment of the present invention.

Before describing any preferred, exemplary, and/or alternative embodiments of the invention in detail, it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION

It is appreciated that, while the disclosed embodiments are illustrated as a jet apparatus designed for bathtubs, spas, whirlpools, hot tubs and the like, the present invention discloses and includes features that have a much wider applicability. For instance, it is appreciated that the present invention is usable with various tub, pool, and/or spa designs which can be adapted for various uses such as hand spas, other body parts, entire bodies, one or multiple persons, etc. Further, the size and relative orientation of the various components and the size of the apparatus can be widely varied. It is further appreciated that the various jet assemblies disclosed herein can be usable in other applications such as fluid mixing or agitation systems.

It is further appreciated that the particular materials used to construct the exemplary embodiments are also illustrative. Components of the device, assembly, or apparatus can be manufactured from thermoplastic resins such as injection molded high density polyethylene, polypropylene, other polyethylenes, acrylonitrile butadiene styrene ("ABS"), polyurethane, nylon, any of a variety of homopolymer plastics, copolymer plastics, plastics with special additives, filled plastics, etc. Also, various molding operations may be used to form these components, such as blow molding, injection or cast molding, rotational molding, etc. In addition, various components of the jet assembly and/or spa apparatus can be manufactured from stamped alloy materials such as steel or aluminum, or other metallic materials.

Figure 3:
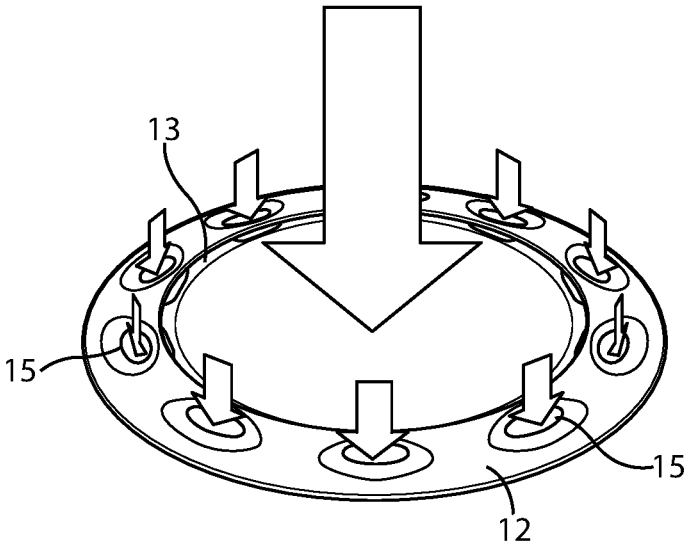
FIGS. 3 and 4 are perspective views of a faceplate of the jet assembly shown in FIG. 1 with an indication of a water flow associated with operation of the jet assembly.
Figure 4:
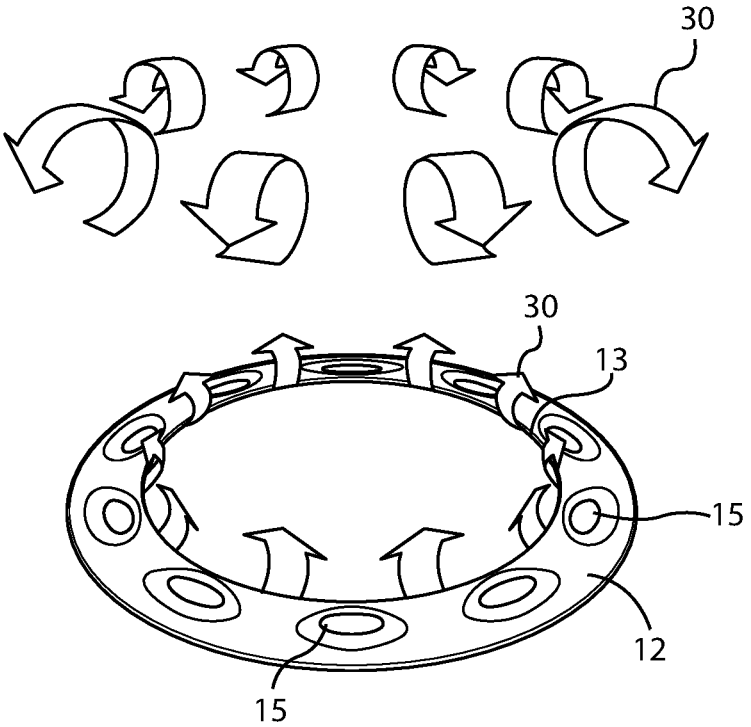
Figure 5:
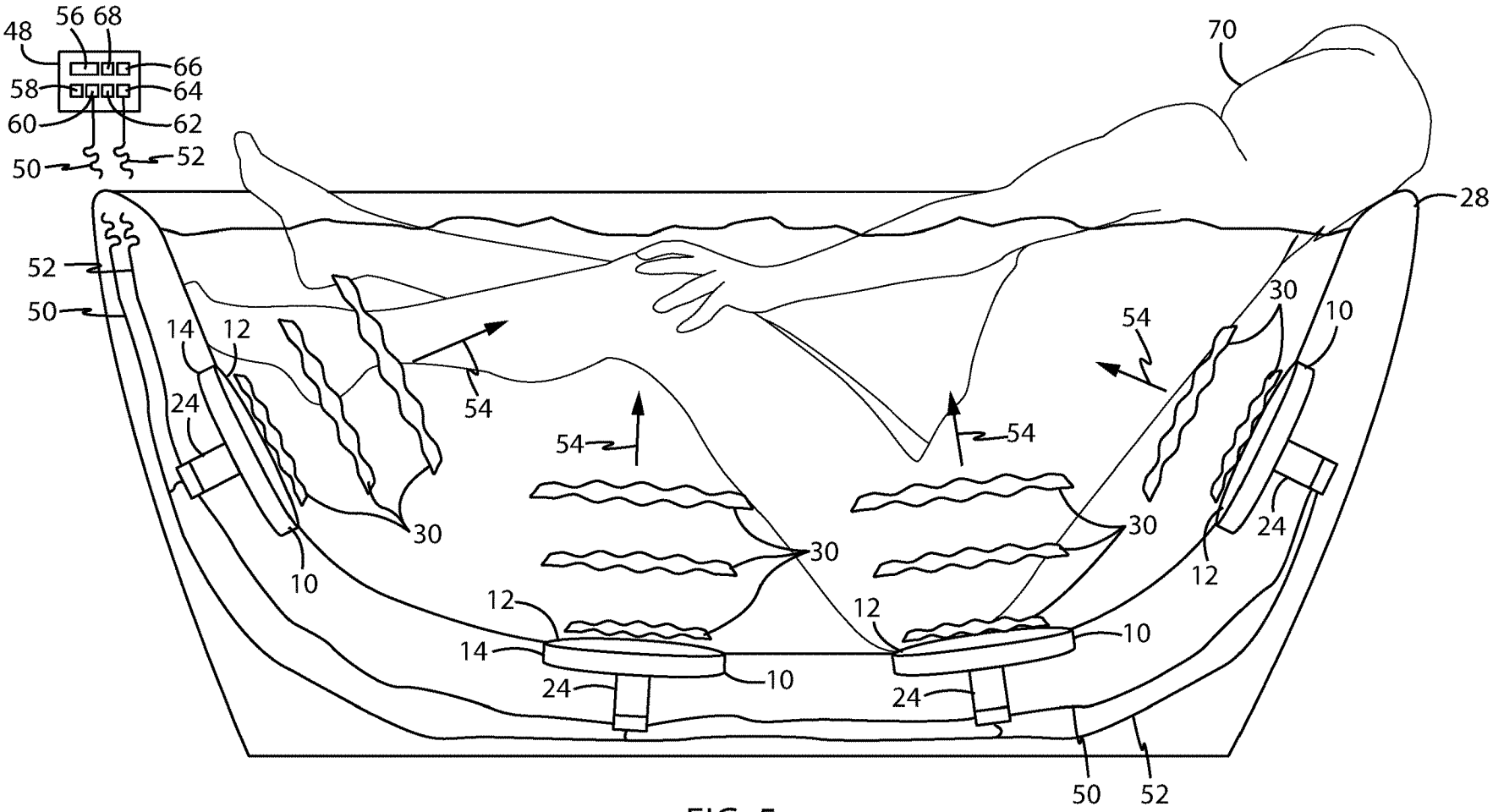
FIG. 5 is a sectional view of a basin, such as a hot tub, equipped with multiple jet assemblies as shown in FIG. 1.

Proceeding now to descriptions of the preferred and exemplary embodiments, FIGS. 1-5 show various views of a water jet device or assembly 10 and a basin, hot tub, bath tub, or spa equipped with multiple water jet assemblies according to one embodiment of the present invention. Although usable in a plurality of environments as alluded to above, jet assembly 10 is configured for use in fluid environments such as basins, pools, whirlpools, hot tubs, bathtubs, spas, and the like, as described further below and as shown in FIG. 5.

Referring to FIGS. 1-4, jet assembly 10 includes a faceplate 12 that is constructed to cooperate with a housing or base 14. Faceplate 12 defines an outlet 13 and a plurality of inlets 15 associated with generating a toroidal shaped water jet stream as disclosed further below. A diaphragm 16 is disposed between faceplate 12 and base 14. A seal 18 extends about a circumference of diaphragm 16 and is disposed between faceplate 12 and base 14. A flap assembly or arrangement 20 is disposed between base 14 and diaphragm 16. Faceplate 12 and base 14 cooperate with one another to define a chamber 22 that is shaped to accommodate motion of diaphragm 16 as disclosed further below. One lateral side of diaphragm 16 is exposed to the working fluid associated with jet assembly 10 whereas the opposite side of diaphragm 16 is fluidly isolated from the working fluid via a circumferential sealed cooperation between diaphragm 16, faceplate 12, and base 14.

Jet assembly 10 includes an exciter 24 whose operation manipulates the position of diaphragm 16 relative to faceplate 12. Exciter 24 imparts motion to or oscillates diaphragm 16 to facilitate the generation of the water jet stream. Exciter 24 can be provided in any number of forms such as a solenoid, a piston pump, a linear actuator, a rotational actuator, a speaker coil, etc. It is further appreciated that each respective exciter 24 can be physically connected to a corresponding diaphragm 16 to effectuate the desired movement of the diaphragm or positionally associated therewith such that a vacuum or other pressure signal can be utilized to effectuate motion of diaphragm 26 in response to operation of the respective exciter 24.

Jet assembly 10 pumps a very small amount of fluid that travels through the medium, in this case water, as if it was a large pulse of energy, a "wave" if you will. This effect is known in scientific communities as the toroidal soliton effect and was first characterized in mathematics and physics. A soliton is a self-reinforcing solitary wave (a wave packet or pulse) that maintains its shape while it travels at constant speed. Solitons are caused by a cancellation of nonlinear and dispersive effects in the medium. Dispersive effects refer to dispersion relations between the frequency and the speed of the waves. The soliton phenomenon was first described by John Scott Russell (1808-1882) who observed a solitary wave in the Union Canal in Scotland. Russell reproduced the phenomenon in a wave tank and named it the "Wave of Translation".

In fluid dynamics such waves are commonly referred to as Scott Russell solitary wave or solitons. Such waves are stable, and can travel over very large distances thereby providing a unique advantage in whirlpools, pools, bathtubs, etc. The term "toroidal" or torus refers to the three dimension doughnut shape of the soliton wave as it moves in a generally outward linear direction away from the origin of the soliton wave form or a direction generally aligned with an axis normal to an imaginary plane defined by the faceplate. It is appreciated that the soliton wave form can be provided as any of a ring torus, horn torus, or spindle torus, or other poly sided toroidal shapes for example, by manipulation of shape, size, and construction of the faceplate and/or inlets and outlets associated therewith, and/or via manipulation of the rate and/or amplitude associated with operation of exciter 24 and the diaphragm 16 associated therewith. Regardless of the shape, jet assembly 10 generates a soliton wave that travels in a generally outward direction, indicated by arrows 54 (FIG. 5) normal to the plane associated with faceplate 12 to generate the massaging effect associated with operation of each discrete jet assembly 10.

These and other advantages and features of the present invention are accomplished (individually, collectively, or in various subcombinations) as described below. In one embodiment of the invention, a basin 28 shaped to retain a fluid includes one or more holes or openings shaped to provide for the attachment of multiple discrete water jet assemblies 10—as shown schematically in FIG. 5.

In its simplest form, the exciter 24 associated with each water jet assembly 10 is provided as a piston pump or linear actuator that is configured to control operation of diaphragm 16 relative to a respective faceplate 12 that defines an orificed outlet. To produce the soliton effect, the volume of water displaced by operation of the piston in a unit of time is sized to work in concert with the diameter of the orifice. If the velocity of the water exiting the orifice is too low, the flow will not separate and "roll" into a donut like or toroid shape soliton. When the flow through the orifice is properly configured, a rolling donut of energy forms and that rolling donut soliton wave can travel for long distances without losing the energy in the wave. In this way each water jet assembly 10 can provide for a pleasing pulse of massage with minimal energy input.

Operation of the piston is tuned to provide a dwell or delay between generation of successive soliton waves after expelling the previous pulse of water such that the retraction associated with operation of the piston does not "suck" the toroidal flow backward and destroy some, and in some cases all, of the energy associated with the respective soliton wave. The inlets 15 and outlet 13 are shaped to mitigate interference between the incoming and outgoing fluid flows. Accordingly, the piston associated with operation of exciter 24 is allowed to dwell at the top of the travel path thereby allowing each discrete soliton wave 30 to move away from the orifice associated with outlet 13. In addition, the inlets 15 allow for additional flow into the chamber 22 in conjunction with the outlet 13, which increases the efficiency of the jet assembly 10 by reducing the necessary intake energy. The flap arrangement 20 is configured to block the inlets 15 and force the fluid completely through the outlet 13 when fluid is flowing out of the chamber 22 during each outlet or discharge stroke associated with the cyclic operation of jet assembly 10.

Additionally, retraction of a piston associated with the respective exciter 24 pulls a new pulse of water from the bathing environment into the pumping cavity via retraction of diaphragm 16 relative to inlets 15. Inlets 15 are dispersed circumferentially about faceplate 12 and radially outboard of outlet 13 to mitigate undesirable sucking of anything other than water into each water jet assembly 10 and degradation of the discrete soliton waves attributable to the incoming water stream. Check valves or flap assembly or arrangement 20 mitigate the ability of water to exit the pumping cavity or area immediately behind faceplate 12 and adjacent diaphragm 16 except through outlets 13. That is, flap arrangement 20 and diaphragm 16 cooperate with one another such that a fluid path associated with inlets 15 is interrupted prior to interruption of outlet 13 during translation of diaphragm 16 toward an inward facing surface 40 of faceplate 12.

Conversely, during intake operation, flap arrangement 20 and diaphragm 16 cooperate with the interior facing surface of faceplate 12 such that obstruction of the fluid path associated with inlets 15 is opened prior to diaphragm 16 achieving a spaced relationship relative to outlet 13. Such a consideration achieves the desired common fluid flow direction through each jet assembly 10 during operation of the discrete jet assemblies 10. When not operating, diaphragm 16 cooperates with the inward facing surface 40 of faceplate 12 such that diaphragm 16 occupies the void or flow path associated with the water flow path between inlets 15 and outlet 13 associated with the jet pumping operation. Such a construction mitigates the retention of environment water within the workings of jet assemblies 10 when the jet assemblies are not operated. Preferably, one or more of at least the working fluid exposed surfaces of faceplate 12, diaphragm 16, and/or base are coated with a silver layer or other suitable antibacterial material or coating to further mitigate existence or propagation of bacteria growth.

Figure 2:
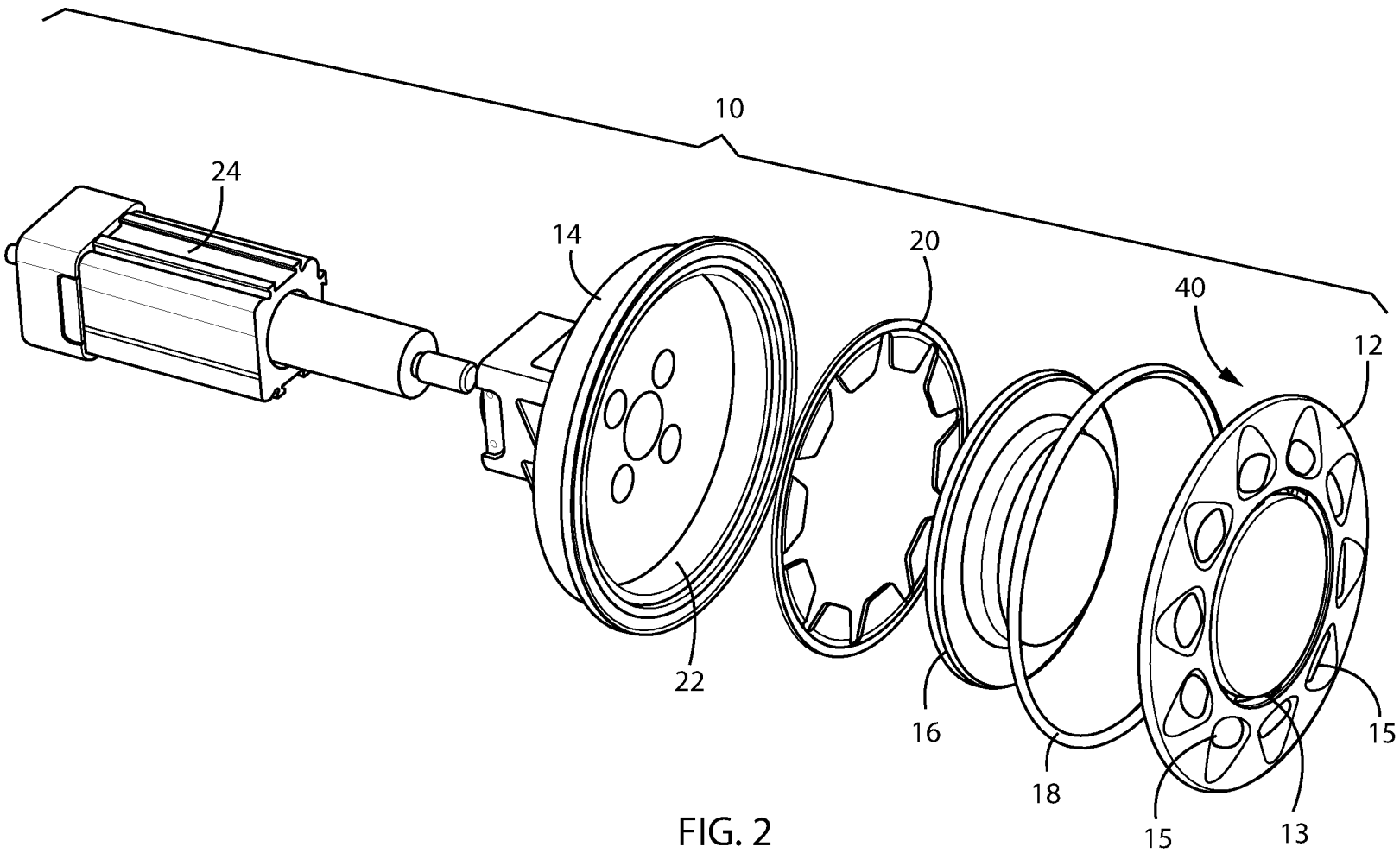
FIG. 2 is an exploded perspective view of the jet assembly shown in FIG. 1.
Figure 2B:
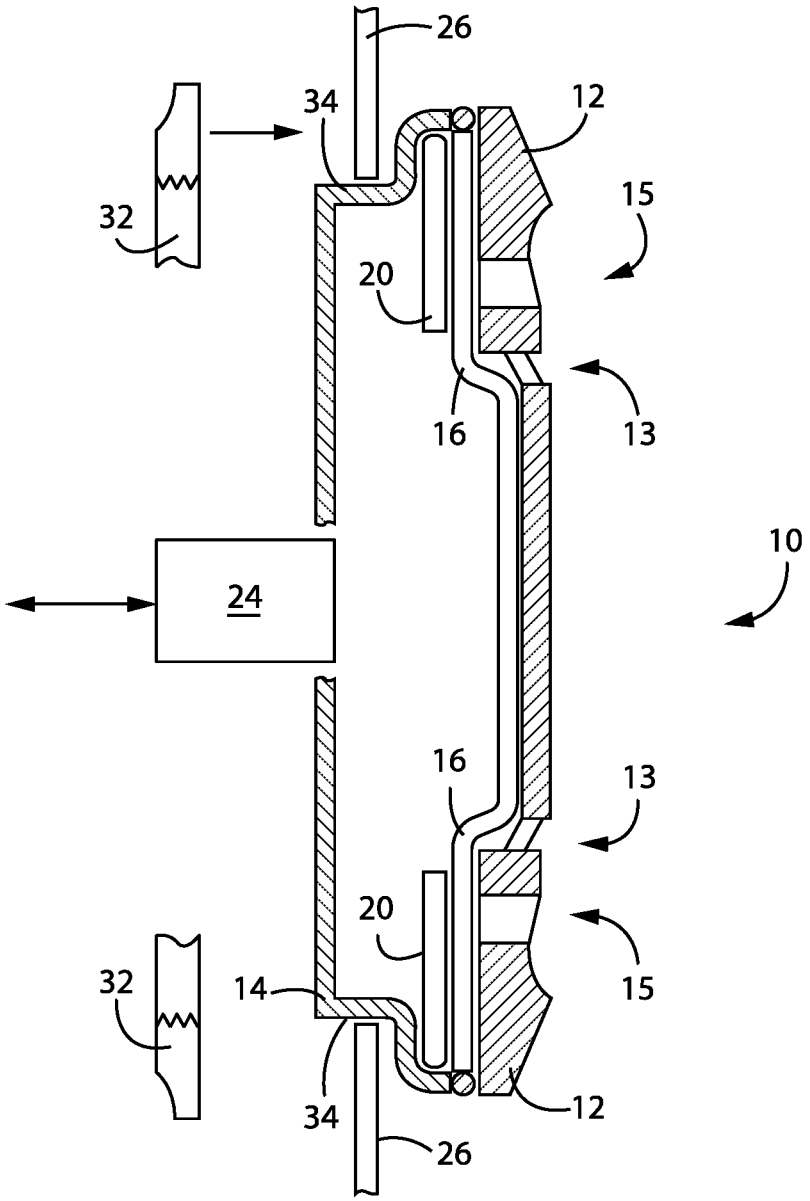
FIG. 2B is a longitudinal cross section view of the jet assembly shown in FIG. 1 with a graphical representation of the exciter associated therewith.

Referring to FIGS. 3-5, it is envisioned that basin 28 can include a plurality of jet assemblies 10. Although shown as a tub or spa, it is further appreciated that basin 28 can be provided in a variety of shapes and configured to accommodate an entire body or just portions thereof. It is further appreciated that each jet assembly 10 can be constructed to cooperate with basin 28 in a sealed manner. As shown in FIG. 2B, a wall 27 of basin 28 includes one or more openings configured to slideably receive a respective water jet assembly 10. A nut 32 or other securing arrangement rotationally cooperates with an external surface 34 of housing or base 14 of each jet assembly 10 such that each jet assembly can be secured to basin 28 in a sealed manner. It is appreciated that nut 32 could be provided to cooperate with a structure of water jet assembly 10 that is internal or external to basin 28. It is further appreciated that basin 28 could include a threaded or other interference interface about the perimeter of each opening configured to receive a respective water jet assembly 10 in a sealed manner. It is further appreciated that the sealed interaction between each jet assembly 10 and basin 28 can be provided at an interface between base 14 and faceplate 12 or other structure associated with each discrete jet assembly 10 and basin 28. It is further appreciated that extraneous securing structures, such as nut 32, can be configured to cooperate with the respective jet assemblies 10 from directions internal to the basin or external thereto.

Regardless of the specific mounting arrangement, each jet assembly 10 is connected to a control system 48 configured to control operation of the discrete exciters 24 and the jet assembly 10 associated therewith. Although each jet assembly 10 is fluidly isolated from the other jet assemblies, aside from being exposed to the working fluid associated with basin 28, each jet assembly 10 is connected to control system 48 by one or more elongated connectors 50, 52, such as wires or pneumatic tubing, to communicate the desired operating instructions to the discrete jet assemblies 10 to achieve a desired output or massage action associated with operation of the respective jet assemblies 10.

Control system 48 preferably includes a display 56 and one or more inputs 58, 60, 62, 64, 66, 68 configured to allow a user 70 to generate a desired output or massage affect associated with utilization of basin 28. Preferably control system 48 allows a limited degree of adjustability associated with the amplitude and/or frequency associated with the generation of the discrete soliton waves 30 during utilization of basin 28. It is appreciated that control system 48 can also be configured to allow the operation of only selected or desired jet assemblies 10 to satisfy different user preferences. When provided in such a methodology, it is further appreciated that the respective jet assemblies designated as preferably providing no massage effect, default to an "OFF" condition wherein the diaphragm obstructs both the outlet 13 and inlets 15 associated with a discrete jet assembly thereby isolating the internal workings of the same from the operating environment, or be allowed to operate at a frequency and/or an amplitude wherein the discrete jet assembly 10 does not generate a soliton wave 30 having an amplitude perceptible by a user 70. It should be appreciated that the operation of each discrete jet assembly 10 can be adjusted to manipulate the amplitude and or frequency of the soliton wave 30 such that the wave collapses before impinging on user 70 of basin 28. Such a consideration allows basin 28 to provide various preferred massaging effects to satisfy preferences specific to different users of basin 28.

It should be appreciated that exciter 24 associated with jet assemblies 10 can be provided in a variety of forms configured to generate the oscillated operation of diaphragm 26. It should be appreciated, from the generally elongated shape, that exciter 24 shown in FIG. 1 is commonly referred to as a linear actuator that includes a driven element that translates in a direction generally aligned with the elongated shape of the exciter. Understandably, it may periodically be desired, or even necessary, to provide the desired operation of diaphragm 16 in a more compact of alternate configuration to accommodate use of soliton water jet assemblies under various spatial constraints. FIGS. 6-9 show various views of some such exemplary exciter configurations.

Figure 6:
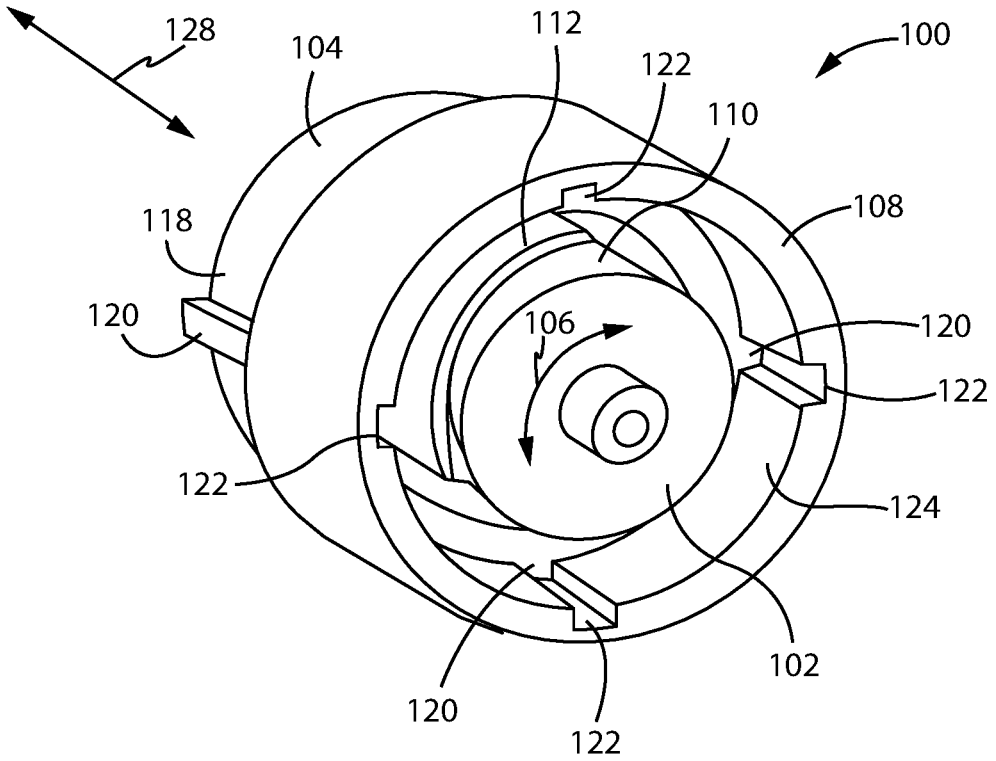
FIGS. 6 and 7 are perspective graphical representations of an exciter assembly associated with forming a water jet assembly according to another embodiment of the present invention.
Figure 7:
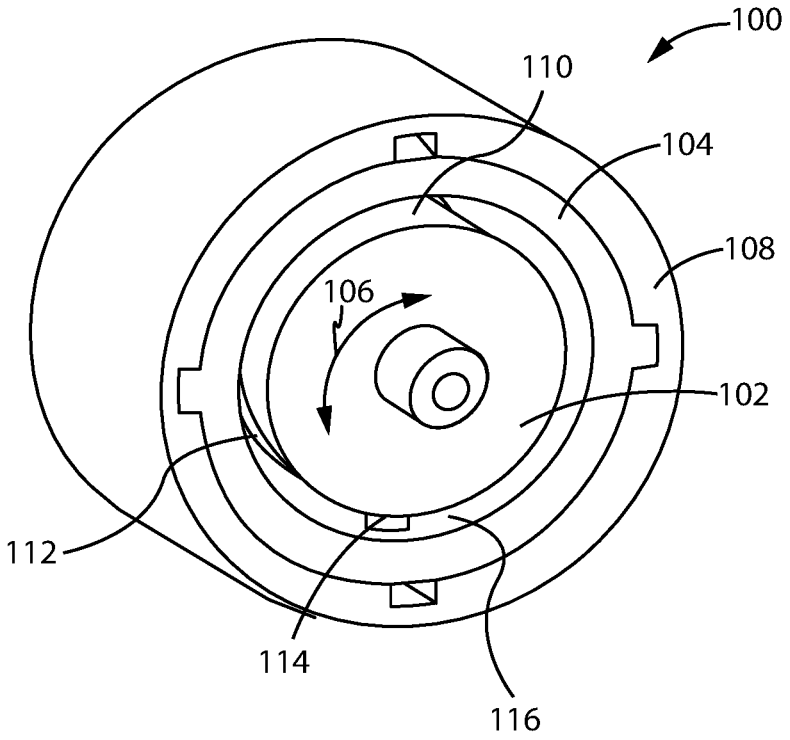

FIGS. 6 and 7 shown a first exciter drive arrangement 100 according to an alternate embodiment of the present invention. Drive arrangement 100 includes a drive element 102 and a driven element 104. Drive element 102 is configured to be driven in a rotational direction, indicated by arrow 106, relative to driven element 104 and a base or housing element 108. An outward radial surface 110 of drive element 102 includes a chase for groove 112 that extends circumferentially about outward radial surface 110 of drive element 102. A post 114 extends from a radially inward facing surface 116 of driven element 104 and slideably cooperates with groove 112 defined by drive element 102.

An outward radial surface 118 of driven element 104 includes one or more ribs 120, that slideably cooperate with a respective groove 122 associated with a radially inward facing surface 124 of housing 108. The slideable cooperation of ribs 120 and grooves 122 facilitates an axially slideable association between driven element 104 and drive element 102 and housing 108. Groove 112 associated with drive element 102 translates in an axial direction, indicated by arrow 128, along the circumference of the exterior surface 110 of drive element 102. During rotation 106 of drive element 102, the slideable cooperation between post 114 and groove 112 effectuate axial translation 128 of driven element 104 relative to drive element 102 and housing 108 thereby generating linear axial oscillation of driven element 104 in response to rotation 106 of drive element 102. The linear axial translation 128 of driven element 104 relative to housing 108 and drive element 102 generates the desired oscillation of diaphragm 116, so as to facilitate sequential generation of multiple soliton waves 30 in response to a rotational input signal associated with rotation 106 of drive element 102.

Figure 8:
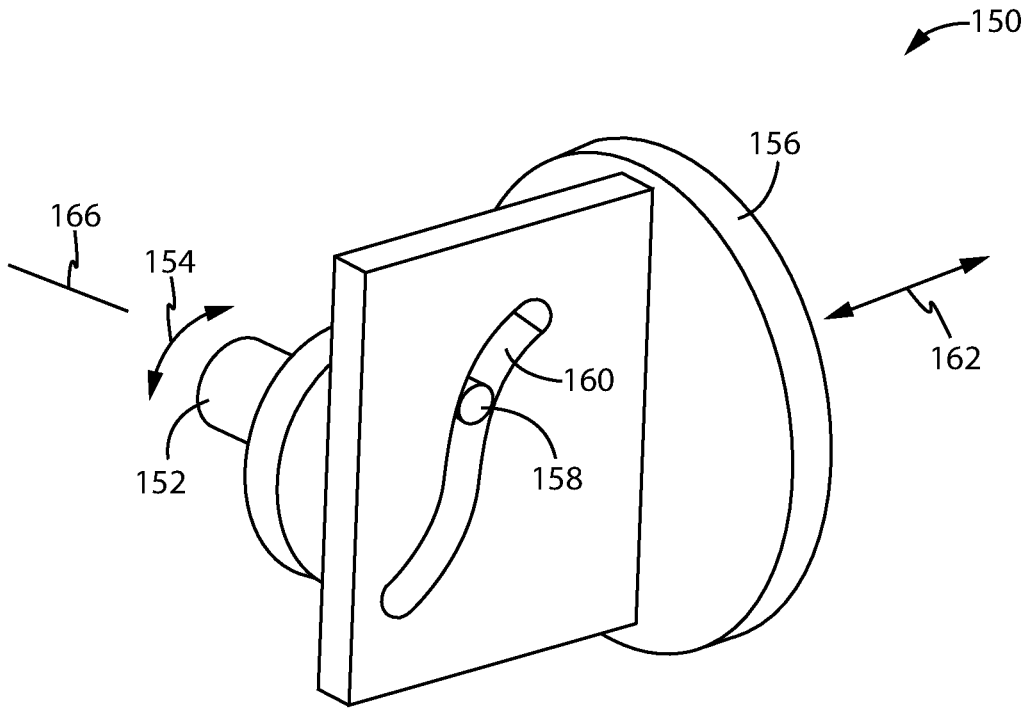
FIG. 8 is a perspective graphical representation of an exciter assembly associated with forming a water jet assembly according to another embodiment of the invention.
Figure 9:
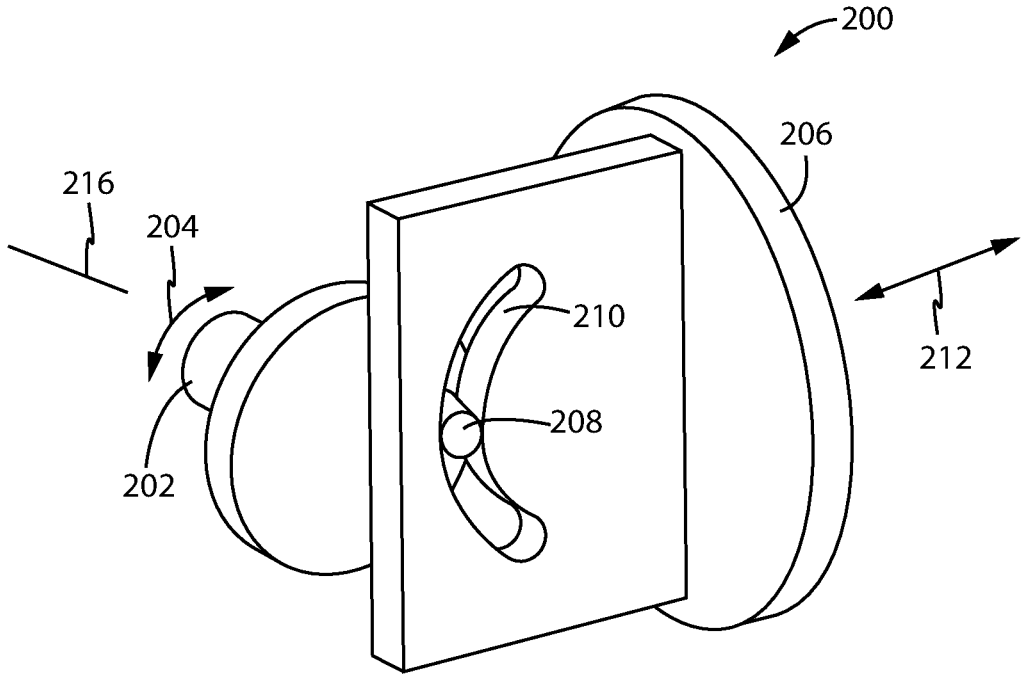
FIG. 9 is a perspective graphical representation of an exciter assembly associated with forming a water jet assembly according to another embodiment of the invention.

FIGS. 8 and 9 show alternate exciter drive arrangements, 150, 200 according to yet other embodiments of the present invention. Each drive arrangement 150, 200 includes a drive element 152, 202 that is driven in a rotational direction, indicated by arrows 154, 204, respectively, and operatively associated with a driven element 156, 206. Each drive element 152, 202 includes a post 158, 208 that slideably cooperates with a groove or channel 160, 210 associated with the respective driven element 156, 206. Each channel 160, 210 is contoured to generate a linear axial translation, indicated by arrows 162, 212 of the respective driven element 156, 206 in response to rotation 154, 204 of the respective drive element 152, 202. Respective posts 158, 208 are offset in a radial direction relative to the respective axis of rotation, 166, 216 of the respective drive element 152, 202, such that the slideable cooperation between posts 158, 208 with respective channels, 160, 210 effectuate the sequential axial translation, 162, 212 of the respective driven element 156, 206 and generate the desired oscillation of diaphragm 16 to facilitate sequential generation of solid time waves 30.

As compared to the embodiment shown in FIGS. 6 and 7, wherein the axis of rotation associated with drive element 102 is generally aligned with the longitudinal displacement axis 128, it should be appreciated that rotational axes 166, 216 associated with the embodiments shown in FIGS. 8 and 9 are oriented in a crossing direction relative to the axis associated with the longitudinal displacement axis 162, 212, respectively, of the driven element. Such a consideration accommodates those configurations wherein close spatial restrictions reduce the ability to utilize generally elongated exciter orientations, such as that shown in FIG. 2. It is further appreciated that the various embodiments shown in FIGS. 6-9, are merely exemplary of various exciter drive arrangements envisioned to be utilized in the generation of soliton waves 30. It should be further appreciated that the general orientation, shape, and construction of posts 158, 208 and channels, 160, 210 are merely exemplary and that other configurations, even reverse configurations of the post and channel relative to the drive and driven elements, are envisioned for converting the rotational input associated with operation of respective drive elements 152, 202, to generate the longitudinal axial displacement, 162, 212 associated with respective driven elements 156, 206.

Figure 10:
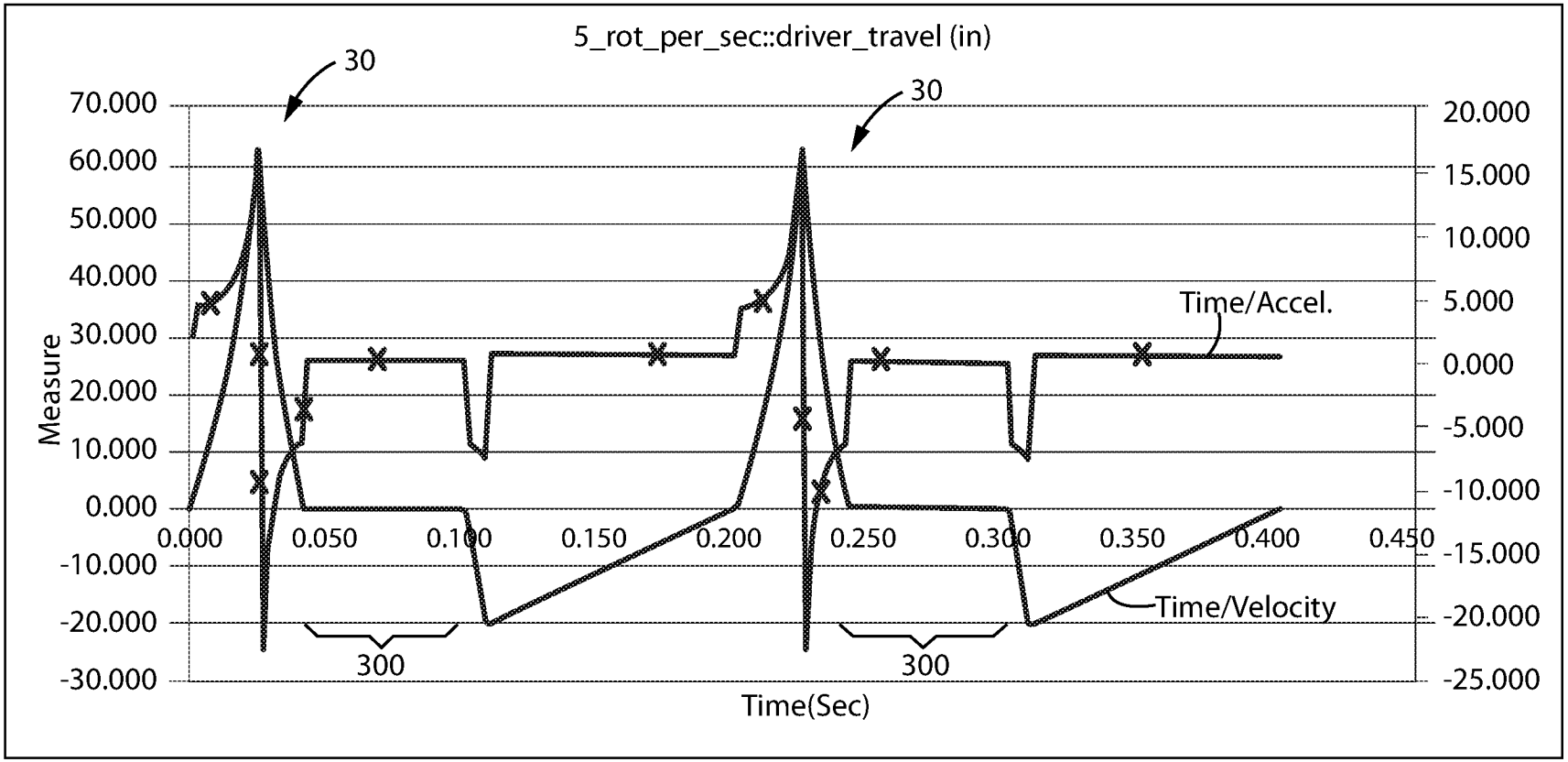
FIG. 10 is a graph showing the generation of sequential soliton waves associated with operation of a water jet assembly equipped with an exciter according to any of the above embodiments.

The table below includes the data associated with sequentially generating a plurality of soliton waves 30 according to any of the embodiments described above. The data in each successive right hand column follows the data in the immediately preceding left hand column. FIG. 10 is a graphical representation of the data presented below.

TABLE 1

| Time (Sec) | Position (in | Veloc (in/s) | Accel (g's) |
|---|---|---|---|
| 0.000 | 0.478 | | |
| 0.001 | 0.478 | 0.833 | 2.156 |
| 0.002 | 0.481 | 2.504 | 4.323 |
| 0.003 | 0.485 | 4.182 | 4.343 |
| 0.004 | 0.491 | 5.870 | 4.370 |
| 0.005 | 0.498 | 7.584 | 4.435 |
| 0.006 | 0.508 | 9.329 | 4.515 |
| 0.007 | 0.519 | 11.100 | 4.585 |
| 0.008 | 0.532 | 12.909 | 4.680 |
| 0.009 | 0.547 | 14.773 | 4.824 |
| 0.010 | 0.563 | 16.692 | 4.968 |
| 0.011 | 0.582 | 18.675 | 5.132 |
| 0.012 | 0.603 | 20.754 | 5.378 |
| 0.013 | 0.626 | 22.937 | 5.650 |
| 0.014 | 0.651 | 25.226 | 5.923 |
| 0.015 | 0.678 | 27.615 | 6.184 |
| 0.016 | 0.709 | 30.158 | 6.575 |
| 0.017 | 0.742 | 32.923 | 7.161 |
| 0.018 | 0.777 | 35.915 | 7.743 |
| 0.019 | 0.817 | 39.172 | 8.430 |
| 0.020 | 0.859 | 42.823 | 9.448 |
| 0.021 | 0.906 | 46.853 | 10.430 |
| 0.022 | 0.958 | 51.370 | 11.691 |
| 0.023 | 1.014 | 56.712 | 13.825 |
| 0.024 | 1.077 | 63.096 | 16.520 |
| 0.025 | 1.139 | 61.495 | −4.142 |
| 0.026 | 1.192 | 52.658 | −22.870 |
| 0.027 | 1.237 | 45.740 | −17.904 |
| 0.028 | 1.278 | 40.129 | −14.521 |
| 0.029 | 1.313 | 35.258 | −12.620 |
| 0.030 | 1.344 | 30.867 | −11.349 |
| 0.031 | 1.371 | 26.928 | −10.196 |
| 0.032 | 1.394 | 23.439 | −9.028 |
| 0.033 | 1.414 | 20.234 | −8.296 |
| 0.034 | 1.431 | 17.200 | −7.851 |
| 0.035 | 1.446 | 14.301 | −7.502 |
| 0.036 | 1.457 | 11.537 | −7.153 |
| 0.037 | 1.466 | 8.907 | −6.808 |
| 0.038 | 1.473 | 6.324 | −6.683 |
| 0.039 | 1.476 | 3.754 | −6.652 |
| 0.040 | 1.478 | 1.234 | −6.522 |
| 0.041 | 1.478 | 0.000 | −3.193 |
| 0.042 | 1.478 | 0.000 | 0.000 |
| 0.043 | 1.478 | 0.000 | 0.000 |
| 0.044 | 1.478 | 0.000 | 0.000 |
| 0.045 | 1.478 | 0.000 | 0.000 |
| 0.046 | 1.478 | 0.000 | 0.000 |
| 0.047 | 1.478 | 0.000 | 0.000 |
| 0.048 | 1.478 | 0.000 | 0.000 |
| 0.049 | 1.478 | 0.000 | 0.000 |
| 0.050 | 1.478 | 0.000 | 0.000 |
| 0.051 | 1.478 | 0.000 | 0.000 |
| 0.052 | 1.478 | 0.000 | 0.000 |
| 0.053 | 1.478 | 0.000 | 0.000 |
| 0.054 | 1.478 | 0.000 | 0.000 |
| 0.055 | 1.478 | 0.000 | 0.000 |
| 0.056 | 1.478 | 0.000 | 0.000 |
| 0.057 | 1.478 | 0.000 | 0.000 |
| 0.058 | 1.478 | 0.000 | 0.000 |
| 0.059 | 1.478 | 0.000 | 0.000 |
| 0.060 | 1.478 | 0.000 | 0.000 |
| 0.061 | 1.478 | 0.000 | 0.000 |
| 0.062 | 1.478 | 0.000 | 0.000 |
| 0.063 | 1.478 | 0.000 | 0.000 |
| 0.064 | 1.478 | 0.000 | 0.000 |
| 0.065 | 1.478 | 0.000 | 0.000 |
| 0.066 | 1.478 | 0.000 | 0.000 |
| 0.067 | 1.478 | 0.000 | 0.000 |
| 0.068 | 1.478 | 0.000 | 0.000 |
| 0.069 | 1.478 | 0.000 | 0.000 |
| 0.070 | 1.478 | 0.000 | 0.000 |
| 0.071 | 1.478 | 0.000 | 0.000 |
| 0.072 | 1.478 | 0.000 | 0.000 |
| 0.073 | 1.478 | 0.000 | 0.000 |
| 0.074 | 1.478 | 0.000 | 0.000 |
| 0.075 | 1.478 | 0.000 | 0.000 |
| 0.076 | 1.478 | 0.000 | 0.000 |
| 0.077 | 1.478 | 0.000 | 0.000 |

TABLE 1-continued

| Time (Sec) | Position (in | Veloc (in/s) | Accel (g's) |
|---|---|---|---|
| 0.078 | 1.478 | 0.000 | 0.000 |
| 0.079 | 1.478 | 0.000 | 0.000 |
| 0.080 | 1.478 | 0.000 | 0.000 |
| 0.081 | 1.478 | 0.000 | 0.000 |
| 0.082 | 1.478 | 0.000 | 0.000 |
| 0.083 | 1.478 | 0.000 | 0.000 |
| 0.084 | 1.478 | 0.000 | 0.000 |
| 0.085 | 1.478 | 0.000 | 0.000 |
| 0.086 | 1.478 | 0.000 | 0.000 |
| 0.087 | 1.478 | 0.000 | 0.000 |
| 0.088 | 1.478 | 0.000 | 0.000 |
| 0.089 | 1.478 | 0.000 | 0.000 |
| 0.090 | 1.478 | 0.000 | 0.000 |
| 0.091 | 1.478 | 0.000 | 0.000 |
| 0.092 | 1.478 | 0.000 | 0.000 |
| 0.093 | 1.478 | 0.000 | 0.000 |
| 0.094 | 1.478 | 0.000 | 0.000 |
| 0.095 | 1.478 | 0.000 | 0.000 |
| 0.096 | 1.478 | 0.000 | 0.000 |
| 0.097 | 1.478 | 0.000 | 0.000 |
| 0.098 | 1.478 | 0.000 | 0.000 |
| 0.099 | 1.478 | 0.000 | 0.000 |
| 0.100 | 1.478 | 0.000 | 0.000 |
| 0.101 | 1.476 | −1.246 | −3.225 |
| 0.102 | 1.472 | −3.762 | −6.511 |
| 0.103 | 1.466 | −6.308 | −6.590 |
| 0.104 | 1.457 | −8.893 | −6.688 |
| 0.105 | 1.446 | −11.546 | −6.867 |
| 0.106 | 1.431 | −14.300 | −7.126 |
| 0.107 | 1.414 | −17.192 | −7.485 |
| 0.108 | 1.394 | −20.074 | −7.459 |
| 0.109 | 1.374 | −20.620 | −1.414 |
| 0.110 | 1.353 | −20.358 | 0.680 |
| 0.111 | 1.333 | −20.096 | 0.678 |
| 0.112 | 1.313 | −19.835 | 0.676 |
| 0.113 | 1.294 | −19.574 | 0.674 |
| 0.114 | 1.274 | −19.316 | 0.668 |
| 0.115 | 1.255 | −19.062 | 0.658 |
| 0.116 | 1.237 | −18.810 | 0.652 |
| 0.117 | 1.218 | −18.559 | 0.648 |
| 0.118 | 1.200 | −18.308 | 0.649 |
| 0.119 | 1.182 | −18.056 | 0.653 |
| 0.120 | 1.164 | −17.803 | 0.655 |
| 0.121 | 1.146 | −17.550 | 0.654 |
| 0.122 | 1.129 | −17.300 | 0.649 |
| 0.123 | 1.112 | −17.053 | 0.639 |
| 0.124 | 1.095 | −16.811 | 0.627 |
| 0.125 | 1.078 | −16.571 | 0.619 |
| 0.126 | 1.062 | −16.333 | 0.617 |
| 0.127 | 1.046 | −16.093 | 0.620 |
| 0.128 | 1.030 | −15.851 | 0.628 |
| 0.129 | 1.015 | −15.607 | 0.632 |
| 0.130 | 0.999 | −15.363 | 0.632 |
| 0.131 | 0.984 | −15.121 | 0.626 |
| 0.132 | 0.969 | −14.883 | 0.617 |
| 0.133 | 0.955 | −14.649 | 0.605 |
| 0.134 | 0.940 | −14.418 | 0.597 |
| 0.135 | 0.926 | −14.188 | 0.594 |
| 0.136 | 0.912 | −13.958 | 0.597 |
| 0.137 | 0.898 | −13.724 | 0.605 |
| 0.138 | 0.885 | −13.489 | 0.608 |
| 0.139 | 0.872 | −13.254 | 0.608 |
| 0.140 | 0.859 | −13.021 | 0.604 |
| 0.141 | 0.846 | −12.790 | 0.596 |
| 0.142 | 0.833 | −12.563 | 0.588 |
| 0.143 | 0.821 | −12.338 | 0.583 |
| 0.144 | 0.809 | −12.113 | 0.582 |
| 0.145 | 0.797 | −11.888 | 0.583 |
| 0.146 | 0.785 | −11.661 | 0.587 |
| 0.147 | 0.774 | −11.434 | 0.587 |
| 0.148 | 0.763 | −11.208 | 0.584 |
| 0.149 | 0.752 | −10.984 | 0.581 |
| 0.150 | 0.741 | −10.761 | 0.577 |
| 0.151 | 0.730 | −10.539 | 0.574 |
| 0.152 | 0.720 | −10.318 | 0.574 |
| 0.153 | 0.710 | −10.096 | 0.574 |
| 0.154 | 0.700 | −9.874 | 0.573 |
| 0.155 | 0.690 | −9.653 | 0.573 |

TABLE 1-continued

| Time (Sec) | Position (in | Veloc (in/s) | Accel (g's) |
|---|---|---|---|
| 0.156 | 0.681 | −9.433 | 0.570 |
| 0.157 | 0.672 | −9.214 | 0.565 |
| 0.158 | 0.663 | −8.997 | 0.562 |
| 0.159 | 0.654 | −8.780 | 0.561 |
| 0.160 | 0.645 | −8.563 | 0.562 |
| 0.161 | 0.637 | −8.345 | 0.565 |
| 0.162 | 0.629 | −8.126 | 0.566 |
| 0.163 | 0.621 | −7.908 | 0.566 |
| 0.164 | 0.613 | −7.690 | 0.563 |
| 0.165 | 0.606 | −7.475 | 0.558 |
| 0.166 | 0.599 | −7.261 | 0.551 |
| 0.167 | 0.591 | −7.050 | 0.548 |
| 0.168 | 0.585 | −6.838 | 0.549 |
| 0.169 | 0.578 | −6.624 | 0.552 |
| 0.170 | 0.572 | −6.409 | 0.557 |
| 0.171 | 0.565 | −6.193 | 0.559 |
| 0.172 | 0.559 | −5.977 | 0.559 |
| 0.173 | 0.554 | −5.763 | 0.555 |
| 0.174 | 0.548 | −5.551 | 0.549 |
| 0.175 | 0.543 | −5.341 | 0.543 |
| 0.176 | 0.538 | −5.132 | 0.540 |
| 0.177 | 0.533 | −4.923 | 0.541 |
| 0.178 | 0.528 | −4.713 | 0.545 |
| 0.179 | 0.524 | −4.500 | 0.550 |
| 0.180 | 0.519 | −4.287 | 0.552 |
| 0.181 | 0.515 | −4.074 | 0.552 |
| 0.182 | 0.511 | −3.852 | 0.548 |
| 0.183 | 0.508 | −3.652 | 0.543 |
| 0.184 | 0.504 | −3.444 | 0.538 |
| 0.185 | 0.501 | −3.237 | 0.536 |
| 0.186 | 0.498 | −3.029 | 0.537 |
| 0.187 | 0.495 | −2.820 | 0.541 |
| 0.188 | 0.493 | −2.610 | 0.545 |
| 0.189 | 0.490 | −2.399 | 0.546 |
| 0.190 | 0.488 | −2.188 | 0.545 |
| 0.191 | 0.486 | −1.978 | 0.543 |
| 0.192 | 0.484 | −1.770 | 0.539 |
| 0.193 | 0.483 | −1.563 | 0.537 |
| 0.194 | 0.481 | −1.355 | 0.537 |
| 0.195 | 0.480 | −1.147 | 0.538 |
| 0.196 | 0.479 | −0.939 | 0.540 |
| 0.197 | 0.478 | −0.730 | 0.541 |
| 0.198 | 0.478 | −0.521 | 0.541 |
| 0.199 | 0.478 | −0.312 | 0.540 |
| 0.200 | 0.478 | −0.104 | 0.539 |
| 0.201 | 0.478 | 0.833 | 2.425 |
| 0.202 | 0.481 | 2.504 | 4.323 |
| 0.202 | 0.485 | 4.182 | 4.343 |
| 0.204 | 0.491 | 5.870 | 4.370 |
| 0.205 | 0.498 | 7.584 | 4.435 |
| 0.206 | 0.508 | 9.329 | 4.515 |
| 0.207 | 0.519 | 11.100 | 4.585 |
| 0.208 | 0.532 | 12.909 | 4.680 |
| 0.209 | 0.547 | 14.773 | 4.624 |
| 0.210 | 0.563 | 16.692 | 4.968 |
| 0.211 | 0.582 | 18.675 | 5.132 |
| 0.212 | 0.603 | 20.754 | 5.378 |
| 0.213 | 0.626 | 22.937 | 5.650 |
| 0.214 | 0.651 | 25.226 | 5.923 |
| 0.215 | 0.678 | 27.615 | 6.184 |
| 0.216 | 0.709 | 30.156 | 5.575 |
| 0.217 | 0.742 | 32.923 | 7.161 |
| 0.218 | 0.777 | 35.915 | 7.743 |
| 0.219 | 0.817 | 39.172 | 8.430 |
| 0.220 | 0.859 | 42.823 | 9.448 |
| 0.221 | 0.906 | 46.853 | 10.430 |
| 0.222 | 0.958 | 51.370 | 11.691 |
| 0.223 | 1.014 | 56.712 | 13.825 |
| 0.224 | 1.077 | 63.096 | 16.520 |
| 0.225 | 1.139 | 61.495 | −4.142 |
| 0.226 | 1.192 | 52.658 | −25.870 |
| 0.227 | 1.237 | 45.740 | −17.904 |
| 0.228 | 1.278 | 40.129 | −14.521 |
| 0.229 | 1.313 | 35.253 | −12.620 |
| 0.230 | 1.344 | 30.867 | −11.349 |
| 0.231 | 1.371 | 26.928 | −10.196 |
| 0.232 | 1.394 | 23.439 | −9.028 |
| 0.233 | 1.414 | 20.234 | −8.296 |

TABLE 1-continued

| Time (Sec) | Position (in | Veloc (in/s) | Accel (g's) |
|---|---|---|---|
| 0.234 | 1.431 | 17.200 | −7.851 |
| 0.235 | 1.446 | 14.301 | −7.502 |
| 0.236 | 1.457 | 11.537 | −7.153 |
| 0.237 | 1.466 | 8.907 | −6.808 |
| 0.238 | 1.473 | 6.324 | −6.683 |
| 0.239 | 1.476 | 3.754 | −6.652 |
| 0.240 | 1.478 | 1.234 | −6.522 |
| 0.241 | 1.478 | 0.000 | −3.193 |
| 0.242 | 1.478 | 0.000 | 0.000 |
| 0.243 | 1.478 | 0.000 | 0.000 |
| 0.244 | 1.478 | 0.000 | 0.000 |
| 0.245 | 1.478 | 0.000 | 0.000 |
| 0.246 | 1.478 | 0.000 | 0.000 |
| 0.247 | 1.478 | 0.000 | 0.000 |
| 0.248 | 1.478 | 0.000 | 0.000 |
| 0.249 | 1.478 | 0.000 | 0.000 |
| 0.250 | 1.478 | 0.000 | 0.000 |
| 0.251 | 1.478 | 0.000 | 0.000 |
| 0.252 | 1.478 | 0.000 | 0.000 |
| 0.253 | 1.478 | 0.000 | 0.000 |
| 0.254 | 1.478 | 0.000 | 0.000 |
| 0.255 | 1.478 | 0.000 | 0.000 |
| 0.256 | 1.478 | 0.000 | 0.000 |
| 0.257 | 1.478 | 0.000 | 0.000 |
| 0.258 | 1.478 | 0.000 | 0.000 |
| 0.259 | 1.478 | 0.000 | 0.000 |
| 0.260 | 1.478 | 0.000 | 0.000 |
| 0.261 | 1.478 | 0.000 | 0.000 |
| 0.262 | 1.478 | 0.000 | 0.000 |
| 0.263 | 1.478 | 0.000 | 0.000 |
| 0.264 | 1.478 | 0.000 | 0.000 |
| 0.265 | 1.478 | 0.000 | 0.000 |
| 0.266 | 1.478 | 0.000 | 0.000 |
| 0.267 | 1.478 | 0.000 | 0.000 |
| 0.268 | 1.478 | 0.000 | 0.000 |
| 0.269 | 1.478 | 0.000 | 0.000 |
| 0.270 | 1.478 | 0.000 | 0.000 |
| 0.271 | 1.478 | 0.000 | 0.000 |
| 0.272 | 1.478 | 0.000 | 0.000 |
| 0.273 | 1.478 | 0.000 | 0.000 |
| 0.274 | 1.478 | 0.000 | 0.000 |
| 0.275 | 1.478 | 0.000 | 0.000 |
| 0.276 | 1.478 | 0.000 | 0.000 |
| 0.277 | 1.478 | 0.000 | 0.000 |
| 0.278 | 1.478 | 0.000 | 0.000 |
| 0.279 | 1.478 | 0.000 | 0.000 |
| 0.280 | 1.478 | 0.000 | 0.000 |
| 0.281 | 1.478 | 0.000 | 0.000 |
| 0.282 | 1.478 | 0.000 | 0.000 |
| 0.283 | 1.478 | 0.000 | 0.000 |
| 0.284 | 1.478 | 0.000 | 0.000 |
| 0.285 | 1.478 | 0.000 | 0.000 |
| 0.286 | 1.478 | 0.000 | 0.000 |
| 0.287 | 1.478 | 0.000 | 0.000 |
| 0.288 | 1.478 | 0.000 | 0.000 |
| 0.289 | 1.478 | 0.000 | 0.000 |
| 0.290 | 1.478 | 0.000 | 0.000 |
| 0.291 | 1.478 | 0.000 | 0.000 |
| 0.292 | 1.478 | 0.000 | 0.000 |
| 0.293 | 1.478 | 0.000 | 0.000 |
| 0.294 | 1.478 | 0.000 | 0.000 |
| 0.295 | 1.478 | 0.000 | 0.000 |
| 0.296 | 1.478 | 0.000 | 0.000 |
| 0.297 | 1.478 | 0.000 | 0.000 |
| 0.298 | 1.478 | 0.000 | 0.000 |
| 0.299 | 1.478 | 0.000 | 0.000 |
| 0.300 | 1.478 | 0.000 | 0.000 |
| 0.301 | 1.476 | −1.246 | −3.225 |
| 0.302 | 1.472 | −3.762 | −6.511 |
| 0.303 | 1.466 | −6.308 | −6.590 |
| 0.304 | 1.457 | −8.893 | −6.688 |
| 0.305 | 1.446 | −11.546 | −6.867 |
| 0.306 | 1.431 | −14.300 | −7.126 |
| 0.307 | 1.414 | −17.192 | −7.485 |
| 0.308 | 1.394 | −20.074 | −7.459 |
| 0.309 | 1.374 | −20.620 | −1.414 |
| 0.310 | 1.353 | −20.358 | 0.680 |
| 0.311 | 1.333 | −20.096 | 0.678 |

TABLE 1-continued

| Time (Sec) | Position (in | Veloc (in/s) | Accel (g's) |
|---|---|---|---|
| 0.312 | 1.313 | −19.835 | 0.676 |
| 0.313 | 1.294 | −19.574 | 0.674 |
| 0.314 | 1.274 | −19.316 | 0.668 |
| 0.315 | 1.255 | −19.062 | 0.658 |
| 0.316 | 1.237 | −18.810 | 0.652 |
| 0.317 | 1.218 | −18.559 | 0.648 |
| 0.318 | 1.200 | −18.308 | 0.649 |
| 0.319 | 1.182 | −18.056 | 0.653 |
| 0.320 | 1.164 | −17.803 | 0.655 |
| 0.321 | 1.146 | −17.550 | 0.654 |
| 0.322 | 1.129 | −17.300 | 0.649 |
| 0.323 | 1.112 | −17.053 | 0.639 |
| 0.324 | 1.095 | −16.811 | 0.627 |
| 0.325 | 1.078 | −16.571 | 0.619 |
| 0.326 | 1.062 | −16.333 | 0.617 |
| 0.327 | 1.046 | −16.093 | 0.620 |
| 0.328 | 1.030 | −15.851 | 0.628 |
| 0.329 | 1.015 | −15.607 | 0.632 |
| 0.330 | 0.999 | −15.363 | 0.632 |
| 0.331 | 0.984 | −15.121 | 0.626 |
| 0.332 | 0.969 | −14.883 | 0.617 |
| 0.333 | 0.955 | −14.649 | 0.605 |
| 0.334 | 0.940 | −14.418 | 0.597 |
| 0.335 | 0.926 | −14.188 | 0.594 |
| 0.336 | 0.912 | −13.958 | 0.597 |
| 0.337 | 0.898 | −13.724 | 0.605 |
| 0.338 | 0.885 | −13.489 | 0.608 |
| 0.339 | 0.872 | −13.254 | 0.608 |
| 0.340 | 0.859 | −13.021 | 0.604 |
| 0.341 | 0.846 | −12.790 | 0.596 |
| 0.342 | 0.833 | −12.563 | 0.588 |
| 0.343 | 0.821 | −12.338 | 0.563 |
| 0.344 | 0.809 | −12.113 | 0.582 |
| 0.345 | 0.797 | −11.888 | 0.583 |
| 0.346 | 0.785 | −11.661 | 0.587 |
| 0.347 | 0.774 | −11.434 | 0.587 |
| 0.348 | 0.763 | −11.208 | 0.584 |
| 0.349 | 0.752 | −10.984 | 0.581 |
| 0.350 | 0.741 | −10.761 | 0.577 |
| 0.351 | 0.730 | −10.539 | 0.574 |
| 0.352 | 0.720 | −10.318 | 0.574 |
| 0.353 | 0.710 | −10.096 | 0.574 |
| 0.354 | 0.700 | −9.874 | 0.573 |
| 0.355 | 0.690 | −9.653 | 0.573 |
| 0.356 | 0.681 | −9.433 | 0.570 |
| 0.357 | 0.672 | −9.214 | 0.565 |
| 0.358 | 0.663 | −8.997 | 0.562 |
| 0.359 | 0.654 | −8.780 | 0.561 |
| 0.360 | 0.645 | −8.563 | 0.562 |
| 0.361 | 0.637 | −8.345 | 0.565 |
| 0.362 | 0.629 | −8.126 | 0.566 |
| 0.363 | 0.621 | −7.908 | 0.566 |
| 0.364 | 0.613 | −7.690 | 0.563 |
| 0.365 | 0.606 | −7.475 | 0.558 |
| 0.366 | 0.599 | −7.261 | 0.551 |
| 0.367 | 0.591 | −7.050 | 0.548 |
| 0.368 | 0.585 | −6.838 | 0.549 |
| 0.369 | 0.578 | −6.624 | 0.552 |
| 0.370 | 0.572 | −6.409 | 0.557 |
| 0.371 | 0.565 | −6.193 | 0.559 |
| 0.372 | 0.559 | −5.977 | 0.559 |
| 0.373 | 0.554 | −5.763 | 0.555 |
| 0.374 | 0.548 | −5.551 | 0.549 |
| 0.375 | 0.543 | −5.341 | 0.543 |
| 0.376 | 0.538 | −5.132 | 0.540 |
| 0.377 | 0.533 | −4.923 | 0.541 |
| 0.378 | 0.528 | −4.713 | 0.545 |
| 0.379 | 0.524 | −4.500 | 0.550 |
| 0.380 | 0.519 | −4.287 | 0.552 |
| 0.381 | 0.515 | −4.074 | 0.552 |
| 0.382 | 0.511 | −3.862 | 0.548 |
| 0.383 | 0.508 | −3.652 | 0.543 |
| 0.384 | 0.504 | −3.444 | 0.538 |
| 0.385 | 0.501 | −3.237 | 0.536 |
| 0.386 | 0.498 | −3.029 | 0.537 |
| 0.387 | 0.495 | −2.820 | 0.541 |
| 0.388 | 0.493 | −2.610 | 0.545 |
| 0.389 | 0.490 | −2.399 | 0.546 |

TABLE 1-continued

| Time (Sec) | Position (in | Veloc (in/s) | Accel (g's) |
|---|---|---|---|
| 0.390 | 0.488 | −2.188 | 0.545 |
| 0.391 | 0.486 | −1.978 | 0.543 |
| 0.392 | 0.484 | −1.770 | 0.539 |
| 0.393 | 0.483 | −1.563 | 0.537 |
| 0.394 | 0.481 | −1.359 | 0.537 |
| 0.395 | 0.480 | −1.147 | 0.538 |
| 0.396 | 0.479 | −0.939 | 0.540 |
| 0.397 | 0.478 | −0.730 | 0.541 |
| 0.398 | 0.478 | −0.521 | 0.541 |
| 0.399 | 0.478 | −0.312 | 0.540 |
| 0.400 | 0.478 | −0.104 | 0.539 |

Referring to FIG. 10, a soliton wave 30 associated with the maximum acceleration and velocity data, is generated for each rotation or axial translation of the exciter drive arrangement associated with any of the above embodiments described above. As shown therein, a delay or dwell event 300 is provided immediately after generation of each soliton wave to mitigate detraction from the energy associated with each wave caused by subsequent oscillation of the diaphragm 16 necessary for generation of subsequent soliton waves. It should be appreciated that the physical arrangement and cooperation between the respective elements of any of the exciter drive arrangements described above can be manipulated so as to manipulate the amplitude associated with each soliton wave and the timing associated with subsequent wave generation. Such considerations allow each exciter drive arrangement to be configured to generate a soliton wave having a desired magnitude and sequencing.

Figure 11:
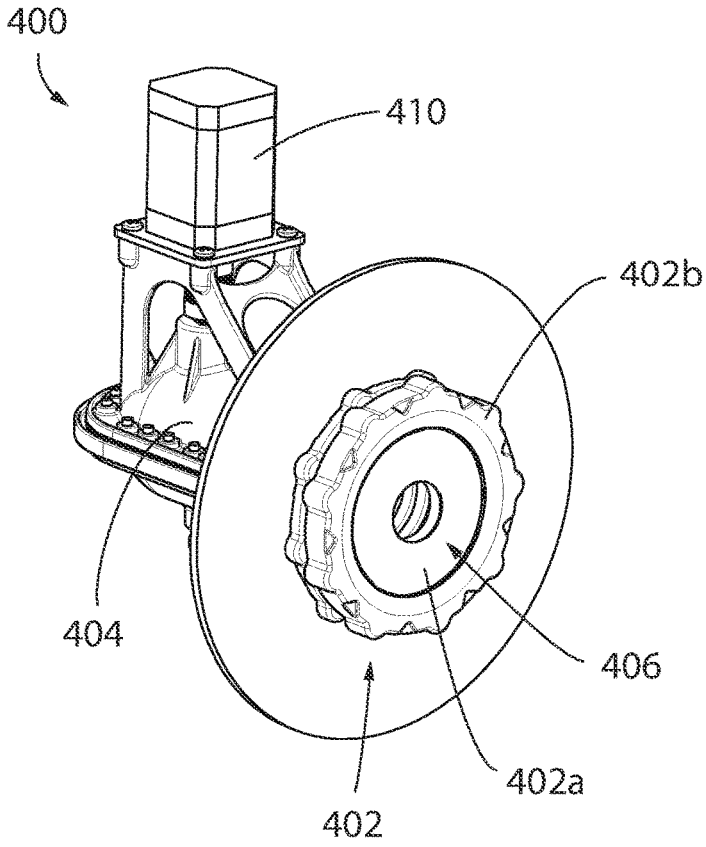
FIG. 11 is a perspective view of a jet assembly according to another embodiment of the present invention.
Figure 12:
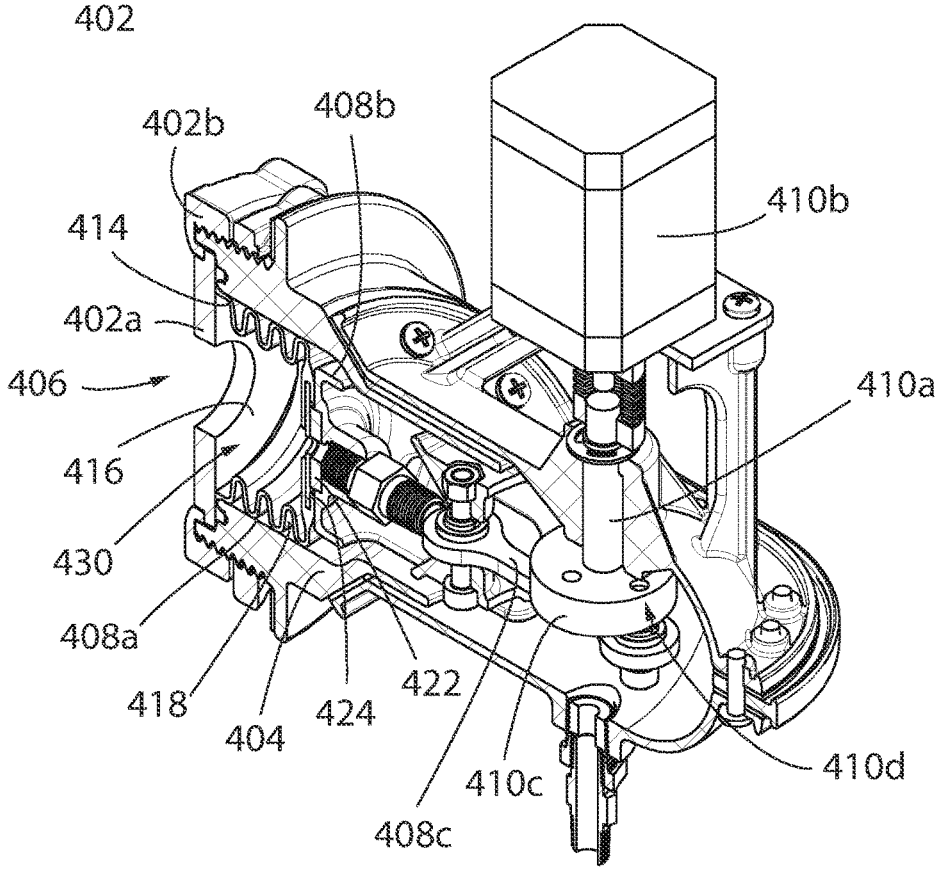
FIG. 12 is a perspective cross-section view of the jet assembly of FIG. 11.
Figure 13:
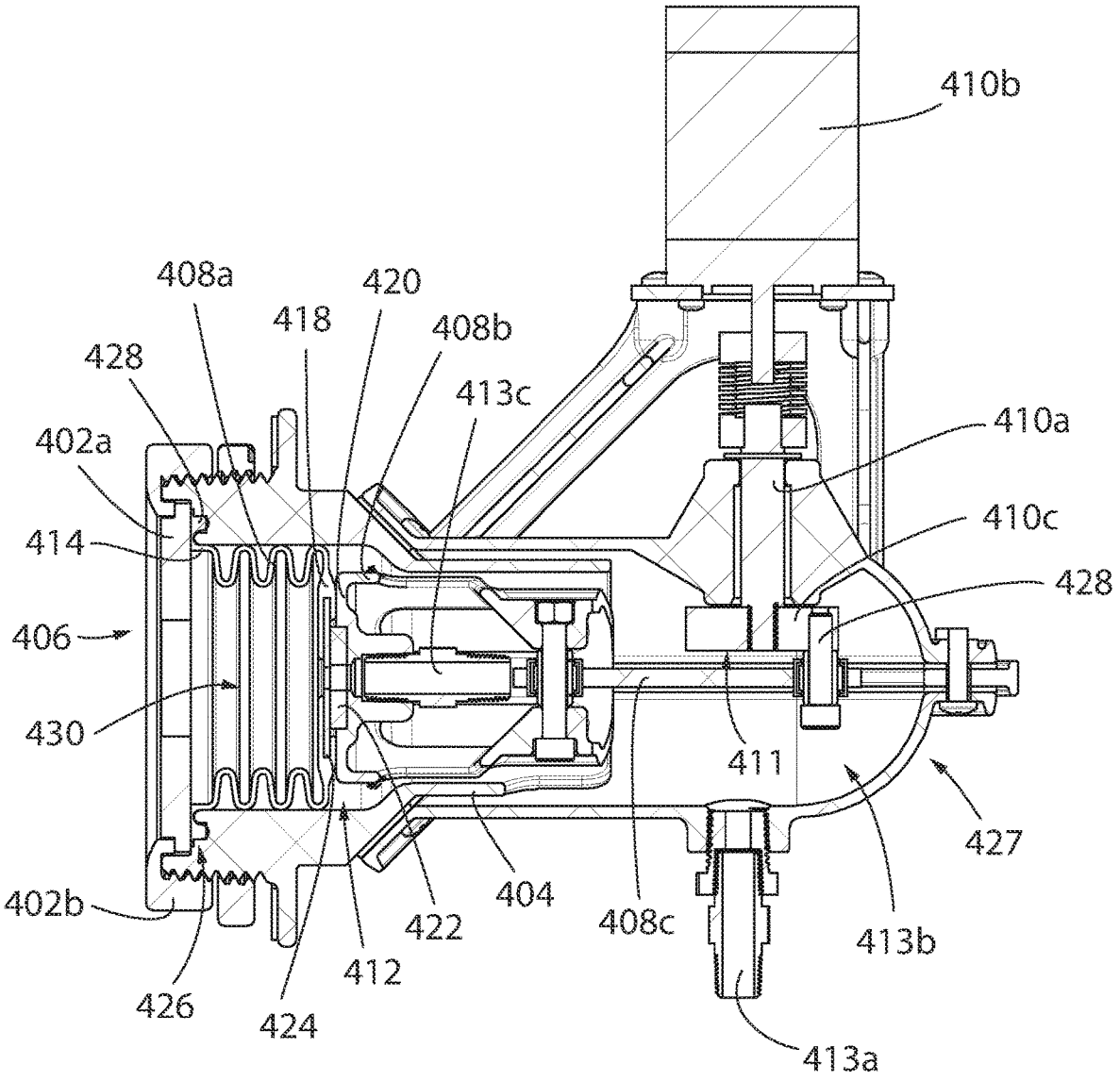
FIG. 13 is an elevational cross-section view of the jet assembly of FIG. 11.

FIGS. 12-39 depict various jet assemblies according to alternate respective embodiments of the invention. FIGS. 11-13 are various views of a jet assembly 400 according to first alternate embodiment of the present invention. Jet assembly 400 includes a faceplate 402 that is constructed to cooperate with a housing or base 404. The faceplate 402 includes at least one opening 406 formed therein, which assists in generating a toroidal shaped water jet stream as discussed in further detail below. In the representative embodiment of the invention, the faceplate 402 includes a disc 402*a* and a retainer 402*b*. The previously discussed, at least one opening 406 of the faceplate 402 is formed in the disc 402*a* of the faceplate 402. The disc 402*a* is placed in contact with a first end 426 of the housing 404. The retainer 402*b* secures the disc 402*a* to the first end 426 of the housing 404. As shown in FIG. 13, the retainer 402*b* is threadably coupled to the first end 426 of the housing 404. In other embodiments of the invention, the retainer 402*b* may be coupled to the housing 404 by alternative methods.

The housing 404 includes a chamber 412 formed therein to allow movement of a mover 408 within the chamber 412. In the representative embodiment of the invention, the mover 408 of FIGS. 11-13 includes a diaphragm 408*a* and a piston 408*b*. The jet assembly 400 further includes an exciter 410 whose operation manipulates the diaphragm 408*a* and the piston 408*b* to generate a water jet stream.

In the representative embodiment of the invention, the exciter 410 is in the form of a rotational actuator oriented generally perpendicular to the axis of motion of the bellows 408*a* and piston 408*b*, which move in concert with each other along the same axis of motion. In particular, the rotational motion of the exciter 410 causes the piston head 408*b* to move from a first position to a second position along the axis of motion. In turn, the movement of the piston 408*b* from the first position to the second position causes the diaphragm 408*a* to contract and expand, respectively. This described below in further detail.

As shown in FIGS. 12 and 13, the diaphragm 408*a* may be in the form of a bellows having collapsible sides. A first end 414 of the bellows 408*a* is in contact with an inner surface 416 of the faceplate 402. In the representative embodiment of the invention, a rim 428 at the first end 414 of the bellows 408*a* is secured between the disc 402*a* of the faceplate 402 and the first end 426 of the housing 404. A second end 418 of the bellows 408*a* is coupled to a first end 420 of the piston 408*b*. While FIG. 13 depicts the bellows 408*a* extending from the inner surface 416 of the faceplate 402 to the piston head 408*b*, it is contemplated that a first end 414 of the bellows may be extend to a location adjacent or spaced apart from the faceplate 402. Movement of the first end 420 of the piston 408*b* is directly translated to movement of the second end 416 of the bellows 408*a*.

In the representative embodiment of the invention, the second end 416 of the bellows 408*a* is magnetically coupled to the first end 420 of the piston 408*b*. As shown in FIG. 13, a magnet 422 is disposed in the first end 420 of the piston head 408*b*. In addition, a plate 424 is disposed in the second end 416 of the bellows 408*a*. The plate 424 may be steel or any other ferromagnetic metal. However, it is contemplated that the bellows 408*a* and piston 408*b* may be coupled together via alternative methods in other embodiments of the invention.

As described above, movement of the exciter 410 is translated to movement of the piston head 408*b* and the bellows 408*a*. The cross-sectional views of FIGS. 12 and 13 further illustrates the transfer of motion between the exciter 410 and the piston 408*b*. As stated above, the exciter 410 exhibits rotational motion. That is, a shaft 410*a* of the exciter 410 rotates one of clockwise or counterclockwise. In the representative embodiment of the invention, rotation of the shaft 410*a* is powered by a motor 410*b*. Motor 410*b* can be any of a pneumatic or electric motor wherein introduction of the respective input signal effectuates rotation of the shaft 410*a* associated with motor 410*b*. A cam 410*c* is disposed at a distal end 411 of the shaft 410*a*. The cam 410*c* includes at least one orifice 410*d* formed therein and configured to receive a connecting pin 428. In turn, the connecting pin 428 connects the cam 410*c* to a linkage 408*c* of the mover 408, such as a slide crank. As a result, rotation of the cam 410*c* results in corresponding movement of the slide crank 408*c* by way of the connecting pin 428. In turn, movement of the slide crank 408*c* causes the piston 408*b* to move between the above discussed first position and second position.

Movement of the piston head 408*b* and the bellows 408*a* causes an available volume 430 of the chamber 412 to change or be adjusted. For instance, when the piston 408*b* is in the second position and the bellows 408*a* is expanded, the volume 430 is increased and a pulse of water is pulled into the chamber 412 through the opening 406 of the faceplate 402. After a delay, the piston 408*b* is moved to the first position and the bellows 408*a* is contracted, which reduces the volume 430 and ejects the water from the chamber 412 and through the opening 406 in a toroidal waveform.

The jet assembly may further include an alternative exciter 413 in the form of a pneumatic system. The pneumatic system 413 includes a pneumatic valve 413*a* coupled to the housing 404 in order to supply air or a fluid to a pneumatic chamber 413*b*. The pneumatic chamber 413*b* is representative of the space within the housing 404 between the second end 427 of the housing 404 and the first end 420 of the piston 408*b*. When the pneumatic system 410 increases the pressure within the pneumatic chamber 413*b*, the piston 408*b* is moved toward the faceplate 402 of the jet assembly 400 to the first position in order to increase the size of the pneumatic chamber 413*b*. The pneumatic system 413 also includes a pneumatic relief valve 413*c* disposed at a first end 420 of the piston 408*b* and extending into the pneumatic chamber 410*b*. The pneumatic relief valve 413*c* assists in decreasing the pressure within the pneumatic chamber 413*b* in order to move the piston 408*b* away from the faceplate 402 and to the second position. As a result, the size of the pneumatic chamber 413*b* is decreased.

Figure 14:
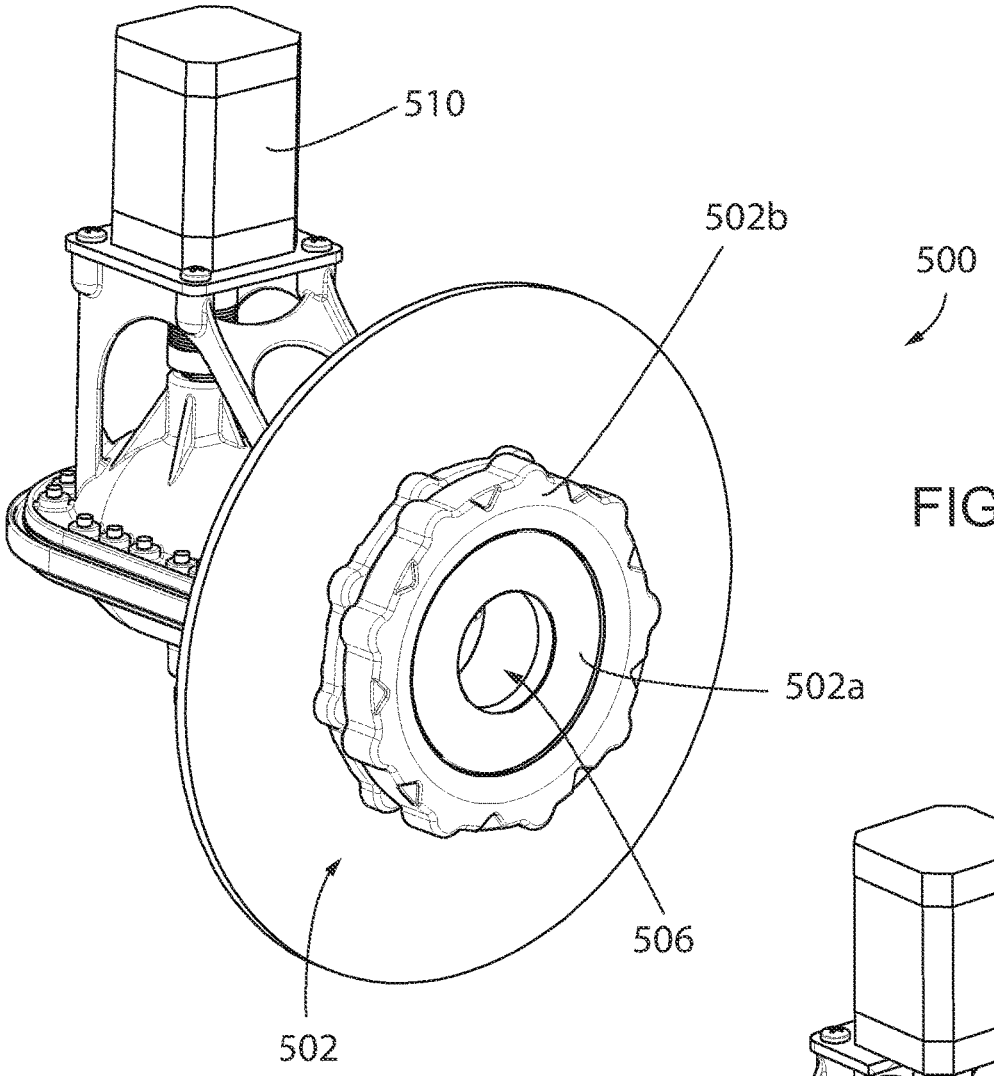
FIG. 14 is a perspective view of a jet assembly according to another embodiment of the present invention.
Figure 15:
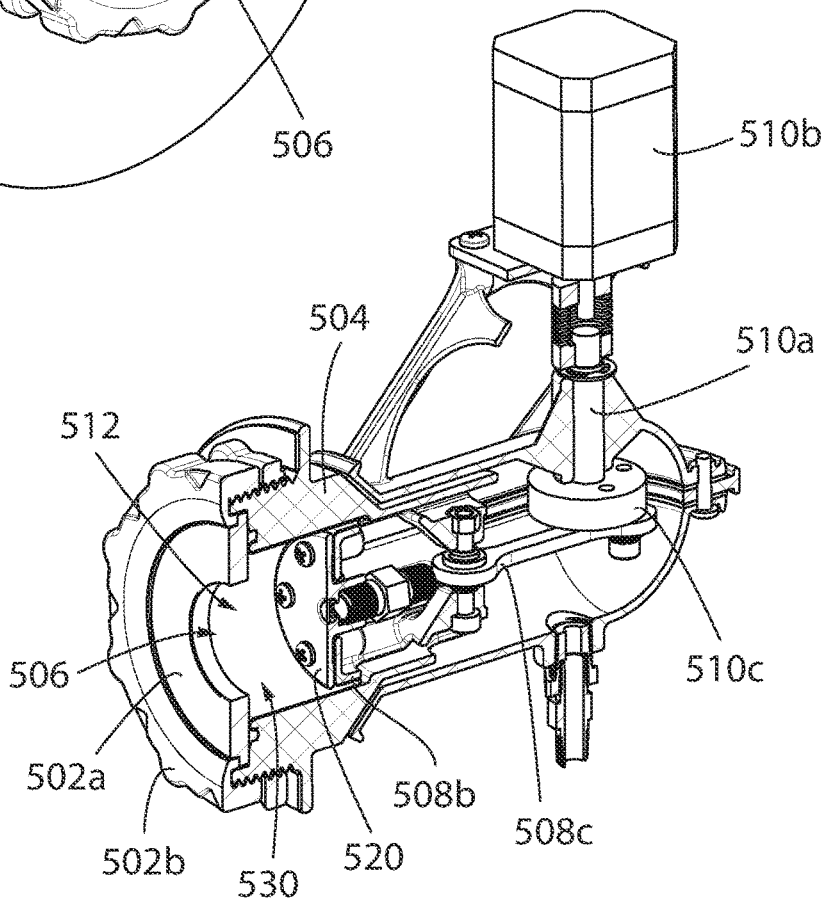
FIG. 15 is a perspective cross-section view of the jet assembly of FIG. 14.
Figure 16:
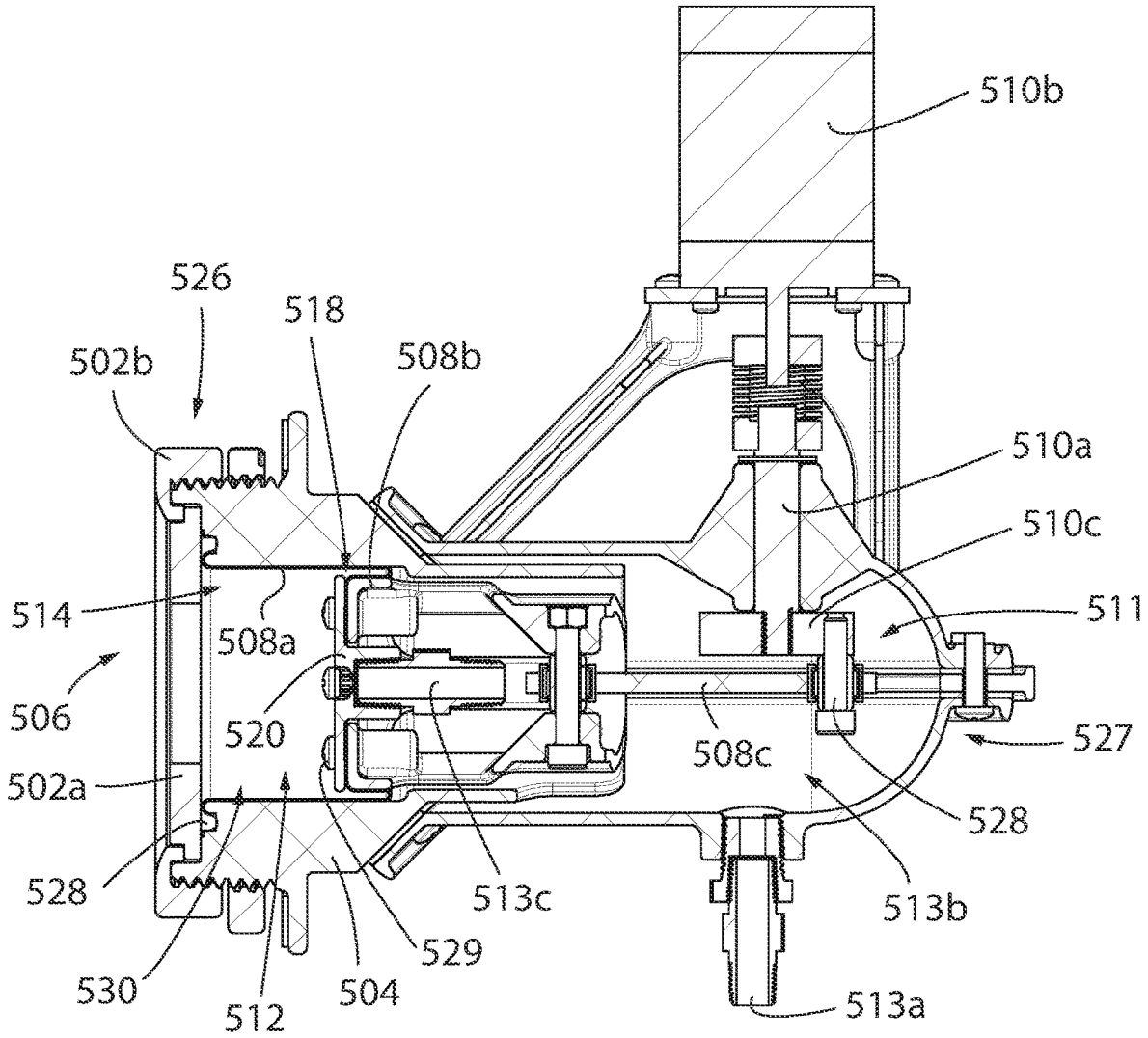
FIG. 16 is an elevational cross-section view of the jet assembly of FIG. 14.

FIGS. 14-16 depict an alternative embodiment of a jet assembly 500. The jet assembly 500 is similarly constructed to the jet assembly 400 of FIGS. 11-13. Jet assembly 500 includes a faceplate 502 constructed to cooperate with a housing or base 504. The faceplate 502 includes a disc 502*a*, a retainer 502*b*, and at least one opening 506 formed through the disc 502*a* of the faceplate 502 to assist in generating a toroidal shaped water jet stream. As shown in FIG. 16, the retainer 502*b* secures the disc 502*a* to a first end 526 of the housing 504. While the representative embodiment of the invention depicts the retainer 502*b* as being threadably coupled to the first end 526 of the housing 504, the retainer 502*b* may be coupled to the housing 504 may other methods in other embodiments of the invention.

A chamber 512 is disposed within the housing 504 and configured to allow movement of a mover 508 within the chamber 512. In this embodiment of the invention, the mover 508 is represented by a piston 508*b* that moves between a first position and a second position and a diaphragm 508*a* that transitions accordingly. The jet assembly 500 also includes an exciter 510 that operates to transition the piston 508*b* between the first and second positions and generate a toroidal water jet stream.

Similar to the exciter 410 of the jet assembly 400, the exciter 510 of the jet assembly 500 is in the form of a rotational actuator oriented perpendicular to the axis of motion of the piston 508*b*. Movement of the exciter 510 is translated to movement of the piston 508*b*. As shown in FIG. 16, the exciter 510 includes a pneumatic or electronic motor 510*b* that powers rotation of a shaft 510*a*. In turn, the shaft 510*a* rotates either clockwise or counterclockwise. The distal end 511 of the shaft 510*a* includes a cam 510*c* having at least one orifice 510*d* formed therein. A connecting pin 528 extends through the orifice 510*d* and connects the cam 510*c* to a linkage 508*c* of the mover 408, such as a slide crank. As a result, rotation of the shaft 510*a*, causes rotation of the cam 510*c*, which results in corresponding movement of the slide crank 508*c* by way of the connecting pin 528. Further, movement of the slide crank 508*c* causes the piston 508*b* to move between the respective first position and second position as disclosed above.

As shown in FIGS. 15 and 16, the diaphragm 508*a* of the jet assembly 500 is in the form of a rolling diaphragm or rolling bellows wherein respective portions of the bellow bypass along one another during motion of the bellows. A first end 514 of the bellows 508*a* is secured to an inner surface 516 of the disc 502*a* of the faceplate 502. In the representative embodiment of the invention, a rim 528 at the first end 514 of the bellows 508*a* is secured between the disc 502*a* of the faceplate 502 and the first end 526 of the housing 504. A second end 518 of the bellows 508*a* is attached to a first end 520 of the piston 508*b*. FIG. 16 depicts the second end 518 of the bellows 508*a* mechanically coupled to the first end 520 of the piston 508*b* by a number of fasteners 522. In other embodiments of the invention, the second end 518 of the bellows 508*a* may be coupled to the first end 520 of the piston 508*b* by other means.

Movement of the first end 520 of the piston 508*b* results in movement of the second end 516 of the bellows 508*a*. In other words, as the piston 508*b* moves from the second position to the first position, the bellows 508*a* rolls onto itself. Conversely, as the piston 508*b* moves from the first position to the second position, the bellows 508*a* unrolls.

In this instance, movement of the piston 508*b* causes an available or accessible volume 530 of the chamber 512 to change. For instance, in the first position, the piston 508*b* is placed nearer the faceplate 502 of the jet assembly 500 to minimize the volume 530 and prevent water from entering the chamber 512. On the other hand, when the piston head 508*b* is in the second position, the piston head 508*b* is displaced from the faceplate 502 to maximize the volume 530 and allow water to enter the chamber 512. As a result, when the piston 508*b* is moved from the first position to the second position, the volume 530 is increased and a pulse of water is pulled into the chamber 512 through the opening 506 of the faceplate 502. After a delay, the piston 508*b* is then moved back to the first position and the volume 530 is reduced, which causes the water within the chamber 512 to be ejected through the opening 506 in a toroidal waveform.

The jet assembly 500 may also include an alternative exciter 513 in the form of a pneumatic system. The pneumatic system 513 includes a pneumatic valve 513*a*, a pneumatic chamber 513*b*, and a pneumatic relief valve 513*c*. The pneumatic valve 513*a* is coupled to the housing 504 in order to supply air or a fluid to the pneumatic chamber 413*b*, which is representative of the space within the housing 504 between the second end 527 of the housing 504 and the first end 520 of the piston 508*b*. The pneumatic relief valve 513*c* is disposed in a first end 520 of the piston 508*b* and extends into the pneumatic chamber 513*b*. The pneumatic system 513 is able to increase the pressure within the pneumatic chamber 513*b* via the pneumatic valve 513*a* and move the piston 408*b* toward the faceplate 502 to the first position in order to increase the size of the pneumatic chamber 513*b*. The pneumatic system 513 is also able to decrease the pressure within the pneumatic chamber 513*b* via the relief valve 513*c* in order to allow the piston 508*b* to move away from the faceplate 502 and to the second position, which results in the size of the pneumatic chamber 513*b* decreasing.

Figure 17:
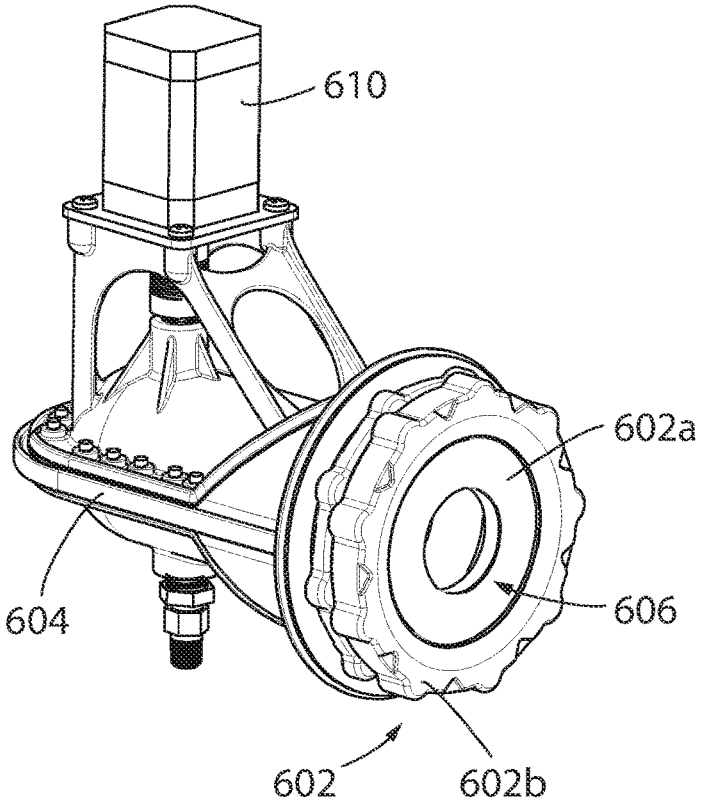
FIG. 17 is a perspective view of a jet assembly according to another embodiment of the present invention.
Figure 18:
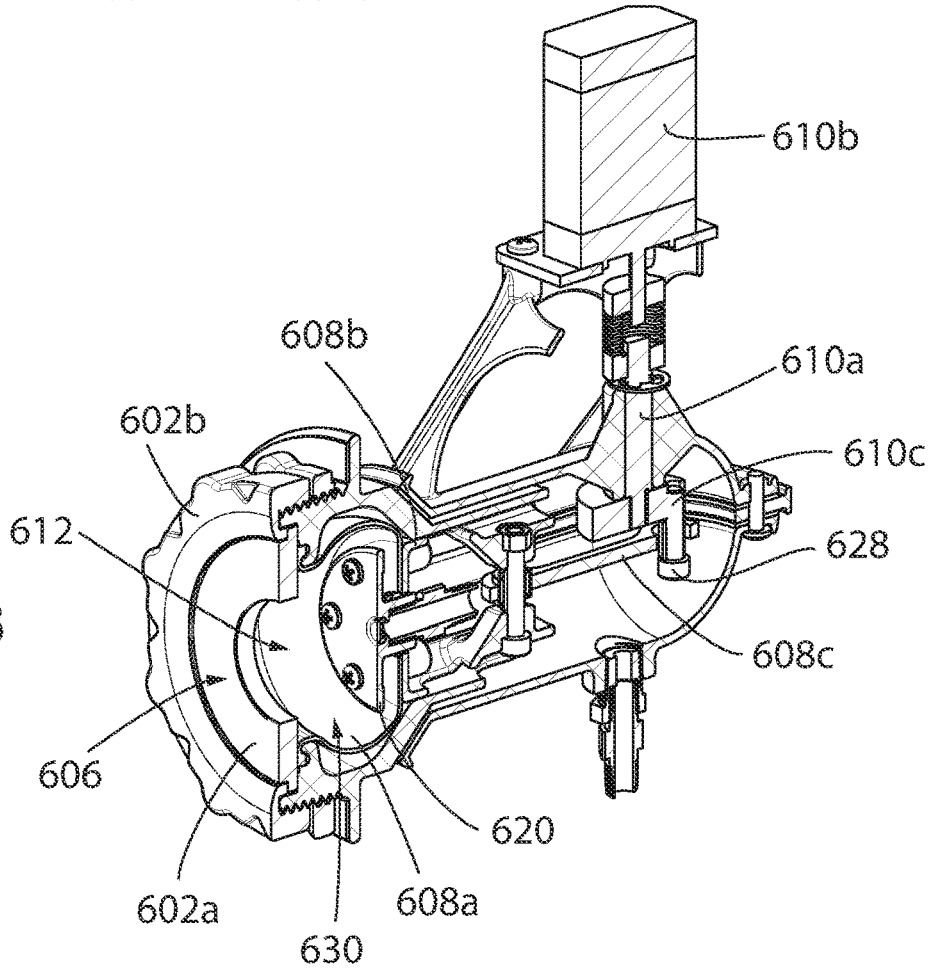
FIG. 18 is a perspective cross-section view of the jet assembly of FIG. 17.
Figure 19:
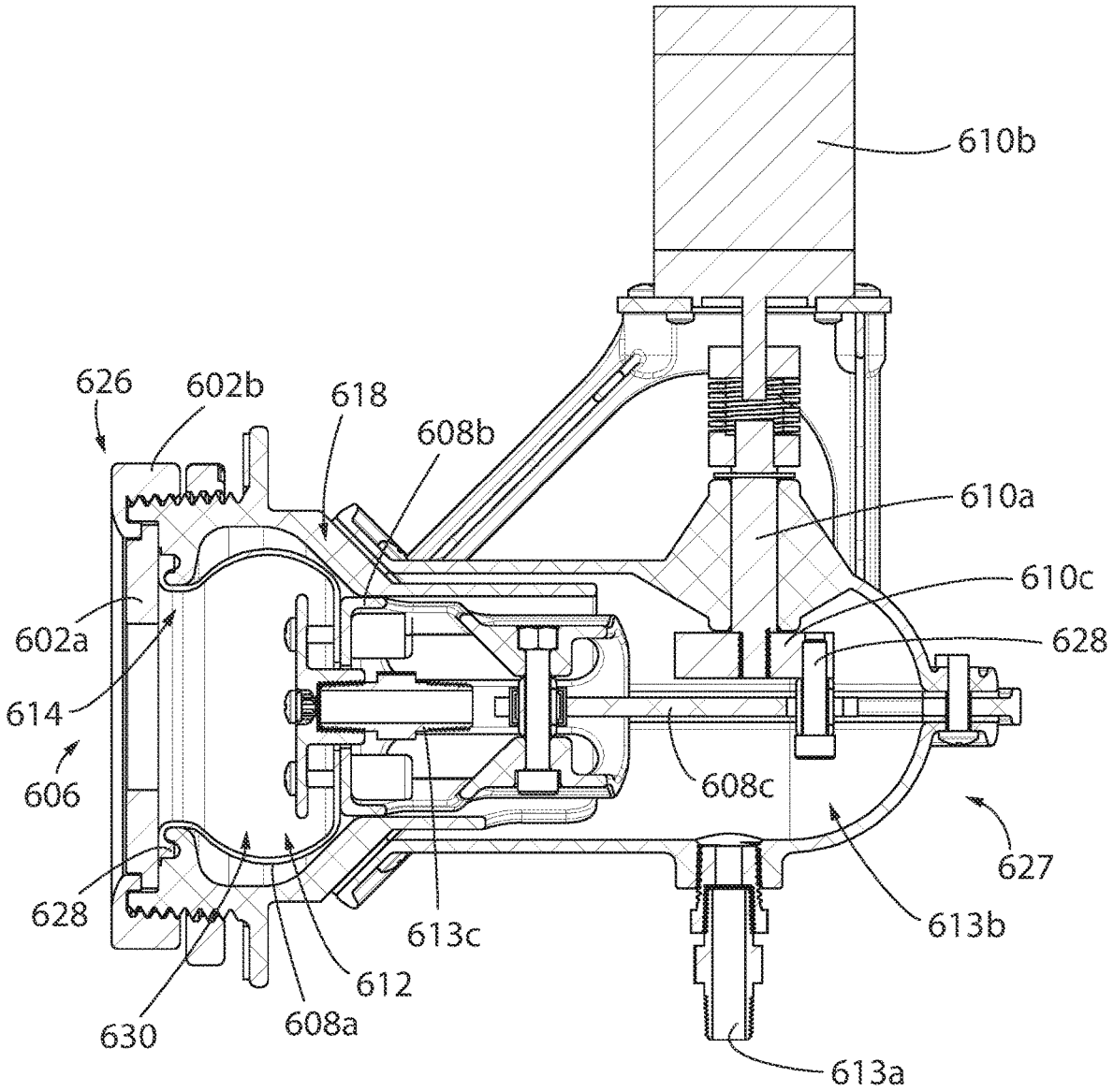
FIG. 19 is an elevational cross-section view of the jet assembly of FIG. 17.

Now referring to FIGS. 17-19, another alternative jet assembly 600 is shown. Jet assembly 600 includes a faceplate 602 constructed to cooperate with a housing or base 604. The faceplate 602 includes a disc 602*a* and a retainer 602*b*. At least one opening 606 is formed through the disc 602*a* of the faceplate 602 to expose a chamber 612 within the housing 604. The disc 602*a* is placed in contact with a first end 626 of the housing 604. The retainer 602*b* is then coupled to the first end 626 of the housing 604 to secure the disc 602*a* in place. While FIG. 16 depicts the retainer 602*b* being threadably coupled with the first end 626 of the housing 604, it is contemplated that the retainer 602*b* may be coupled to the housing 604 by other methods in other embodiments of the invention.

The chamber 612 within the housing 604 allows a mover 608 to move within the chamber 612. As shown in FIGS. 18 and 19, the mover 608 includes a diaphragm 608*a* and a piston 608*b*. The piston 608*b* moves between a first position and a second position. In turn, the diaphragm expands and contracts accordingly. The jet assembly 600 also includes an exciter 610. In operation, the exciter 610 causes the piston 608*b* to transition between the first and second positions, which generates a toroidal water jet stream.

In the representative embodiment of the invention of FIG. 19, the diaphragm 608*a* is in the form of a bellows having concave sidewalls configured to move outward as it collapses. The bellows 608*a* includes a first end 614 in contact with an inner surface 616 of the faceplate 602 and a second end 618 coupled to a first end 620 of the piston 608*b*. As shown in FIG. 19, the first end 614 of the bellows 608*a* includes a rim 628, which is secured between the disc 602*a* of the faceplate 602 and the first end 626 of the housing 604. The second end 618 of the bellows 608*a* is mechanically coupled to the first end 620 of the piston 608*b* by a number of fasteners 622. However, it is also contemplated that the second end 518 of the bellows 608*a* may be coupled to the first end 620 of the piston 608*b* by other means in other embodiments of the invention.

The exciter 610 of the jet assembly 600 is in the form of a rotational actuator similar to the exciters 410, 510 previously discussed above. As shown in FIG. 19, the exciter 610 includes a rotating shaft 610*a* that is powered by a motor 610*b*. In particular, the motor 610*b* causes the shaft 610*a* to rotate in one of a clockwise or counterclockwise direction. A cam 610*c* is disposed at a distal end 611 of the shaft 610*a*. The cam 610*c* includes at least one orifice 610*d* formed therein and configured to receive a connecting pin 628. The connecting pin 628 couples the cam 610*c* to a linkage 608*c*, such as a slide crank. In turn, movement of the slide crank 608*c* directly causes the piston 608*b* to transition between the first and second positions, as discussed above.

An available or accessible volume 630 within the chamber 612 is changed by movement of the piston 608*b*. For instance, in the first position, the piston 608*b* is disposed adjacent the faceplate 602 of the jet assembly 600 to minimize the volume 630 and prevent water from entering the chamber 612. In the second position, the piston 608*b* is spaced apart from the faceplate 602 to maximize the volume 630 and allow water from a respective basin to enter the chamber 612. As the piston 608*b* is moved from the first position to the second position, the volume 530 is increased and a volume of water is pulled into the chamber 612 through the opening 606 in the faceplate 602. As the piston 608*b* is moved from the second position toward the first position, the volume 530 is decreased and a toroidal pulse of water is ejected from the chamber 512 through the opening 606. It is contemplated that the piston 608*b* may be maintained in the first position for a delay period before returning toward the second position such that the toroidal wave can fully propagate and travel in a direction away from the faceplate such that a subsequent intake stroke does not detract or reduce the previously generated soliton fluid wave.

The jet assembly 600 may also include an alternative exciter 613 in the form of a pneumatic system. The pneumatic system 613 may include a pneumatic valve 613*a* coupled to the housing 604 in order to supply air or another fluid to a pneumatic chamber 613*b*. The pneumatic chamber 613*b* is representative of the space within the housing 604 between the second end 627 of the housing 604 and the first end 620 of the piston 608*b*. When the pneumatic system 613 increases the pressure within the pneumatic chamber 613*b*, the piston 608*b* is moved to the first position in order to increase the size of the pneumatic chamber 613*b*. The pneumatic system 613 may also include a pneumatic relief valve 613*c* disposed at a first end 620 of the piston 608*b* and extending into the pneumatic chamber 610*b*. The pneumatic relief valve 613*b* may be used to decrease the pressure within the chamber 613*b* in order to move the piston 608*b* to the second position and decrease the size of the pneumatic chamber 613*b*.

Figure 20:
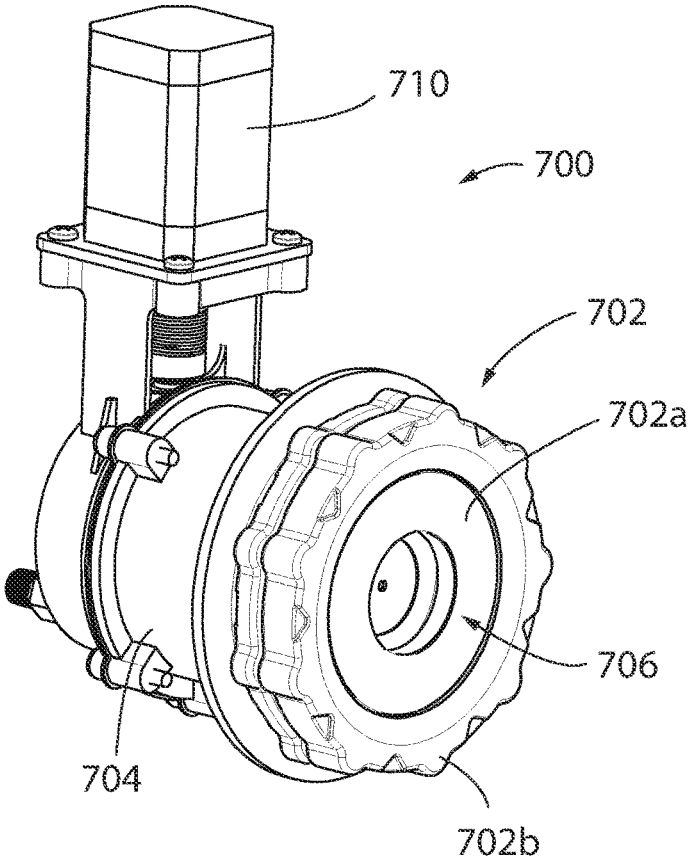
FIG. 20 is a perspective view of a jet assembly according to another embodiment of the present invention.
Figure 21:
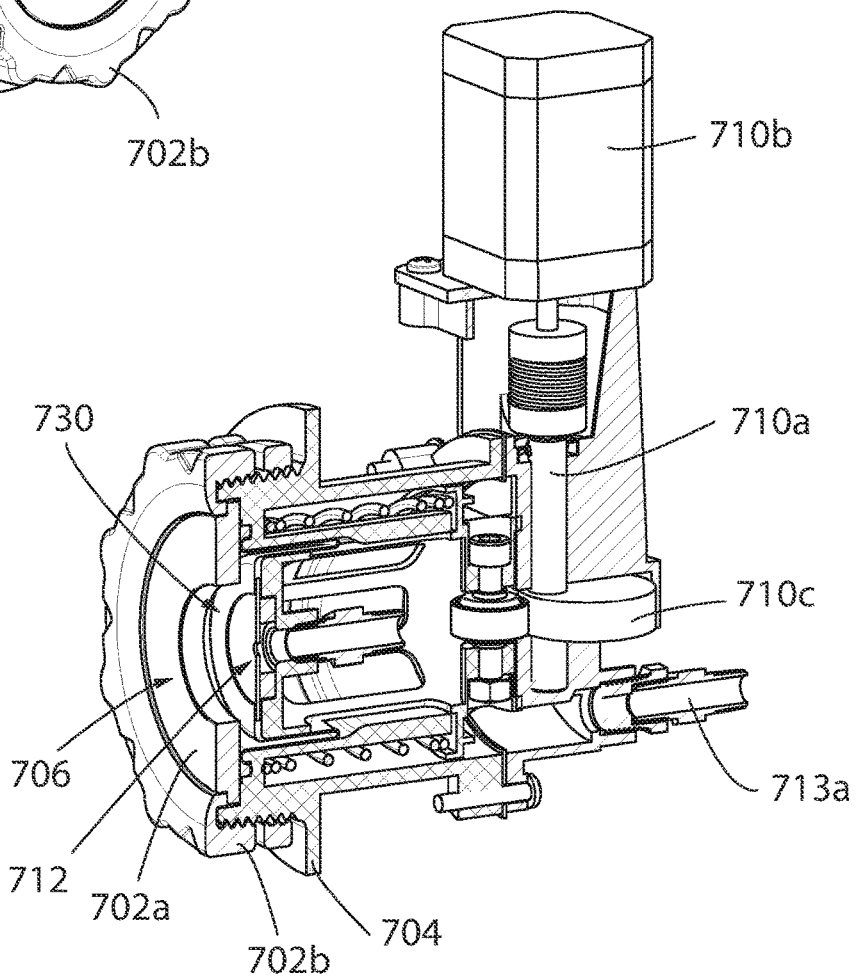
FIG. 21 is a perspective cross-section view of the jet assembly of FIG. 20.
Figure 22:
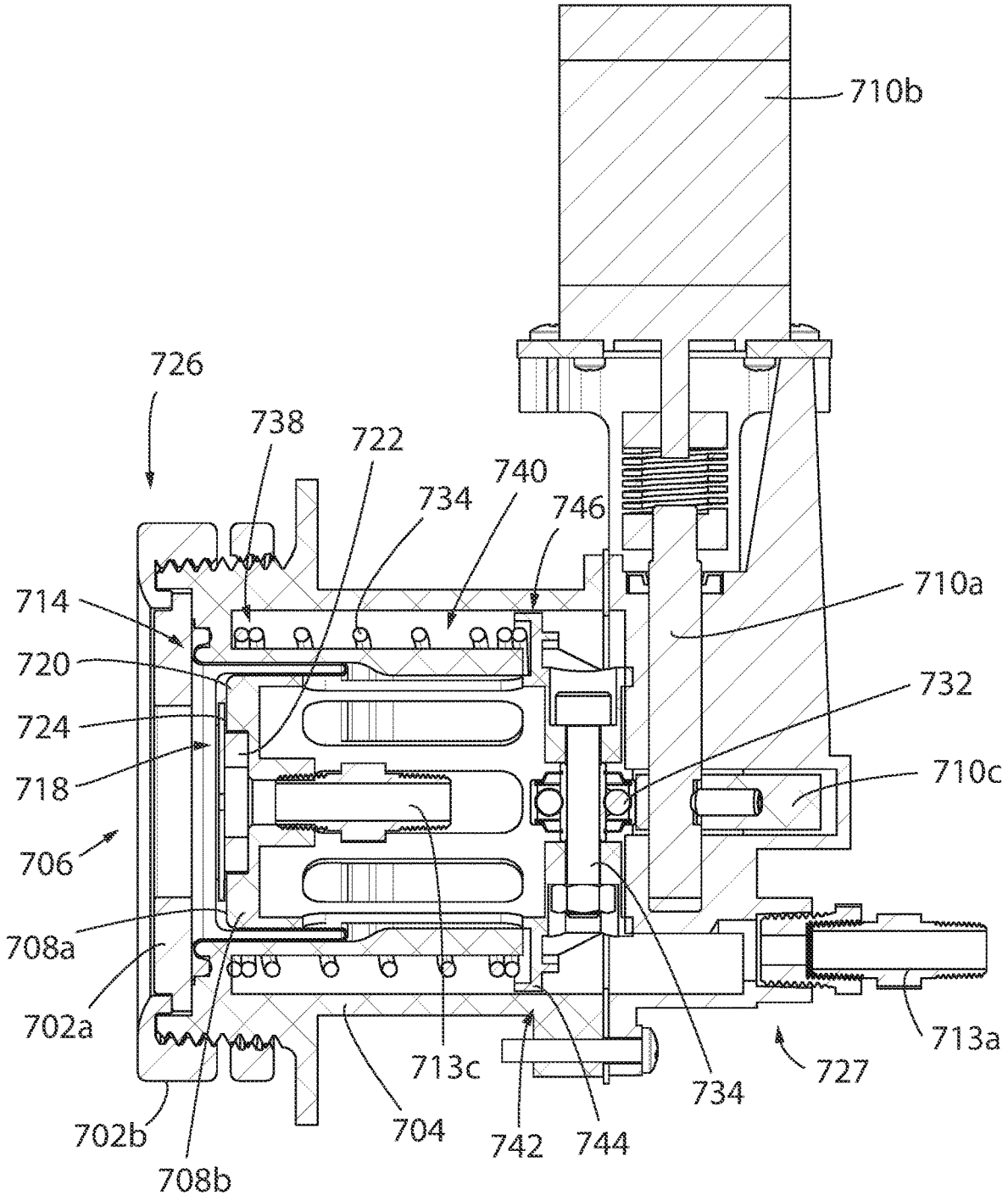
FIG. 22 is an elevational cross-section view of the jet assembly of FIG. 20.

Next, FIGS. 20-22 depict another alternative jet assembly 700. Similar to previously described jet assemblies, the jet assembly 700 includes a faceplate 702 and a housing or base 704. The faceplate 702 includes a disc 702*a* and a retainer 702*b*. The disc 702*a* includes at least one opening 706 formed therethrough to expose a chamber 712 within the housing 704. The disc 702*a* is placed at a first end 726 of the housing 704 and secured relative thereto by the retainer 702*b*. As shown in FIG. 22, the retainer 702*b* is threadably coupled to the first end 726 of the housing 704 in order to secure the disc 702*a* to the first end 726 of the housing 704. The retainer 702*b* may be coupled to the first end 726 of the housing 704 by other means in alternative embodiments of the invention.

A mover 708 is disposed within the chamber 712 of the housing 704. The chamber 712 is configured to allow the mover 708 to move within the chamber 712. In the representative embodiment of the invention, the mover 708 comprises a diaphragm 708*a* and a piston 708*b*. The piston 708*b* moves between a first position and a second position, while the diaphragm 708*a* transitions accordingly. This will be described in further detail below. The jet assembly 700 also includes an exciter 710 that causes the piston 708*b* to move between the first and second positions and generate a toroidal water jet stream through the opening 706.

The exciter 710 of the jet assembly 700 is in the form of a rotational actuator oriented perpendicular to the axis of motion of the piston 708*b*. Movement of the exciter 710 is translated to movement of the piston 708*b* between the first and second positions. As shown in FIG. 22, the exciter 710 includes a rotational shaft 710*a* that is powered by a motor 710*b*. The shaft 710*a* is configured to rotate either clockwise or counterclockwise in response to operation of the motor 710*b*. A cam 710*c* is disposed adjacent or spaced apart from a distal end 711 of the shaft 710*a*. The cam 710*c* is configured to rotate with the shaft 710*a*. The cam 710*c* is further aligned with a displacement element 708*c* at a second end 742 of the piston 708*b*. As a result, when the cam 710*c* rotates, the displacement element 708*c* moves forward and backward thereby causing the piston 708*b* to move between the first position and the second position. The displacement element 708*c* includes a bearing 732 that is aligned with the cam 710*c*. The bearing 732 is configured to rotate around a shaft 734 of the displacement member 732 as it is displaced forward and backward.

A biasing element 734, such as a spring, is disposed within a biasing channel 740 of the housing 704 in order to surround the piston 708*b*. A first end 738 of the biasing channel 740 is disposed adjacent the first end 726 of the housing 704. The second end 742 of the piston 708*b* includes an extension portion 744 that extends in a radially outward direction, which defines a second end 746 of the biasing channel 740. In turn, the biasing element 734 extends from a first end 748 that is in contact with the first end 738 of the biasing channel 740 and a second end 750 that is in contact with a front face 752 of the extension portion 744 of the piston 708*b*. As a result, when the exciter 710 and displacement member 708*c* cause the piston 708*b* to move to the first position, the biasing element 734 compresses as the movement of the extension portion 744 reduces the size of the biasing channel 740. In turn, when the exciter 710 and the displacement member 708*c* move backward, the biasing element 734 exerts a force on the extension portion 744 of the piston 708*b* and causes the piston 708*b* to move to the second position, which in turn allows the biasing element 734 to expand as the size of the biasing channel 740 is increased.

FIG. 22 further depicts the diaphragm 708*a* in the form of a rolling bellows, similar to the diaphragm 508*a* of the jet assembly 500 shown in FIG. 14. A first end 714 of the bellows 708*a* is secured to an inner surface 716 of the faceplate disc 702*a*. The first end 714 of the bellows 708*a* may include a rim 728 that is disposed between the disc 702*a* of the faceplate 702 and the first end 726 of the housing 704 in order to secure the first end 714 of the bellows 708*a* in place. A second end 718 of the bellows 708*a* is preferably magnetically attached to a first end 720 of the piston 708*b*. A magnet 722 may be disposed in the first end 720 of the piston 708*b*, and a magnetically responsive plate 724 may be disposed in the second end 716 of the bellows 708*a*. The plate 724 may be steel or any other ferromagnetic material. In other embodiments of the invention, other methods may be used to couple the second end 716 of the bellows 708*a* to the first end 720 of the piston 708*b*. As the piston 708*b* moves from the second position to the first position, the bellows 708*a* transitions by rolling onto itself. As the piston 708*b* moves from the first position to the second position, the bellows 708*a* transitions by unrolling itself.

Movement of the piston 708*b* causes an available or accessible volume 730 of the chamber 712 to change. For instance, when the piston 708*b* is in the first position, it is disposed adjacent the faceplate 702 to minimize the volume 730 and prevent water from entering the chamber 712. Conversely, when the piston 708*b* is in the second position, it is spaced apart from the faceplate 702 to maximize the volume 730 and allow water to enter the chamber 712. Further, when the piston 708*b* transitions from the first position to the second position, the volume 730 is increased and a pulse of water is pulled into the chamber 712 through the opening 706. After a delay, the piston 708*b* transitions from the second position to the first position thereby decreasing the volume 730 associated with chamber 712 and ejecting the water from the chamber 712 and through the opening 706 in a toroidal waveform.

The jet assembly 700 may further include an alternative exciter 713, such as a pneumatic system. The pneumatic system 713 includes a pneumatic valve 713*a*, a pneumatic chamber 713*b*, and a pneumatic relief valve 713*c*. The pneumatic valve 713*a* is coupled to the housing 704 and supplies air or another fluid to the pneumatic chamber 713*b*. The pneumatic chamber 713*b* is representative of the space within the housing 704 between the second end 727 of the housing 704 and the first end 720 of the piston 708*b*. The pneumatic system 713 is able to increase the pressure within the pneumatic chamber 713*b* via the pneumatic valve 713*a* and move the piston 70*b* to the first position and increase the size of the pneumatic chamber 713*b*. The pneumatic relief valve 713*c* is disposed in the first end 720 of the piston 708*b* and extends into the pneumatic chamber 713*b*. The pneumatic relief valve 713*c* assists in decreasing the pressure within the chamber 713*b* in order to move the piston 708*b* to the second position and decrease the size of the pneumatic chamber 713*b*.

Figure 23:
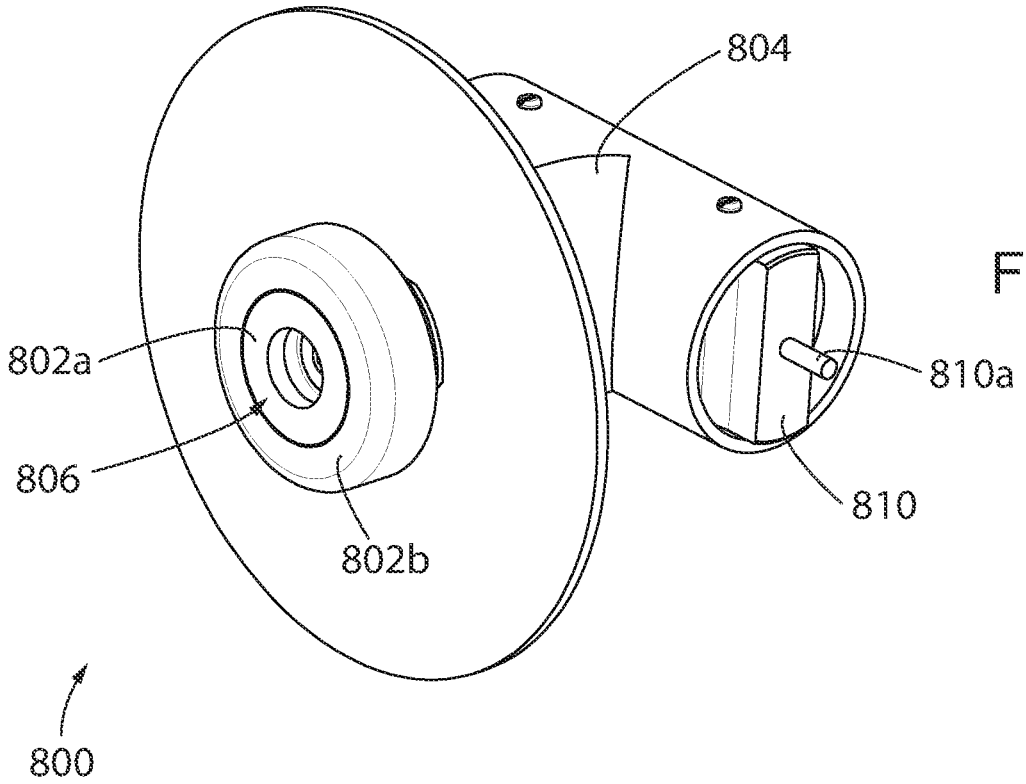
FIG. 23 is a perspective view of a jet assembly according to another embodiment of the invention.
Figure 24:
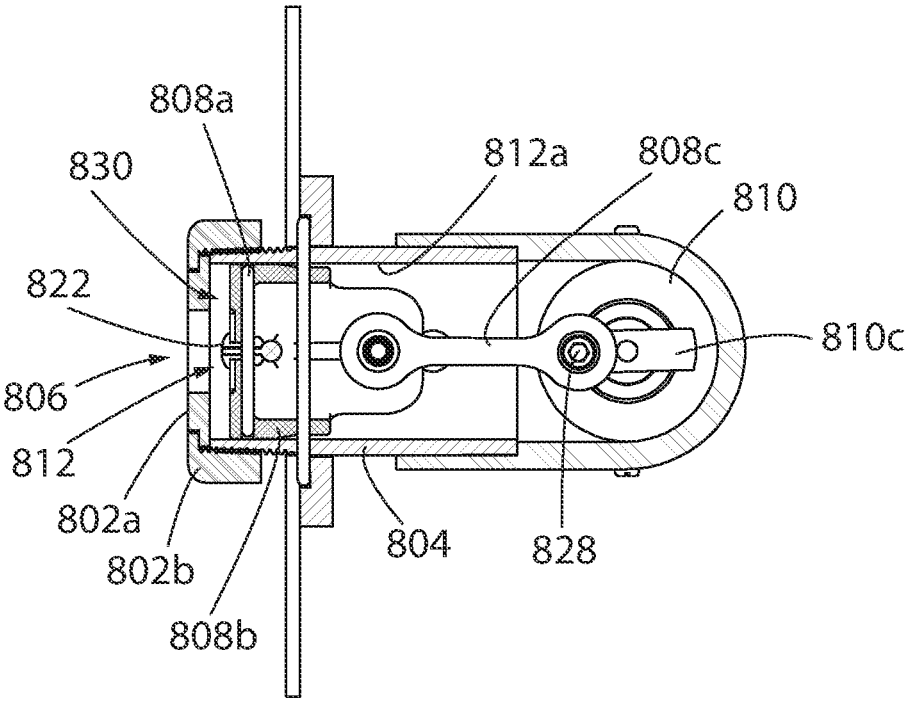
FIG. 24 is an elevational cross-section view of the jet assembly of FIG. 23.

Referring next to FIGS. 23-24, a jet assembly 800 is shown according to yet another embodiment of the invention. The jet assembly 800 includes a faceplate 802 constructed to cooperate with a housing or base 804. At least one opening 806 is formed in the faceplate 802 to assist in generating a toroidal shaped water jet stream. In the representative embodiment of the invention, the faceplate 802 includes a disc 802*a* and a retainer 802*b* configured to secure the faceplate 802 to the housing 804. The disc 802*a* is placed in contact with a first end 826 of the housing 804 and includes the previously discussed opening 806. The retainer 802*b* is threadably coupled to the first end 826 of the housing 804 in order to secure the disc 802*a* to the first end 826 of the housing 804. In other embodiments of the invention, the retainer 802*b* may be secured to the housing 804 via other methods.

The housing 804 includes a chamber 812 disposed therein. The chamber 812 is configured to allow a mover 708 to move within the chamber 812. As shown in FIG. 24, the mover 808 includes a diaphragm 808*a* and a piston 808*b*. The piston 808*b* transitions between a first position and a second position as it moves within the chamber 812. In turn, the diaphragm 808*a* moves with the piston 808*b*. The jet assembly 800 also includes an exciter 810 that causes the piston 608*b* to move between the first and second positions and generate a toroidal water jet stream.

FIG. 24 depicts the diaphragm 808*a* in the form of a seal secured to a first end 820 of the piston 808*b*. As a result, the diaphragm 808*a* moves in unison with the first end 820 of the piston 808*b*. The diaphragm 808*a* is sized so as to maintain a seal with the sidewalls 812*a* of the chamber 812. While the representative embodiment of the invention depicts the diaphragm 808*a* as being coupled to the first end 820 of the piston 808*b* via at least one fastener 822, it is contemplated that the diaphragm 808*a* may be coupled to the piston 808*b* via other methods.

The exciter 810 of the jet assembly 800 is in the form of a rotational actuator. As shown in FIG. 24, the exciter 810 includes a rotating shaft 810*a*. A motor 810*b* powers the shaft 810*a* to rotate in either a clockwise or counterclockwise direction. A rotating plate 810*c* is centered on the shaft 810*a* and includes an orifice 810*d* spaced apart from the shaft 810*a*. A connecting pin 828 is disposed within the orifice 810*d* and connects the rotating plate 810*c* to a linkage 808*c*, such as a slide crank. As a result, the rotation of the shaft 810*a* causes the rotation of the plate 810*c*, which causes movement of the slide crank 808*c*, which causes the piston 808*b* to move between the first and second positions.

The chamber 812 includes an accessible volume 830 that is changed by the movement of the piston 808*b*. In the first position, the piston 808*b* is located adjacent the faceplate 802 of the jet assembly 800 so as to minimize the volume 830 and prevent water from entering the chamber 812. In the second position, the piston 808*b* is spaced apart from the faceplate 802 of the jet assembly 800 so as to maximize the volume 830 and allow water to enter the chamber 812 through the opening 806 in the faceplate 802. More specifically, when the piston 808*b* moves from the first position to the second position, the volume 830 is increased and water is pulled into the chamber 812. On the other hand, when the piston 808*b* moves from the second position to the first position, the volume 830 is decreased and the water is jettisoned from the chamber 812 via the opening 806 in a toroidal waveform. It is also contemplated that the piston 808*b* may be maintained in the first or second position for a dwell or delay period before moving to the other position to mitigate interference between the intake and discharge strokes associated with operation of piston 808*b* and the development and outward propagation of the toroidal wave into the operating environment, respectively.

Figure 25:
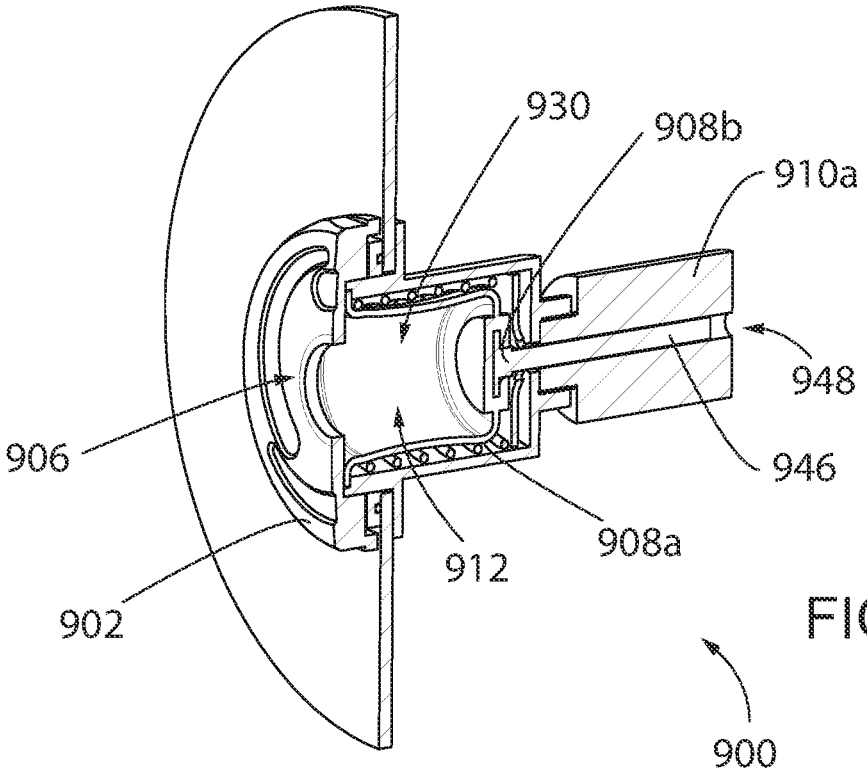
FIG. 25 is a perspective cross-section view of a jet assembly according to another embodiment of the invention.
Figure 26:
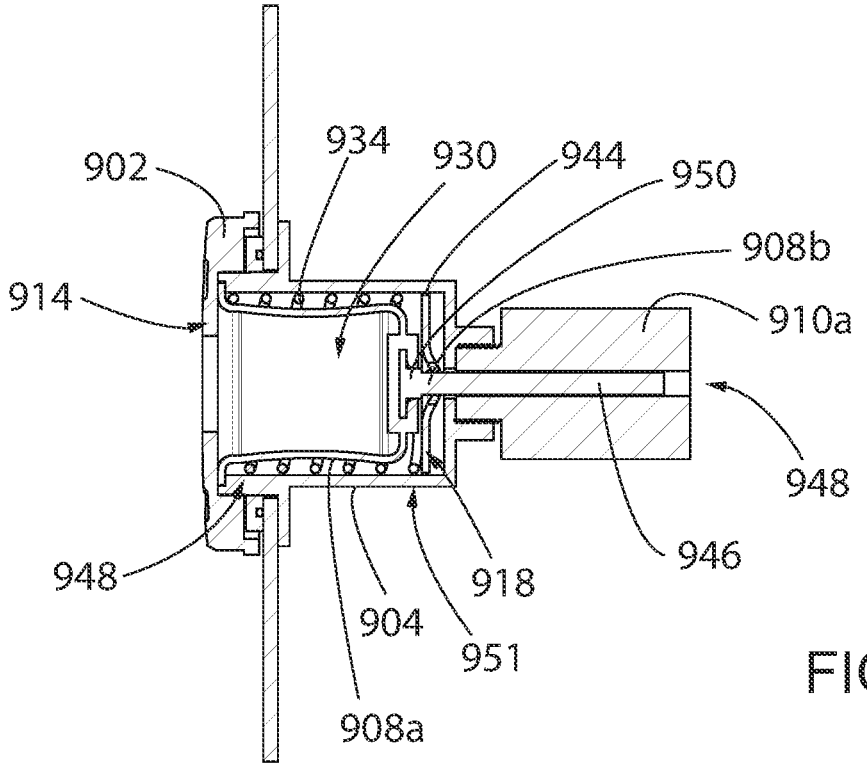
FIG. 26 is an elevational cross-section view of the jet assembly of FIG. 25.

Next, FIGS. 25-26 depict a jet assembly 900 according to yet another embodiment of the invention. The jet assembly 900 includes a faceplate 902 and a housing 904 having a chamber 912 formed therein. The faceplate 902 is coupled to a first end 926 of the housing 904. In varying embodiments of the invention, the faceplate 902 may be coupled to the first end 926 of the housing 904 by threading, fastening, or other coupling means or mechanisms.

A mover 908 is disposed within the chamber 912 of the housing 904 and is able to move within the chamber 912. FIG. 26 illustrates the mover 908 as including a diaphragm 908*a* and a piston or plunger 908*b*. The piston 908*b* moves between a first position and a second position, while the diaphragm 908*a* transitions accordingly. The jet assembly 900 further includes an exciter 910 to cause movement of the piston 908*b*, which generates a toroidal water jet stream through the opening 906 of the faceplate 902.

The exciter 910 is in the form of a solenoid 910*a* coupled to the housing 904 opposite the faceplate 902. A shaft 946 extends from the piston 908*b* and extends into a cavity 948 formed within the solenoid 910*a*. Energization and de-energization of solenoid 910*a* imparts a driving force upon shaft 946 and thereby transitions piston 908*b* from the first position to the second position.

As shown in FIG. 26, the diaphragm 908*a* is in the form of a flexible bellows that collapses and expands as the piston 908*b* moves between the first and second positions. A first end 914 of the diaphragm 908*a* is secured to an inner surface 916 of the faceplate 902. For example, the first end 914 of the diaphragm 908*a* is pinned between the inner surface 916 of the faceplate 902 and the first end 926 of the housing 904. Meanwhile, the second end 918 of the diaphragm 908*a* is coupled to the piston 808*b*. In the representative embodiment of the invention, the piston 808*b* includes a piston head 950. In turn, the second end 918 of the diaphragm 908*a* is molded to surround and encapsulate the piston head 950. As a result, movement of the piston 908*a* and piston head 950 directly causes movement of the second end of the diaphragm 908*a* and the resultant collapsing and expansion of the diaphragm 908*a*.

FIG. 26 further illustrates a biasing element 934 that is disposed within the chamber 912. The biasing element is oriented to surround the diaphragm 908*a* and piston head 950. A first end 948 of the biasing element 934 is located at the first end 926 of the housing 904. Meanwhile, a second end 951 of the biasing element 934 is in contact with an extension plate 944. The extension plate 944 extends radially from the shaft 946 of the piston 908*b* at a location adjacent the second end 918 of the diaphragm 908*a*. In alternative embodiments of the invention, the extension plate 944 may be spaced apart from the second end 918 of the diaphragm 908*a*. As a result, when the solenoid 910*a* is activated and the piston 908*b* moves from toward the first end 926 of the housing 904, the extension plate 944 also moves toward the first end 926 of the housing 904 and compresses the biasing element 934. In turn, when the solenoid 910*a* is deactivated, the biasing element 934 exerts a force on the extension plate 944 and the piston 908*b* and extension plate 944 move away from the first end 926 of the housing, which allows the biasing element 934 to expand. Alternatively, it is further appreciated that solenoid 910*a* could be provided as a bidirectional pneumatic or electronic solenoid wherein energization of the solenoid effectuates the desired movement of piston 908*b* between the first and second positions.

As the piston 908*b* moves, an available or accessible volume 930 in the chamber 812 changes. For example, when the piston 908*b* is in the first position, the piston head 946 is disposed adjacent the faceplate 902 to reduce the volume 930 and prevent water from entering the chamber 912. When the piston 908*b* is in the second position, the piston head 946 is spaced apart from the faceplate 902 to maximize the volume 930 and allow water to enter the chamber 912. Movement of the piston 908*b* from the first position toward the second position causes the volume 930 to increase and a pulse of water to be pulled into the chamber 912 through the opening 906 in the faceplate 902. Conversely, movement of the piston 908*b* from the second position toward the first position causes the volume 930 to decrease and eject water from the chamber 912 in a toroidal waveform through the opening 906 in the faceplate 902. Upon reaching the first position or second position, the piston 908*b* may delay before moving toward the other position.

Figure 27:
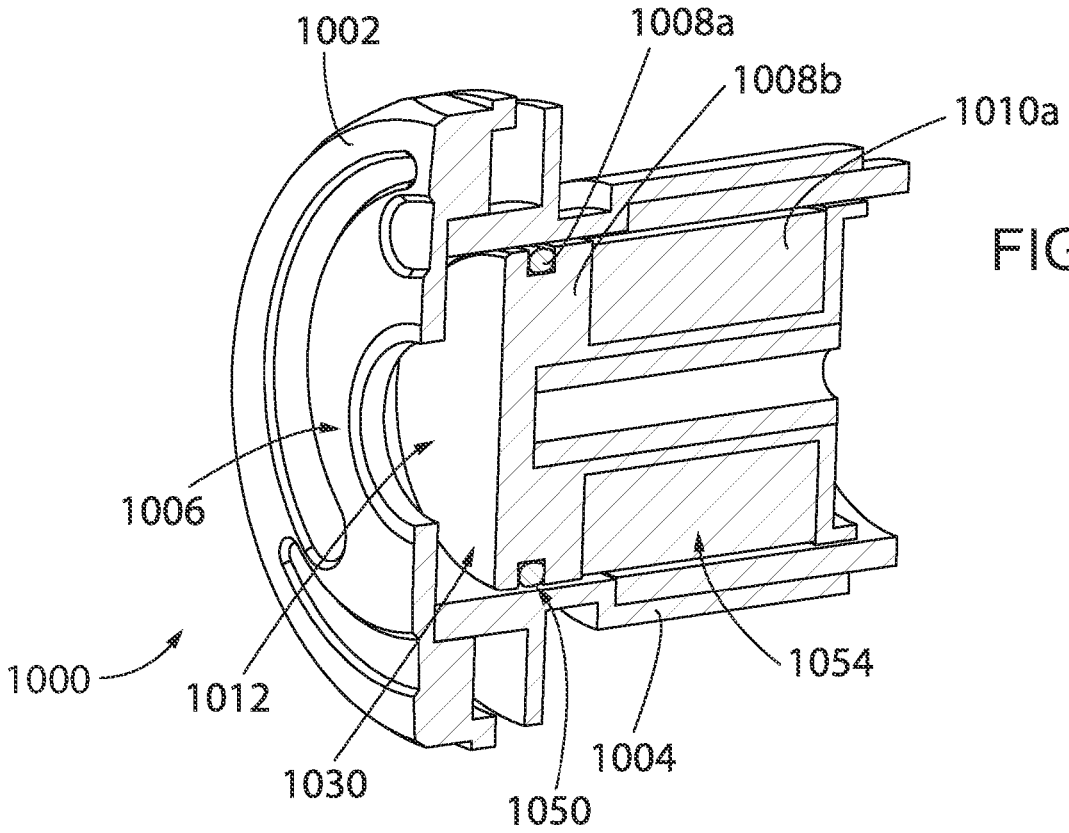
FIG. 27 is a perspective cross-section view of a jet assembly according to another embodiment of the present invention.
Figure 28:
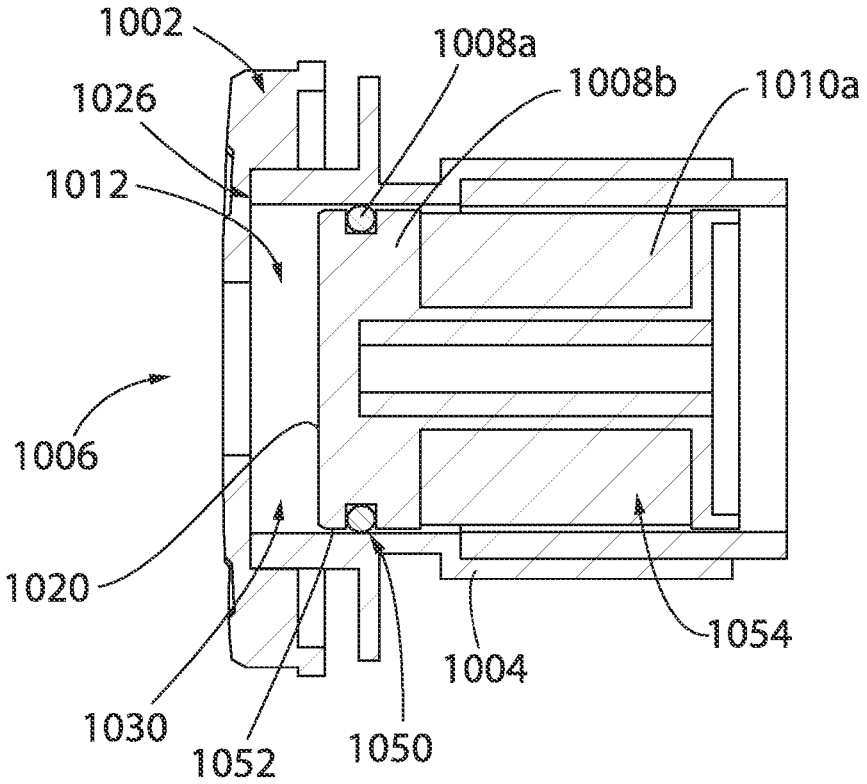
FIG. 28 is an elevational cross-section view of the jet assembly of FIG. 27.

Referring to FIGS. 27-28, another embodiment of a jet assembly 1000 according to the present disclosure includes a faceplate 1002 that is coupled to a first end 1026 of a housing 1004. The housing 1004 includes a chamber 1012 formed therein. In varying embodiments of the invention, the faceplate 1002 may be coupled to the housing 1004 by a threaded engagement or other mechanical coupling.

A mover 1008 is disposed within the chamber 1012 of the housing 1004. The mover 1008 is able to move between first and second positions within the chamber 1012. FIG. 28 illustrates the mover 1008 as a piston 1008*b* including a diaphragm 1008*a* in the form of a seal or an O-ring that is supported by the piston and disposed at a first end 1020 of the piston 1008*b*. The piston 1008*b* moves between a first position and a second position, while the diaphragm 1008*a* moves in concert with the piston 1008*b*.

As mentioned above, FIG. 28 depicts the diaphragm 1008*a* in the form of an o-ring seal disposed adjacent the first end 1020 of the piston 1008*b*. In the representative embodiment of the invention, the piston 1008*b* includes a channel 1050 disposed in a sidewall 1052 of the piston 1008*b*. The channel 1050 is configured to receive the seal 1008*a*. In turn, the seal 1008*a* is able to maintain a sealed interaction with the sidewalls 1012*a* of the chamber 1012, while the piston 1008*b* moves between the first and second positions. While FIG. 28 depicts the channel 1050 as being adjacent the first end 1020 of the piston 1008*b*, it is contemplated that the channel 1050 and corresponding diaphragm 1008*a* may be located at any location along a length of the piston 1008*b*.

The jet assembly 1000 further includes an exciter 1010 that is configured to actuate movement of the piston 1008*b* between the first and second positions in order to generate a toroidal water jet output. In the representative embodiment of the invention, the exciter 1010 is in the form of a solenoid 1010*a* disposed within the piston 1008*b*. As shown in FIG. 28, the piston 1008*b* includes a subsequent channel 1054 formed in the piston 1008*b*. The solenoid 1010*a* is disposed within the channel 1054 of the piston 1008*b* in order to surround a piston core 1056 and not extend past an outer surface of the piston 1008*b* to maintain a streamlined piston 1008*b* for movement within the chamber 1012. Activation and deactivation of the solenoid 1010*a* effectuates movement of the piston 1008*b* between the previously discussed first and second positions.

As the piston 1008*b* moves, an available or accessible volume 1030 in the chamber 1012 is modified. For instance, when the piston 1008*b* is in the first position, the piston 1008*b* is disposed adjacent the faceplate 1002 to minimize the volume 1030 and prevent water from entering the chamber 1012. When the piston 1008*b* is in the second position, the piston 1008*b* is spaced apart from the faceplate 1002 to maximize the volume 1030 and allow water to enter the chamber 1012. As a result, when the piston 1008*b* moves from the first position to the second position, the volume 1030 increases and a volume of water is pulled into the chamber 1012 through the opening 1006 in the faceplate 1002. When the piston 1008*b* moves from the second position toward the first position, the volume 1030 decreases and water is ejected from the chamber 1012 in a toroidal waveform through the opening 1006 in the faceplate 1002. It is contemplated that upon reaching the first or second position, the piston 1008*b* may be maintained in the relative top and bottom stroke positions for a delay period before transition to the other position.

Figure 29:
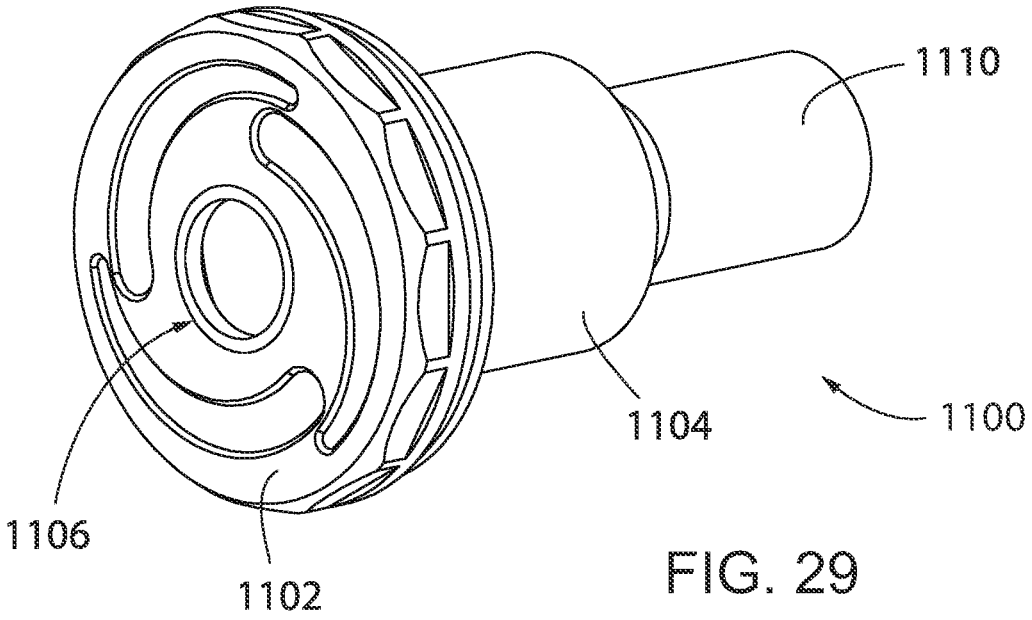
FIG. 29 is a perspective view of a jet assembly according to another embodiment of the present invention.
Figure 30:
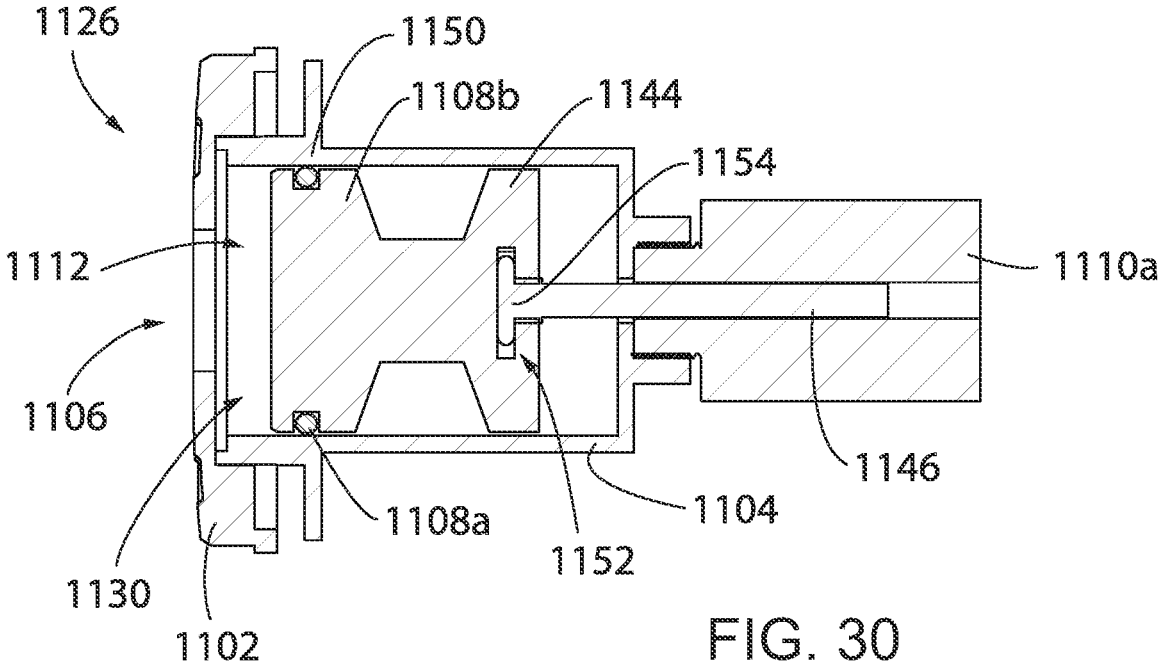
FIG. 30 is an elevational cross-section view of the jet assembly of FIG. 29.

Referring next to FIGS. 29-30, a jet assembly 1100 is shown according to yet another embodiment of the invention. The jet assembly 1100 includes a faceplate 1102 and a housing 1104 with a chamber 1112 formed therein. The faceplate 1102 is coupled to a first end 1126 of the housing 1104. In some embodiments of the invention, the faceplate 1102 may be coupled to the housing 1104 by threading. However, other embodiments of the invention may couple the faceplate 1102 to be housing 1104 by fastening or other mechanical coupling techniques.

A mover 1108 is disposed within the chamber 1112 of the housing 1104 and transitions between first and second positions. In the representative embodiment of the invention, the mover 1108 includes a diaphragm 1108*a* and a piston 1108*b*. An exciter 1110 causes the piston 1108*b* to move between a first position and a second position to create a toroidal waveform.

The diaphragm 1108*a* is depicted as being in the form of an o-ring seal disposed adjacent a first end 1120 of the piston 1108*b*. As shown in FIG. 30, the piston 1108*b* includes a channel 1150 formed in a sidewall 1152 thereof. The channel 1150 is configured to receive the seal 1108*a*. As a result, the seal 1108*a* is able to maintain contact with the sidewalls 1112*a* of the chamber 1112 during movement of the piston 1108*b* between the first and second positions. While the channel 1150 is shown as being located adjacent the first end 1120 of the piston 1108*b*, other embodiments of the invention may have the channel 1105 and corresponding diaphragm 1108*a* disposed at any location along a length of the piston 1108*b*.

The exciter 1110 is in the form of a solenoid 1110*a* attached to the housing 1104 opposite the faceplate 1102. The piston 1108*b* includes a main body 1144 and a plunger 946 extending from a cavity 1152 within the main body 1144 to a cavity 1148 formed within the solenoid 1110*a*. Meanwhile, the plunger 1146 also further includes a head 1154, which is disposed within the centrally-located cavity 1152 of the main body 114 of the piston 1108*b*. The cavity 1152 is formed to receive the head 1154 of the plunger 1146 so as to secure the plunger 1146 in place. In other words, the cavity 1152 includes a head portion 1152*a* and a shaft portion 1152*b* configured to receive corresponding portions of the plunger 1146 so that movement of the plunger 1146 is directly translated into movement of the piston 1108*b*.

Movement of the piston 1108*b* changes an available or accessible volume 1130 within the chamber 1112. When the piston 1108*b* is in the first position, the first end 1120 of the piston 1108*b* is disposed adjacent the faceplate 1102 to minimize the volume 1130 and prevent water from entering the chamber 112. When the piston 1108*b* is in the second position, the first end 1120 of the piston 1108*b* is spaced apart from the faceplate 1102 to maximize the volume 1130 and allow water to enter the chamber 112 through the opening 11066 in the faceplate 1102. As a result, movement of the piston 1108*b* from the first position to the second position causes the volume 1130 to increase and a pulse of water to be pulled into the chamber 1112 through the opening 1106 in the faceplate 1102. Meanwhile, movement of the piston 1108*b* from the second position toward the first position causes the volume 1130 to increase and the water to be ejected through the opening 1106 of the faceplate 1102 in a toroidal waveform. It is contemplated that the piston 1108*b* may be provided with a dwell or delay before transitioning from one from a respective one of the first and second positions toward the other of the respective first or second position.

Figure 31:
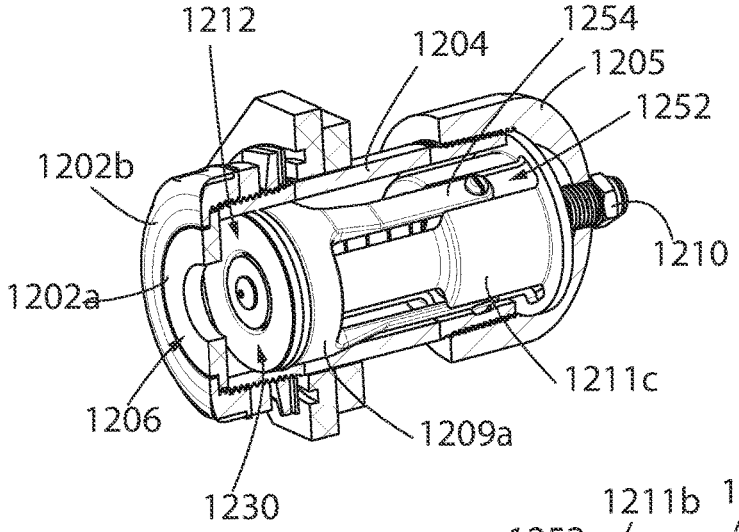
FIG. 31 is a perspective partial cross-section view of a jet assembly according to another embodiment of the present invention.
Figure 32:
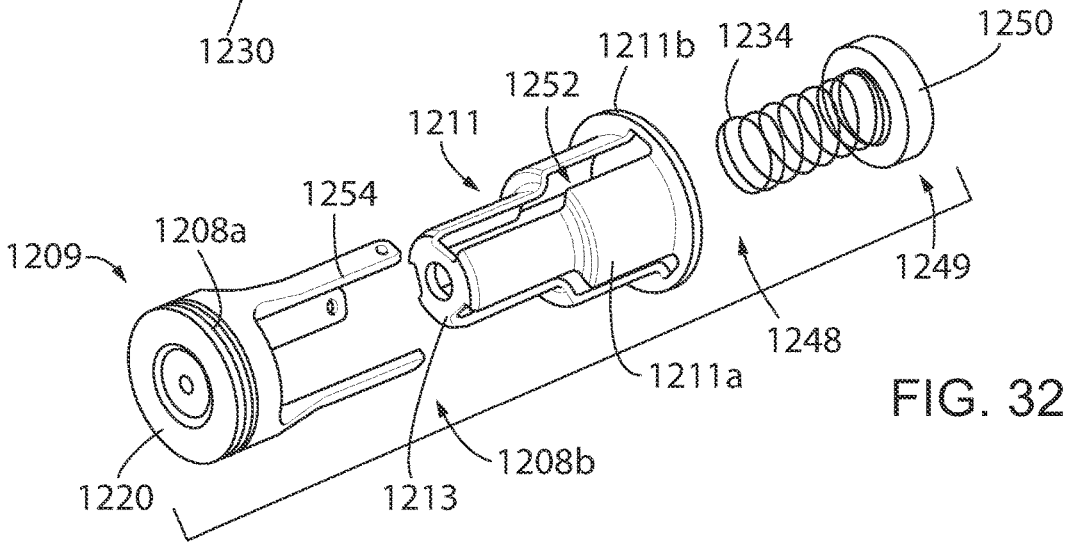
FIG. 32 is an exploded perspective view of a piston the jet assembly of FIG. 31.
Figure 33:
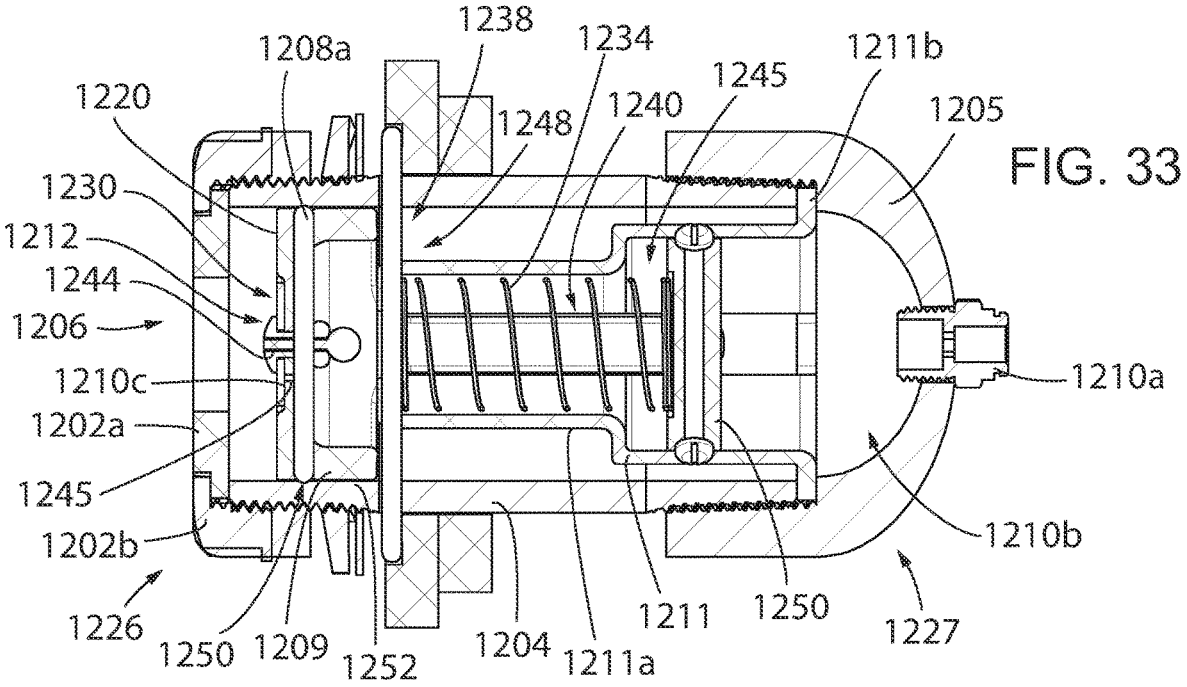
FIG. 33 is an elevational cross-section view of the jet assembly of FIG. 31.

FIGS. 31-33 depict a jet assembly 1200 according to another embodiment of the invention. The jet assembly 1200 includes a faceplate 1202 secured to a first end 1226 of a housing 1204. The faceplate 1202 includes at least one opening 1206 to assist in generating a toroidal shaped water jet stream. In the representative embodiment of the invention, the faceplate 1202 includes a disc 1202*a* and a retainer 1202*b*. The disc 1202*a* is placed in contact with the first end 1226 of the housing 1204 and includes the previously discussed opening 1206. The retainer 1202*b* is threadably coupled to the first end 1226 of the housing 1204 to secure the disc 1202*a* to the first end 1226 of the housing 1204. Other mechanical coupling methods may be used to secure the retainer 1202*b* to the housing 1204, in other embodiments of the invention.

The housing 1204 includes a chamber 1212 formed therein and configured to allow a mover 1208 to be disposed therein. As shown in FIG. 33, the mover 1208 includes a diaphragm 1208*a* and a piston 1208*b*. The piston 1208*b* includes a piston head 1209 and a piston base 1211 that are movably coupled to each other. The piston head 1209 of the piston 1208*b* transitions between a first position and a second position within the chamber 1212, while the piston base 1211 is maintained in a stationary position relative to housing 1204. In turn, the diaphragm 1208*a* moves with the head 1209 of piston 1208*b* and sealingly cooperates with the interior facing surface of housing 1240 to maintain the desired fluid isolation between chamber 1212 and the interior surface of housing 1204 that is rearward of piston head 1209. The jet assembly 1200 also includes an exciter 1210 that causes the movement of the piston head 1209 of the piston 1208*b* to create a toroidal water jet stream.

FIG. 33 further depicts the diaphragm 1208*a* in the form of an o-ring seal disposed adjacent a first end 1220 of the piston head 1209 of the piston 1208*b*. The piston head 1209 includes a channel 1250 formed in a sidewall 1252 thereof and configured to receive the seal 1208*a*. The seal 1208*a* and channel 1250 are sized so that the seal 1208*a* is able to maintain contact with the sidewalls 1212*a* of the chamber 1212, while the piston head 1209 moves between the first and second positions. In other embodiments of the invention, the channel 1250 and corresponding seal 1208*a* may be disposed at any location along a length of the piston head 1209.

As described above, the piston head 1209 is movably disposed within the chamber 1212, while the piston base 1211 is stationary within the chamber 1212. As shown in FIG. 33, the piston base 1211 includes a main body portion 1211*a* and a rim 1211*b* extending outward from an end of the main body portion 1211*a*. In turn, the rim 1211*b* is disposed between the second end 1227 of the housing 1204 and the cap 1205, in order to be secured in place. As a result, the piston base 1211 is unable to move within the chamber 1212. The main body portion 1211*a* of the piston base 1211 extends from the rim 1211*b* and toward the first end 1226 of the housing 1204 to a first end 1214 of the piston base 1211. A number of slots 1252 are formed in the sidewalls 1211*c* of the main body portion 1211*a* of the piston base 1211. The slots 1252 are configured to receive corresponding arms 1254 of the piston head 1209 that extend from the main portion 1209*a* of the piston head 1209 toward the second end 1227 of the housing 1204. The arms 1254 of the piston head 1209 are coupled to a spring plate 1250 disposed within the piston base 1211.

The exciter 1210 is in the form of a pneumatic system including a pneumatic valve 1210*a*, a pneumatic chamber 1210*b*, and a pneumatic relief valve 1210*c*. The pneumatic valve 1210*a* is coupled to a second end 1227 of the housing 1204. In the representative embodiment of the invention, a cap 1205 is threadably coupled to the second end 1227 of the housing 1204, and the pneumatic valve 1201*a* is disposed within the cap 1205. The pneumatic system 1210 provides air or another fluid into the pneumatic chamber 1210*b* via the pneumatic valve 1210*a*. The pneumatic chamber 1210*b* is representative of the space between the main portion 1209*a* of the piston head 1209 and the cap 1205. As the pressure within the pneumatic chamber 1210*b* increases, the piston head 1209 is moved toward the faceplate 1202 of the jet assembly 1200 in response to an increase in the volume of the pneumatic chamber 1210*b*. In turn, the spring plate 1250, which is coupled to the piston head 1209 as described above, also moves toward the faceplate 1202 of the jet assembly 1200.

A biasing element 1234, such as a spring, is disposed within a biasing chamber 1240 disposed within the piston base 1211. A first end 1238 of the biasing chamber 1240 is at a first end 1213 of the piston base 1211, opposite the rim 1211*b* of the piston base 1211. The biasing element 1234 extends from a first end 1248 in contact with the first end 1238 of the biasing chamber 1240 to a second end 1249 in contact with the spring plate 1250. As a result, when the pneumatic system 1210 increases the air pressure within the pneumatic chamber 1210*b* and moves the spring plate 1250, the biasing element 1234 is compressed as the movement of the spring plate 1250 reduces the spacing between the spring plate 1250 and the first end 1238 of the biasing chamber 1240. When the pneumatic system 1210 reduces the pressure within the pneumatic chamber 1210*b* via the pneumatic relief valve 1201*c*, the biasing element 1234 exerts a force on the spring plate 1250 and causes the piston head 1209 and spring plate 1250 to move away from the faceplate 1202. As the spacing between the spring plate 1250 and the first end 1238 of the biasing chamber 1240 increases, the biasing element 1234 expands.

The pneumatic relief valve 1210*c* is in the form of a membrane coupled to the first end 1220 of the piston head 1209 by a fastener 1244, such as a rivet or the like. The membrane 1210*c* covers at least one orifice 1245 formed in the first end 1220 of the piston head. To reduce the pressure within the pneumatic chamber 1210*b*, the membrane 1210 is supported by the piston head such that the membrane can move away from the first end 1220 of the piston head 1209 to expose the orifice 1245 that lies therebehind while remaining coupled to the piston head 1209.

As the piston head 1209 of the piston 1208*b* moves between the first and second positions, an available or accessible working fluid volume 1230 within the chamber 1212 is modified. For example, when the piston 1208*b* is in the first position, the first end 1220 is adjacent the faceplate 1202 to reduce the volume 1230 and prevent water from entering the chamber 1212. Conversely, when the piston 1208*b* is in the second position, the first end 1220 is spaced apart from the faceplate 1202 to increase the volume 1230 and allow water to enter the chamber 1212. As such, when the piston 1208*b* moves from the first position to the second position, the volume 1230 increases and a pulse of water is pulled into the chamber 1212 through the opening 1206. After a delay, the piston 1208*b* may be moved from the second position to the first position to reduce the volume 1230 and eject the water from the chamber 1212 and through the opening 1206 to create a toroidal jet of water.

Figure 34:
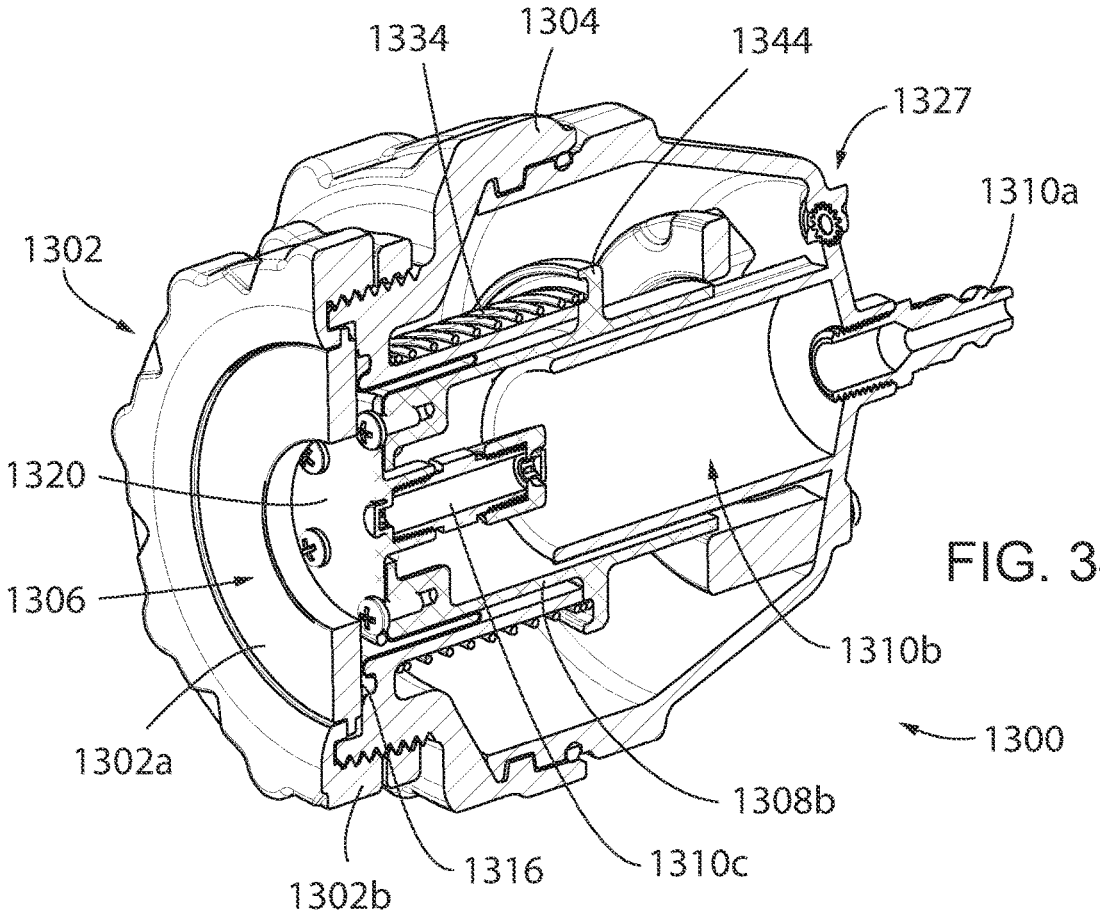
FIG. 34 is a perspective cross-section view of a jet assembly according to another embodiment of the present invention.
Figure 35:
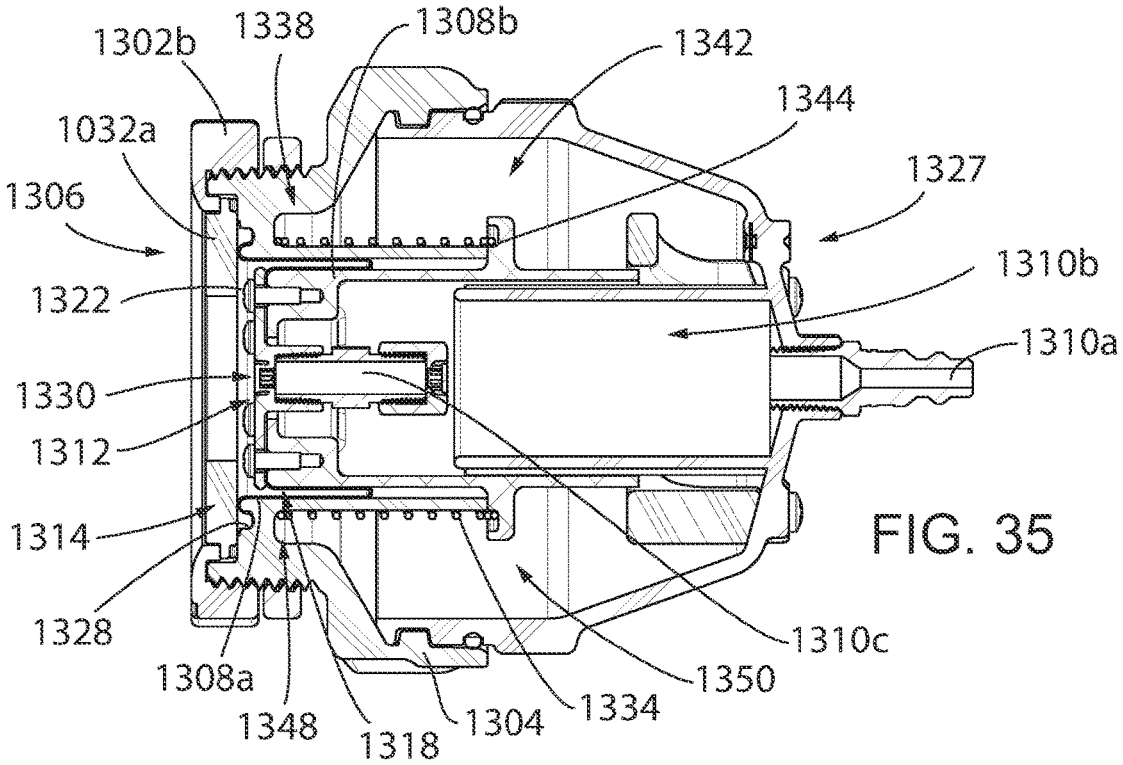
FIG. 35 is an elevational cross-section view of the jet assembly of FIG. 34.

Referring now to FIGS. 34-35, another alternative jet assembly 1300 is shown. The jet assembly 1300 includes a faceplate 1302 coupled to a first end 1326 of a housing 1304. The faceplate 1300 includes a disc 1302*a* and a retainer 1302*b*. The disc 1302*a* includes at least one opening 1306 formed therein to expose a chamber 1312 within the housing 1304. The disc 1302*a* is placed at the first end 1326 of the housing 1304 and secured thereto by the retainer 1302*b*. As shown in FIG. 35, the retainer 1302*b* is threadably coupled to the first end 1326 of the housing 1304 in order to secure the disc 1302*a* to the first end 1326 of the housing 1304. In other embodiments of the invention, the retainer 1302*b* may be coupled to the first end 1326 of the housing 1304 by other mechanical coupling methods.

A mover 1308 is disposed within the chamber 1312 of the housing 1304. Further, the mover 1308 is able to move within the chamber 1312. As shown in FIGS. 34-35, the mover 1308 is shown as including a diaphragm 1308*a* and a piston 1308*b*. The piston 1308*b* moves between a first position and a second position, while the diaphragm 1308*a* transitions accordingly, which will be described in further detail below. The jet assembly 1300 also includes an exciter 1310 that causes the piston 1308*b* to move between the first and second positions in order to generate a toroidal water jet stream through the opening 1306 of the faceplate 1302.

The exciter 1310 of the jet assembly 1300 is in the form of a pneumatic system including a pneumatic valve 1310*a*, a pneumatic chamber 1310*b*, and a pneumatic relief valve 1310*c*. The pneumatic valve 1310*a* is coupled to a second end 1327 of the housing 1304 opposite the first end 1326 of the housing 1304, the pneumatic chamber 1310*b* is disposed within the piston 1308*b*, and the pneumatic relief valve 1310*c* is disposed at a first end 1320 of the piston 1308*b* and extends into the pneumatic chamber 1310*b*. The pneumatic system 1310 provides air or another fluid into the pneumatic chamber 1310*b* via the pneumatic valve 1310*a*. As the pressure increases within the pneumatic chamber 1310*b*, the piston 1308*b* is moved toward the faceplate 1302 of the jet assembly 1300. In turn, the pneumatic relief valve 1310*c* may be used to decrease the pressure within the pneumatic chamber 1310*b* in order to move the piston 1308*b* away from the faceplate 1302.

A biasing element 1334, such as a spring, is disposed within a biasing chamber 1340 of the housing 1304 in order to surround the piston 1308*b*. A first end 1338 of the biasing chamber 1340 may be disposed adjacent the first end 1326 of the housing 1304. Further, the second end 1342 of the piston 1308*b* may include an extension portion 1344 extending radially outward therefrom and into the biasing chamber 1340. The biasing element 1334 extends from a first end 1348 in contact with the first end 1338 of the biasing chamber 1340 and a second end 1350 in contact with a front face 1352 of the extension portion 1344 of the piston 1308*b*. As a result, when the pneumatic system 1310 increases the air pressure within the pneumatic chamber 1310*b* and moves the piston 1308*b* to the first position, the biasing element 1334 compresses as the movement of the extension portion 1344 reduces the spacing between the extension portion 1344 and the first end 1338 of the biasing chamber 1340. When the pneumatic system reduces the air pressure within the pneumatic chamber 1310*b*, the biasing element 1334 exerts a force on the extension portion 1344 and causes the piston 1308*b* to move to the second position. In turn, the biasing element 1334 expands as the spacing between the extension portion 1344 and the first end 1338 of the biasing chamber 1340 increases.

FIGS. 34 and 35 further illustrate the diaphragm 1308*a* in the form of a rolling bellows, similar to a number of embodiments described above. A first end 1314 of the bellows 1308*a* is secured to an inner surface 1316 of the faceplate disc 1302*a*. The first end 1314 of the bellows 1308*a* may include a rim 1328 that is disposed between the disc 1302*a* of the faceplate 1302 and the first end 1326 of the housing 1304 to secure the first end 1314 of the bellows 1308*a* in place. A second end 1318 of the bellows 1308*a* may be mechanically coupled to the first end 1320 of the piston 1308*b*. While the representative embodiment of the invention depicts the second end 1318 of the bellows 1308*a* as being coupled to the first end 1320 of the piston 1308*b* via a number of fasteners 1322, other embodiments of the invention may use other coupling methods. Movement of the piston 1308*a* causes movement of the second end 1316 of the bellows 1308*a*. For example, as the piston 1308*b* moves from the second position to the first position, the bellows 1308*a* rolls onto itself. Conversely, as the piston 1308*b* moves from the first position to the second position, the bellows 1308*a* unrolls.

Movement of the piston 1308*b* causes an accessible volume 1330 within the chamber 1312 to be modified. For example, when the piston 1308*b* is in the first position, the first end 1320 of the piston 1308*b* is placed adjacent the faceplate 1302 of the jet assembly 1300 to minimize the volume 1330 and prevent water from entering the chamber 1312. When the piston 1308*b* is in the second position, the first end 1320 of the piston 1308*b* is spaced apart from the faceplate 1302 to maximize the volume 1330 and allow water to enter the chamber 1312 through the opening 1306 in the faceplate 1302. As a result, when the piston 1308*b* moves from the first position to the second position, the volume 1330 is increased and a pulse of water is pulled into the chamber 1312 through the opening 1306 in the faceplate 1302. After a delay, the piston 1308*b* is then moved back to the first position and the volume 1330 is reduced to cause the water within the chamber 1312 to be ejected through the opening 1306 in the faceplate 1302 in a toroidal waveform.

Figure 36:
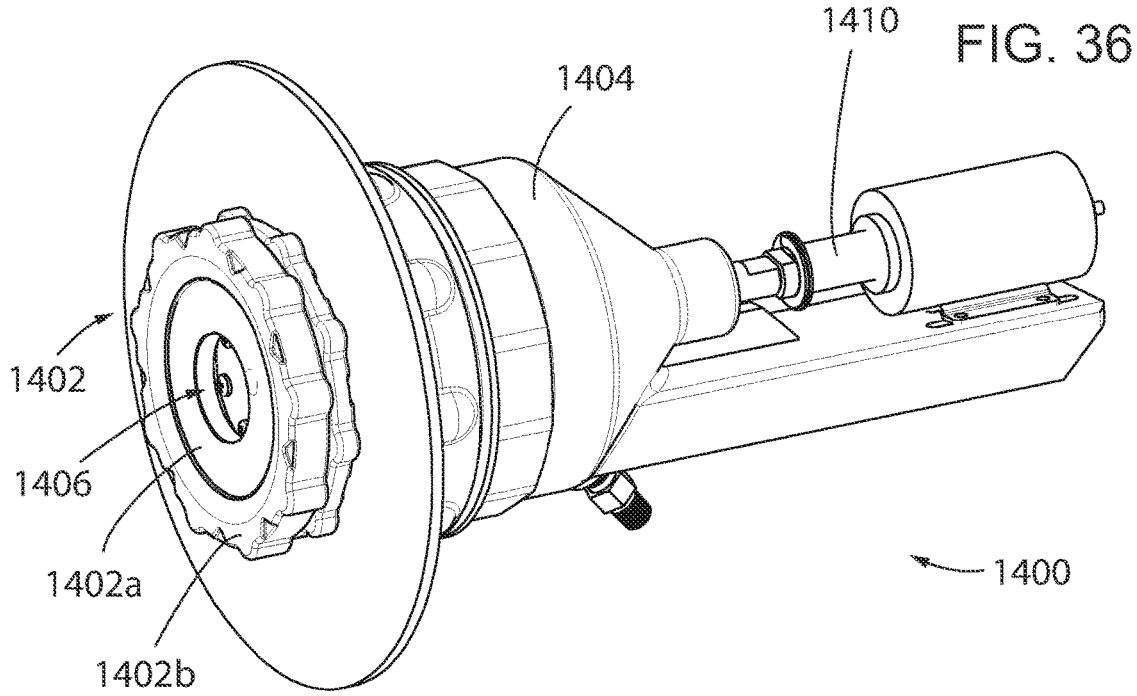
FIG. 36 is a perspective view of a jet assembly according to another embodiment of the present invention.
Figure 37:
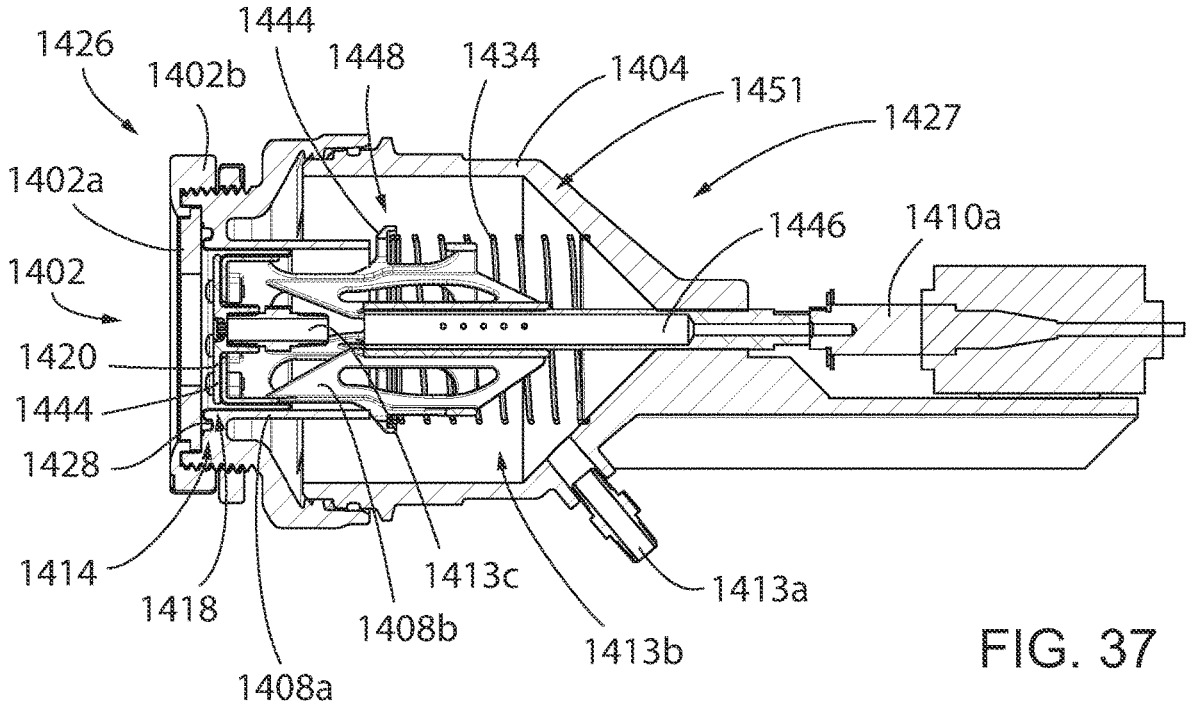
FIG. 37 is an elevational cross-section view of the jet assembly of FIG. 36.

Referring now to FIGS. 36-37, a jet assembly 1400 is shown according to yet another embodiment of the invention. The jet assembly 1400 includes a faceplate 1402 secured to a housing 1404. The faceplate 1402 includes a disc 1402*a* and a retainer 1402*b*. The disc 1402*a* includes at least one orifice 1406 and is in contact with a first end 1426 of the housing 1404. The retainer 1402*b* is threadably coupled to the first end 1426 of the housing 1404 in order to secure the disc 1402*a* to the first end 1426 of the housing 1404. In other embodiments of the invention, the retainer 1402*b* may be coupled to the housing 1404 by way of other mechanical coupling methods.

A chamber 1412 is disposed within the housing 1404, and a mover 1408 is disposed within the chamber 1412. As shown in FIG. 37, the mover 1408 includes a diaphragm 1408*a* and a piston 1408*b*. The piston 1408*b* moves between a first position and a second position, while the diaphragm 1408*a* transitions accordingly. The jet assembly 1400 also includes an exciter 1410 that causes movement of the piston 1408*b* to create a toroidal water jet stream through the opening 1406 of the faceplate 1402.

The diaphragm 1408*a* is in the form of a rolling diaphragm or rolling bellows. A first end 1414 of the bellows 1408*a* is secured to an inner surface 1416 of the faceplate disc 1402*a*. In the representative embodiment of the invention, the bellows 1408*a* includes a rim 1428 that is held in place between the disc 1402*a* and the first end 1426 of the housing 1404 in order to secure the first end 1414 of the bellows 1408*a* to the inner surface 1416 of the faceplate disc 1402*a*. A second end 1418 of the bellows 1408*a* is coupled to a first end 1420 of the piston 1408*b*. While FIG. 37 depicts the second end 1418 of the bellows 1408*a* being secured to the first end 1420 of the piston 1408*b* by way of fasteners 1444, other coupling methods are contemplated. Regardless of the connection methodology associated with securing bellows 1408*a* relative to piston 1408*b*, when the piston 1408*b* moves from the second position toward the first position, the bellows 1408*a* transitions by rolling onto itself. When the piston 1408*a* moves from the first position toward the second position, the bellows 1408*a* transitions by unrolling itself.

The exciter 1410 is in the form of a solenoid 1410*a* coupled to a second end 1427 of the housing 1404, opposite the first end 1426 of the housing 1404. The solenoid 1410*a* includes a shaft 1446 that extends toward and is coupled to the piston 1408*b*. In turn, when the solenoid is activated, the piston 1408*b* is pulled by the shaft 1446 toward the second end 1427 of the housing 1404 and to the second position. When the solenoid is deactivated, the piston 1408*b* is able to return toward the first end 1426 of the housing 1404 and to the first position. It is appreciated that solenoid 1410*a* could be provided in a generally reverse operational nature, wherein actuation of the solenoid drives piston 1408*b* toward the faceplate and deactivation of the solenoid allows the piston 1408*a* to translate toward the second position, or a configuration wherein dissimilar drive signals effectuate driven operation of the piston toward the respective first and second positions.

Referring to FIG. 37, in a preferred configuration, a biasing element 1434 is disposed within the housing 1404 and surrounding the shaft 1446 of the solenoid 1410*a*. The biasing element 1434 extends from a first end 1448 in contact with an extension portion 1444 to a second end 1451 in contact with a second end 1427 of the housing 1404. The extension portion 1444 extends radially outward from the piston 1408*b* at a location spaced apart from the first end 1420 of the piston 1408*b*. As a result, when the solenoid 1410*a* pulls the piston 1408*b* toward the second end 1427 of the housing 1404, the biasing element 1444 is compressed. In turn, when the solenoid 1410*a* is deactivated, the biasing element 1444 exerts a force on the extension portion 1444 and pushed the piston 1408*b* toward the first position.

As the piston 1408*b* moves, an available or accessible volume 1430 associated with the working fluid disposed within the chamber 1412 is modified. When the piston 1408*b* is in the first position, the first end 1420 of the piston 1408*b* is generally disposed adjacent the faceplate 1402 to reduce the volume 1430 and prevent water from entering the chamber 1412. When the piston 1408*b* is in the second position, the first end 1420 of the piston 1408*b* is spaced apart from the faceplate 1402 to increase the volume 1430 and allow water to enter the chamber 1412. Hence, when the piston 1408*b* moves from the first position to the second position, the volume 1430 is increased and a volume of water is pulled into the chamber 1412 through the opening 1406. After a delay, the piston 1408*b* may be moved back toward the first position from the second position any thereby reduce the volume 1430 and cause the water within the chamber 1412 to be ejected through the opening 1406 in the form of a toroidal water jet stream.

The jet assembly may further include an alternative exciter 1413 in the form of a pneumatic system. The pneumatic system 1413 may include a pneumatic valve 1413*a*, a pneumatic chamber 1413*b*, and a pneumatic relief valve 1413*c*. The pneumatic valve 1413*a* is coupled to the housing 1404 to supply air or another fluid to a pneumatic chamber 413*b*, which is representative the space within the housing 1404 between the second end 1427 of the housing 1404 and the first end 1420 of the piston 1408*b*. When the pneumatic system 1410 increases the pressure within the pneumatic chamber 1413*b*, the piston 1408*b* is moved to the first position in order to increase the size of the pneumatic chamber 1413*b*. The pneumatic relief valve 1413*c* is disposed at the first end 1420 of the piston 1408*b* and extends into the pneumatic chamber 1410*b*. The pneumatic relief valve 1413*c* assists in decreasing the pressure within the pneumatic chamber 1413*b* in order to move the piston 1408*b* to the second position and decrease the size of the pneumatic chamber 1413*b*.

Figure 38:
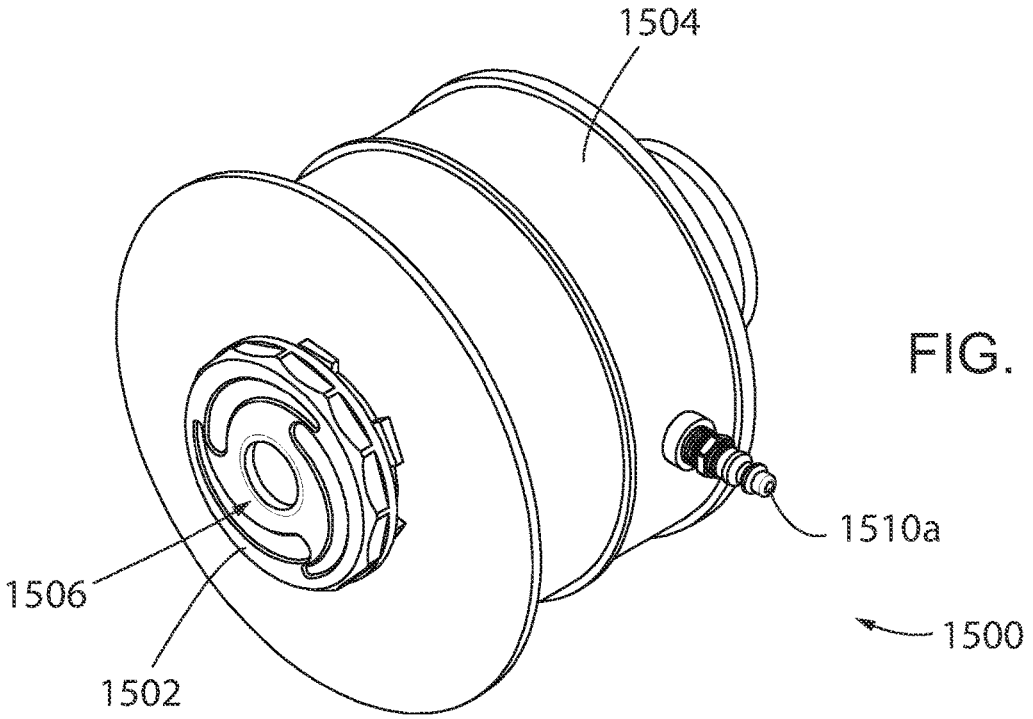
FIG. 38 is a perspective view of a jet assembly according to another embodiment of the present invention.
Figure 39:
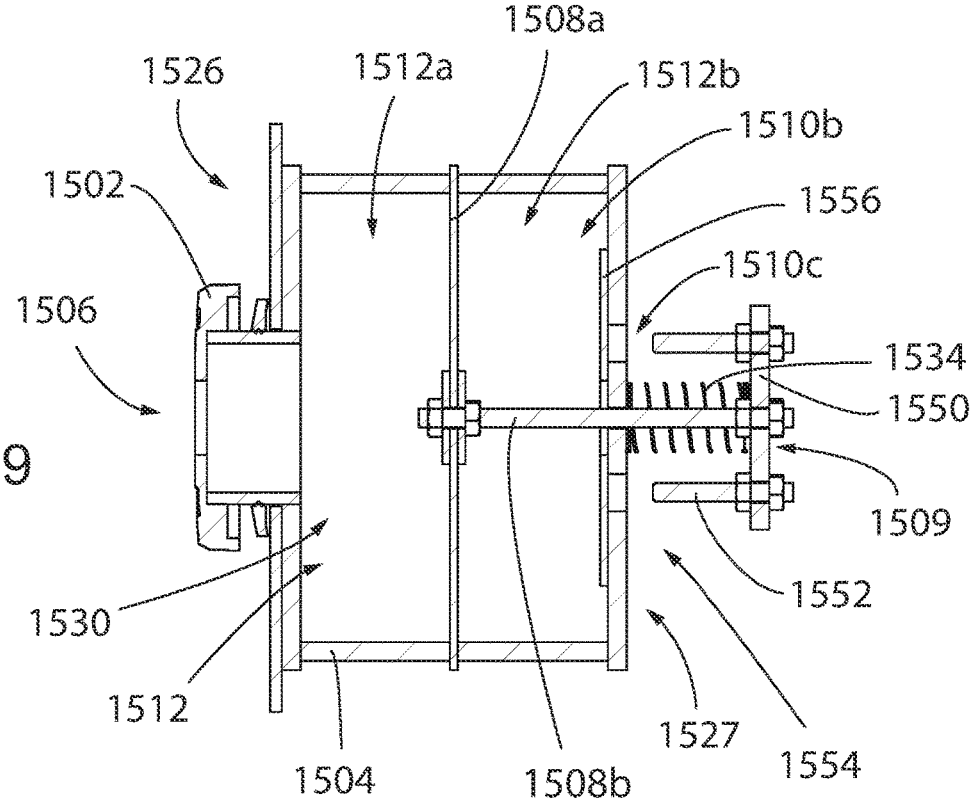
FIG. 39 is an elevational cross-section view of the jet assembly of FIG. 38.
Figure 40:
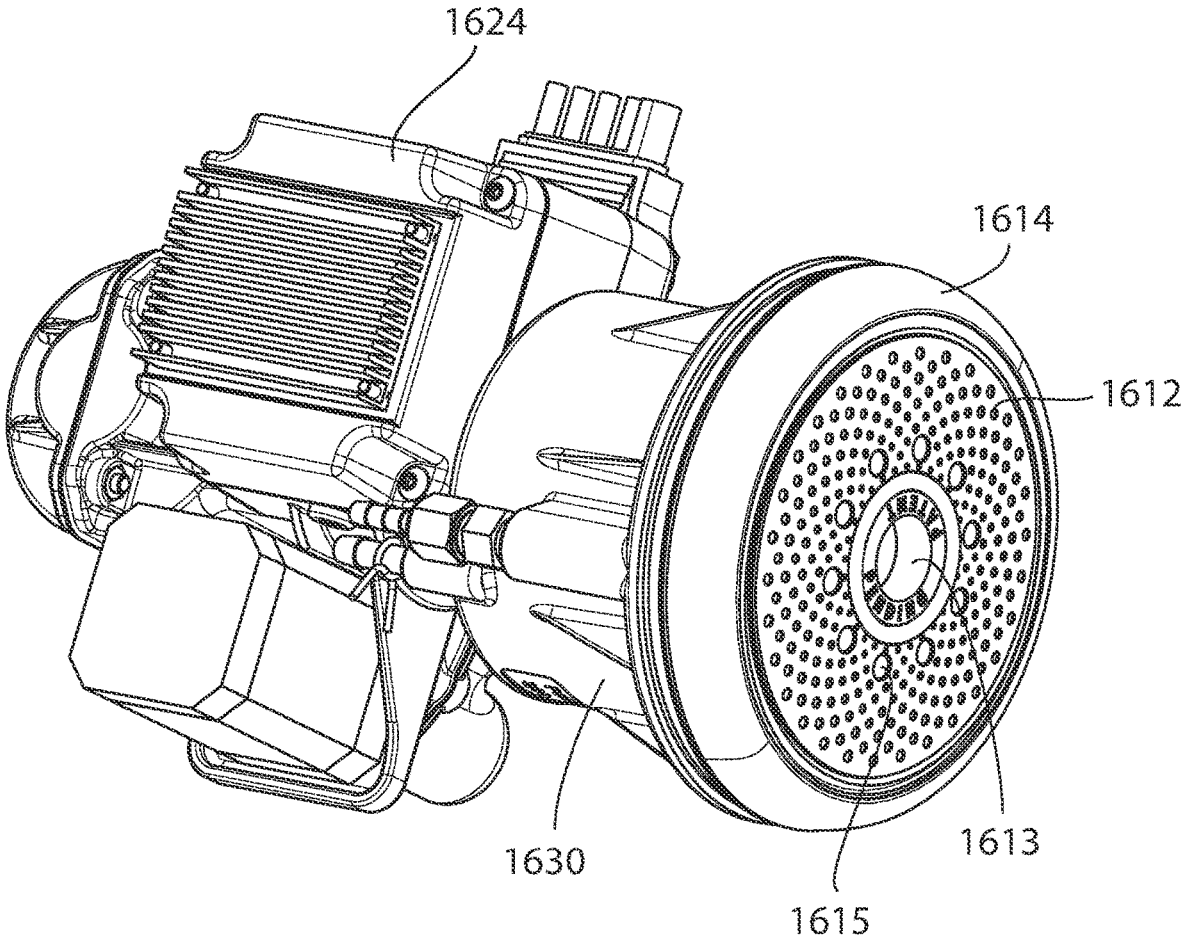
FIG. 40 is a perspective view of a jet assembly according to yet another embodiment of the present invention.

Next, FIGS. 38-39 depicts a jet assembly 1500 according to another embodiment of the invention. The jet assembly 1500 includes a faceplate 1502, a housing 1504, and a chamber 1512 within the housing 1504. The faceplate 1502 is secured to a first end 1526 of the housing 1504. As shown in FIG. 38, the housing 1504 may include a neck 1504*a* at its first end 1526.

A mover 1508 is disposed within the chamber 1512 of the housing 1504. In this embodiment of the invention, the mover 1508 includes a diaphragm 1508*a* and a shaft 1508*b* extending from the diaphragm and out a second end 1527 of the housing 1504 opposite the first end 1526. The diaphragm 1508*a* is oriented to divide the chamber 1512 into a first portion 1512*a* and a second portion 1512*b*. The first portion 1512*a* is fluidly coupled to the working fluid environment via an opening 1506 in the faceplate 1502, while the second portion 1512*b* is fluidically coupled with an exciter 1510, such as a pneumatic system, coupled to the housing 1512.

The pneumatic system 1510 includes a pneumatic valve 1510*a*, which, as shown in FIG. 38, is coupled to the housing 1504 of the jet assembly 1500. The pneumatic system 1510 provides air or another fluid into a pneumatic chamber 1510*b* representative of the second portion 1512*b* of the chamber 1512. As will be described in further detail below, the diaphragm 1508*b* is configured to transfer between a first position and a second position in response to air entering and leaving the second portion 1512*b* of the chamber 1512.

As disclosed above, the shaft 1508*b* of the mover 1508 extends from the diaphragm 1408*a*, through a second end 1527 of the housing 1504, to a distal end 1509 of the shaft 1508*b* located outside the housing 1504. A spring plate 1550 is coupled to the distal end 1509 of the shaft 1508*b*. The spring plate 1500 extends laterally from the distal end 1509 of the shaft 1508*b*. As shown in FIG. 39, supports 1552 are coupled to the plate 1550 and oriented to extend parallel to the shaft 1508*b* in a direction toward the housing 1504. When the diaphragm 1508*a* is in a neutral or resting position, the supports 1552 are spaced apart from the second end 1527 of the housing 1504. When the diaphragm is in the second position, the supports 1552 are further spaced apart from the second end 1527 of the housing 1504. When the diaphragm is in the first position, the supports 1552 extend through orifices 1554 formed through the second end 1527 of the housing 1504.

FIG. 39 further depicts a biasing element 1534 disposed between the second end 1527 of the housing 1504 and the plate 1550. In the representative embodiment of the invention, the biasing element 1534 is in the form of a spring surrounding the shaft 1508*b* outside the housing 1504. When the pneumatic system 1510 provides air into the second portion 1512*b* of the chamber 1512, the diaphragm 1508*b* is moved to the first position. In turn, the shaft 1508*b* moves with the diaphragm 1508*b*, and the plate 1550 moves with the shaft 1508*b* to be oriented nearer the second end 1527 of the housing 1504. Further, the supports 1552 extend through the orifices 1554 of the second end 1527 of the housing 1504 and dislodge a membrane 1556 located within the chamber 1512 of the housing 1504 at the second end 1527 of the housing 1504. Dislodging the membrane 1556 causes the air to be released from the second portion 1512*b* of the chamber 1512. The membrane 1556 and orifices 1554 work together as a pneumatic relief valve 1510*c*.

As a result, when the diaphragm 1508*a* is moved to the first position and the pneumatic system 1510 stops providing air to the second portion 1512*b* of the chamber 1512, the biasing element 1524 is able to exert a force on the plate 1550 to cause the diaphragm 1508*a* to move from the first position to the second position away from the first end 1526 of the housing 1504. In turn, the shaft 1508*b* moves with the diaphragm 1508*a*, the plate 1550 moves away from the second end 1527 of the housing, the supports 1552 are spaced apart from the second end 1527 of the housing. As such, the membrane 1556 reengages the interior facing surface of the housing 1504 and covers the orifices 1554 thereby sealing the second portion 1512*b* of the chamber 1512 from atmosphere.

As the diaphragm 1508*a* and the shaft 1508*b* move, an available or accessible volume 1530 in the chamber 1512 is modified. In this embodiment of the invention, the first portion 1512*a* of the chamber 1512 is representative of the volume 1530. When the mover 1508 is in the first position, the diaphragm 1508*a* flexes toward the first end 1526 of the housing 1504 to reduce the volume 1530 associated with chamber 1512 and thereby reduce the amount of water in the first portion 1512*a* of the chamber 1512. Conversely, when the mover 1508 is in the second position, the diaphragm 1508*a* is flexed away from the first end 1526 of the housing and toward the second end 1527 of the housing 1504. In turn, the volume 1530 increases thereby increasing the amount of water associated with the first portion 1512*a* of the chamber 1512. As the mover 1508 moves from the first position to the second position, the volume 1530 is increased and a volume of water is pulled into the first portion 1512*a* of the chamber 1512. When the mover 1508 moves from the second position toward the first position, the volume 1530 is decreased and a toroidal jet of water if ejected from the first portion 1512*a* of the chamber 1512 through the opening 1506 in the faceplate 1502.

Figure 41:
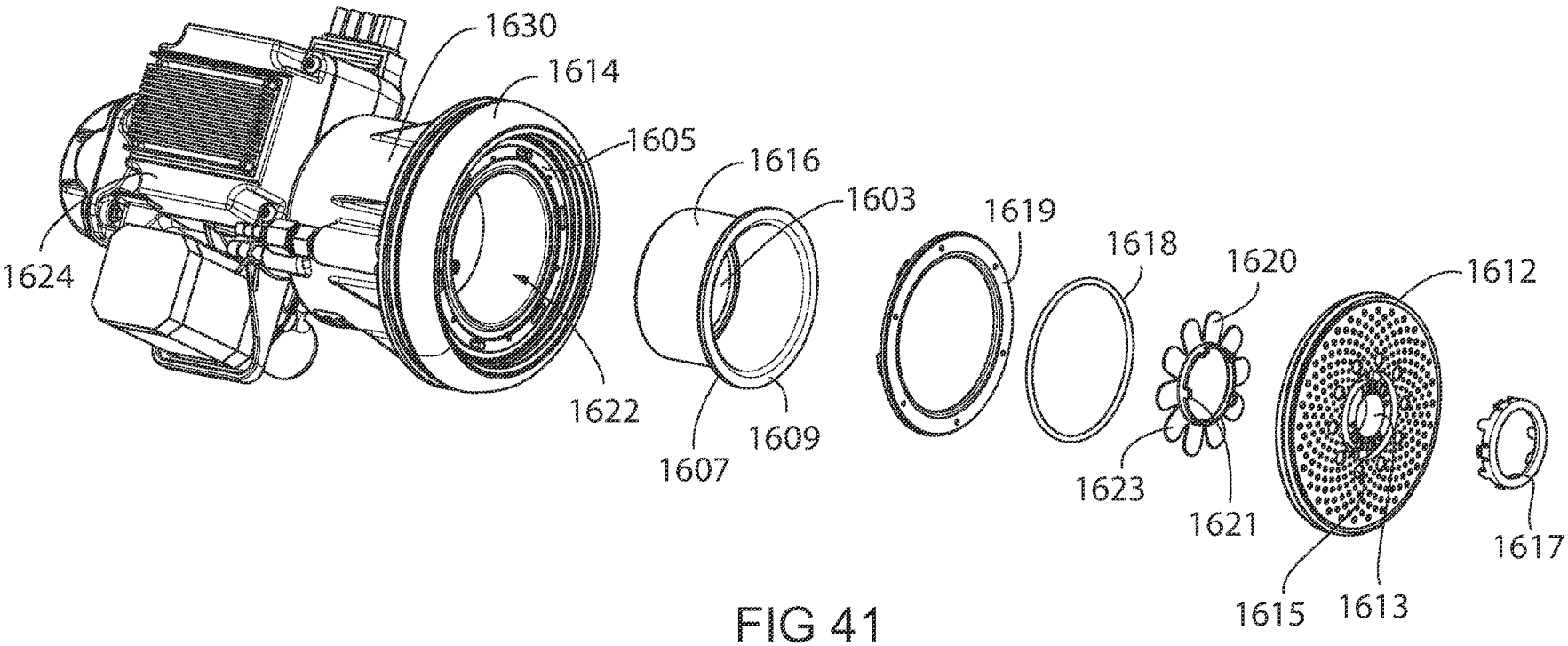
FIG. 41 is an exploded perspective view of the jet assembly shown in FIG. 40.

Referring next to FIGS. 40-44, a jet assembly 1610 according to another embodiment of the present application is shown and that is constructed similar to jet assembly 10 as shown in FIGS. 1-4 as described above. The jet assembly 1610 includes a faceplate 1612, a housing 1614, a diaphragm 1616 disposed between the faceplate 1612 and the housing 1614, a seal 1618, a flap arrangement 1620, and an exciter 1624. As shown in FIG. 41, the flap arrangement 1620 is disposed between the faceplate 1612 and the diaphragm 1616, which is contained within a chamber 1622 similar to chamber 22 of jet assembly 10. The flap arrangement 1620 is coupled to the faceplate 1612 by way of a retaining element 1617.

Figure 42:
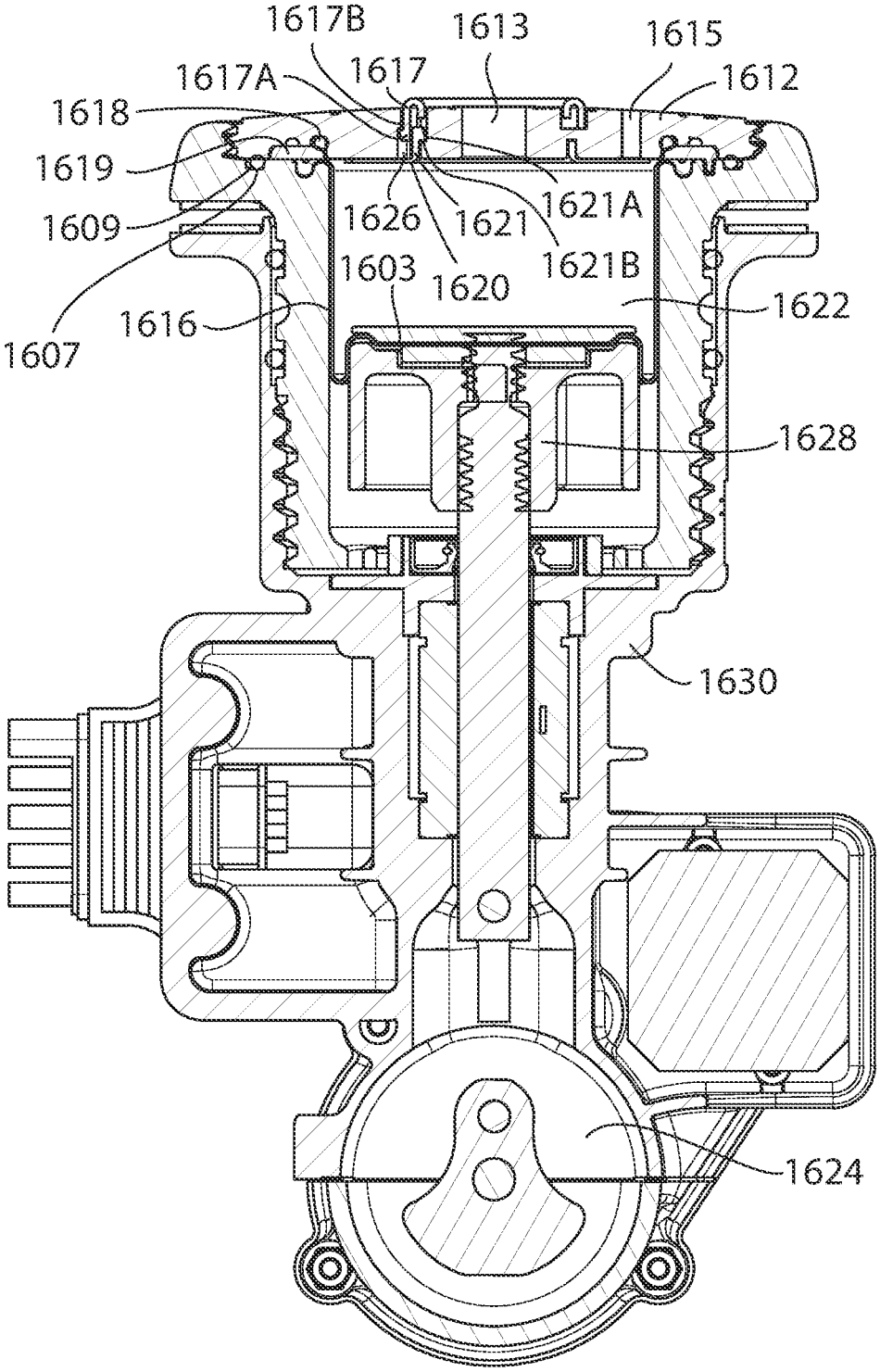
FIG. 42 is a longitudinal cross section view of the jet assembly shown in FIG. 40.

As further shown in FIG. 42, a slot 1626 is formed in faceplate 1612 and sized to receive the retaining element 1617 and an extension 1621 of the flap arrangement 1620 extending vertically from the main body 1623 of the flap arrangement 1620. In the representative embodiment of the invention, the retaining element 1617 and the extension 1621 of the flap arrangement 1620 are configured to interfit with the sidewalls of the slot 1626 and each other in order to secure both the retaining element 1617 and the flap arrangement 1620 in place. That is, the retaining element 1617 and the extension 1621 of the flap arrangement 1620 include tabs 1617A, 1621A, respectively, that interfit with detents 1617B, 1621B, respectively, in the sidewalls of the slot 1626. When both the retaining element 1617 and the extension 1621 of the flap arrangement are inserted into the slot 1626, they exert a force on each other so that the tabs 1617A, 1621A interfit with their respective detents 1617B, 1621B in the sidewalls in a locked orientation. It is appreciated that discrete detents could be provided in discrete slots formed in the sidewalls such that retaining element 1617 flap arrangement 1620 can be secured in an independent manner relative to faceplate 1612.

The main body 1623 of the flap arrangement 1620 is in the form of flaps that extend outward and are aligned with the inlets 1615 of the faceplate 1612. During the inlet flow, a fluid is able to enter the chamber 1622 through both the inlets 1615 and the outlet 1613 without interference by the flap 1623. During the outlet flow, the flaps 1623 block fluid from leaving the chamber 1622 via inlets 1615 such that fluid is forced to leave chamber 1622 through outlet 1613 defined by faceplate 1612.

FIG. 42 is a longitudinal cross section view of jet assembly 1610 and further illustrates the diaphragm 1616. A first end 1607 of the diaphragm 1616 is secured to the housing 1614 at a first end 1605 of the housing 1614. A retaining ring 1619 is secured at the first end 1605 of the housing 1614 and secures the first end 1607 of the diaphragm 1616 to the first end 1605 of the housing 1614. In the representative embodiment of the invention, a rim 1609 at the first end 1607 of the diaphragm 1616 is secured between the first end 1605 of the housing and the retaining ring 1619. In addition, the seal 1618 disposed between the diaphragm 1620 and the faceplate 1612. The seal 1618 is disposed within a recess 1611 of the faceplate 1612. When the faceplate 1612 is engaged with the housing 1614, the retaining ring 1619 described above comes in contact with the faceplate 1612 and secures the seal 1618 in the recess 1611.

A second end 1603 of the diaphragm 1616 is secured to a piston 1628. The piston 1628 moves linearly from a first position to a second position in response to movement of the exciter 1624. In the first position shown in FIG. 42, the piston 1628 is spaced apart from the faceplate 1612 thereby increasing the volume within the chamber 1622. In the second position, the piston 1628 is moved nearer to or adjacent the faceplate 1612 relative the first position such that the volume of chamber 1622 is reduced or decreases relative to the volume of the chamber when piston 1628 is oriented in the first position. As the piston 1628 moves from the second position toward the first position, fluid flows into the chamber through the outlet 1613 and the inlets 1615. Conversely, as the piston moves from the first relative position toward the second relative position, fluid flows out of the chamber through the outlet 1613.

FIG. 42 further illustrates the attachment of the housing 1614 to the exciter 1624. The exciter 1624 has a frame 1630 that encloses the components of the exciter 1624. It is appreciated that exciter 1624 may be configured to operate in various operational methodologies including and not limited as a rotational actuator, a mechanical actuator, a pneumatic system, or the like. Regardless of the operational methodology employed associated with operation of exciter 1624, operation of exciter 1624 is configured to generate at least partly linear operation of a flexible member such as a diaphragm or bellows as disclosed further below to effectuate the cyclic intake and discharge strokes associated with the discrete jet assemblies.

Figure 44:
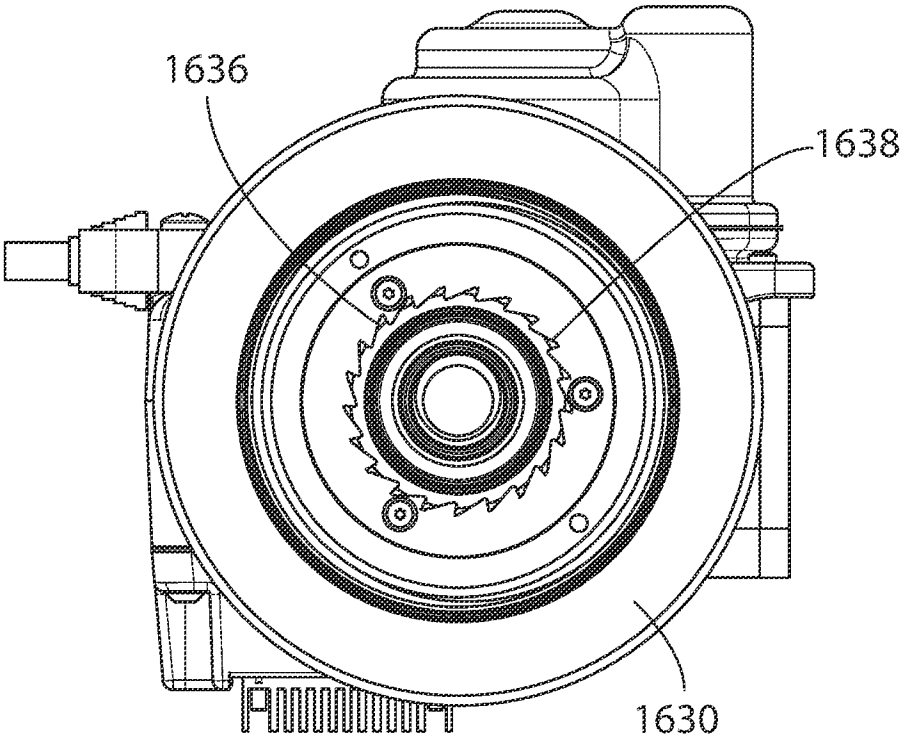
FIG. 44 is a top view of an exciter frame of the jet assembly shown in FIG. 40.
Figure 43:
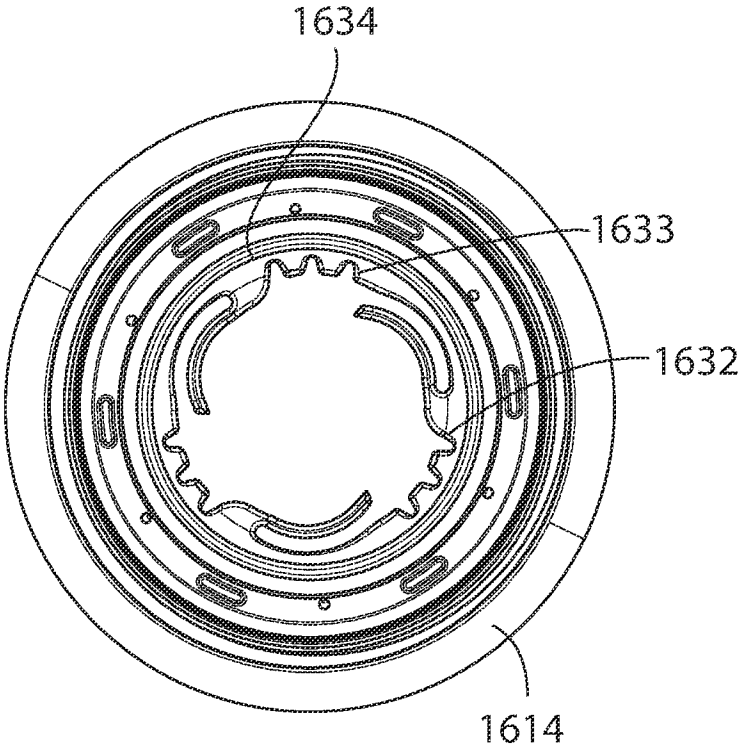
FIG. 43 is a top view of a housing of the jet assembly shown in FIG. 40.
Figure 45:
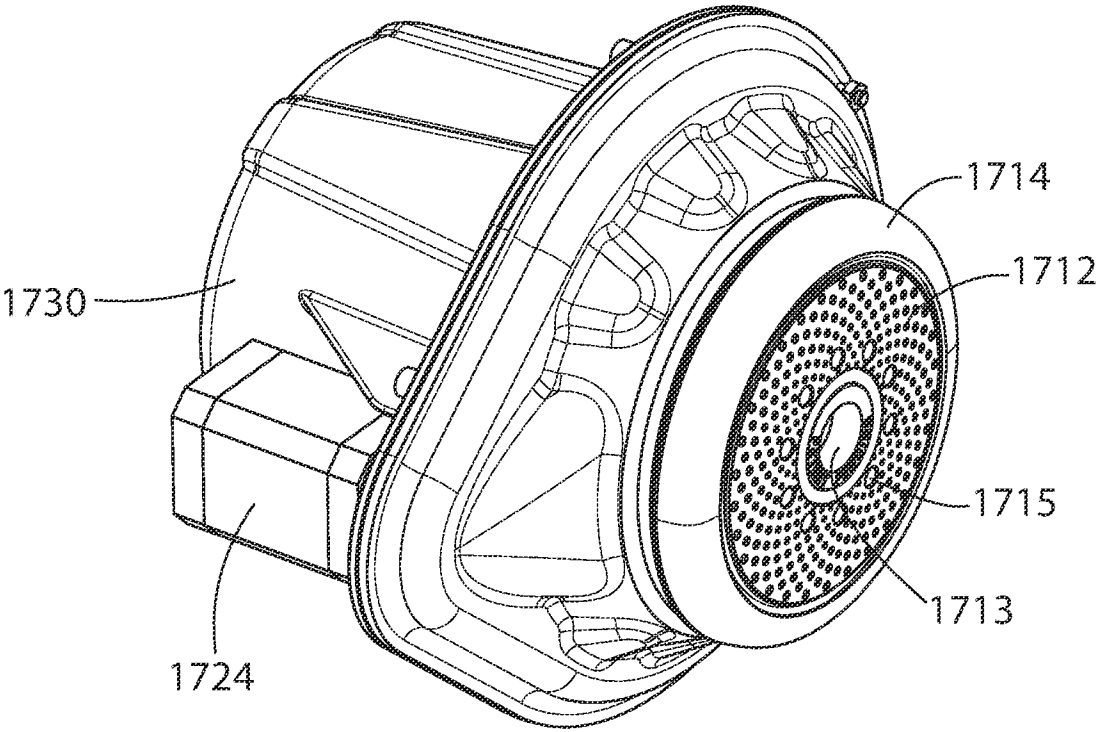
FIG. 45 is a perspective view of a jet assembly according to another embodiment of the invention.

In the representative embodiment of the invention, the housing 1614 may be threadably engaged with the exciter frame 1630 to couple the housing 1614 to the remainder of the exciter 1624 structure. FIGS. 43 and 44 further illustrate the interiors of the housing 1614 and the exciter frame 1630, respectively. As shown, the interior of the housing 1614 includes a number of ratchet elements 1632 having detents 1633 formed in a second end 1634 of the housing 1614. In addition, the ratchet elements 1632 may also include fingers 1635 extending inwardly. Ratchet elements 1632 are oriented in a generally radial direction and are spaced about a circumference of second end 1634 of the housing 1614. Meanwhile, the interior of the exciter frame 1630 includes a centrally located ratchet portion 1636 including a number of teeth or tabs 1638 extending outwardly therefrom. To secure the housing 1614 within the exciter frame 1630, the housing 1614 is disposed within the exciter frame 1630 and rotated to threadably engage an outer surface of the housing 1614 with an inner surface of the exciter frame 1630. The tabs 1638 of the ratchet portion 1636 of the exciter frame 1630 interact with the detents 1632 and fingers 1635 of the housing 1614 to lock the housing 1614 within the exciter frame 1630 to prevent rotation in the direction that would be necessary to separate the housing 1614 and the exciter frame 1630. As a result, the housing 1614 is secured within the exciter frame 1630 in a locked position so that operation of the jet assembly 1610 will not interfere with the desired operational connection between the housing 1614 and the exciter frame 1630.

FIGS. 45-48 depict a jet assembly 1710 according to another embodiment of the invention. Similar to jet assembly 1610 described above, jet assembly 1710 includes a faceplate 1712, a housing 1714, a diaphragm 1716 disposed within a cavity 1722 of the housing 1714, and a flap arrangement 1720. The flap arrangement 1720 is secured proximate the faceplate 1712 by way of a retaining element 1717. The orientation and interaction between flap arrangement 1720 and retaining element 1717 is the same as shown and described with regard to flap arrangement 1620 and retaining element 1617 of jet assembly 1610. It is contemplated that the jet assembly 1710 may include a retaining ring similar to the retaining ring 1619 of the previously described jet assembly 1610.

The diaphragm 1716 includes a first end 1707 and a second end 1703. The first end 1707 of the diaphragm 1716 includes a rim 1709 that is secured between an inner surface of the faceplate 1712 and a first end 1705 of the housing 1712. Meanwhile, the second end 1703 of the diaphragm 1716 is attached to a mover 1728, such as a piston, that reciprocates between a first position and a second position. In the first position, the piston 1728 is displaced from the inner surface of the faceplate 1712 thereby increasing the volume defined by chamber 1722. In the second position, the piston 1728 is moved toward the inner surface of the faceplate 1712 relative to the first position and thereby decreases the volume within the chamber 1722 relative to the first position. During movement of the piston 1728 from the first position toward the second position, fluid flows into the chamber through the outlet 1713 and the inlets 1715. As the piston moves from the second position toward the first position, fluid flows out of the chamber through the outlet 1713, as the flap arrangement 1720 at least substantially blocks fluid flow through the inlets 1715.

Figure 46:
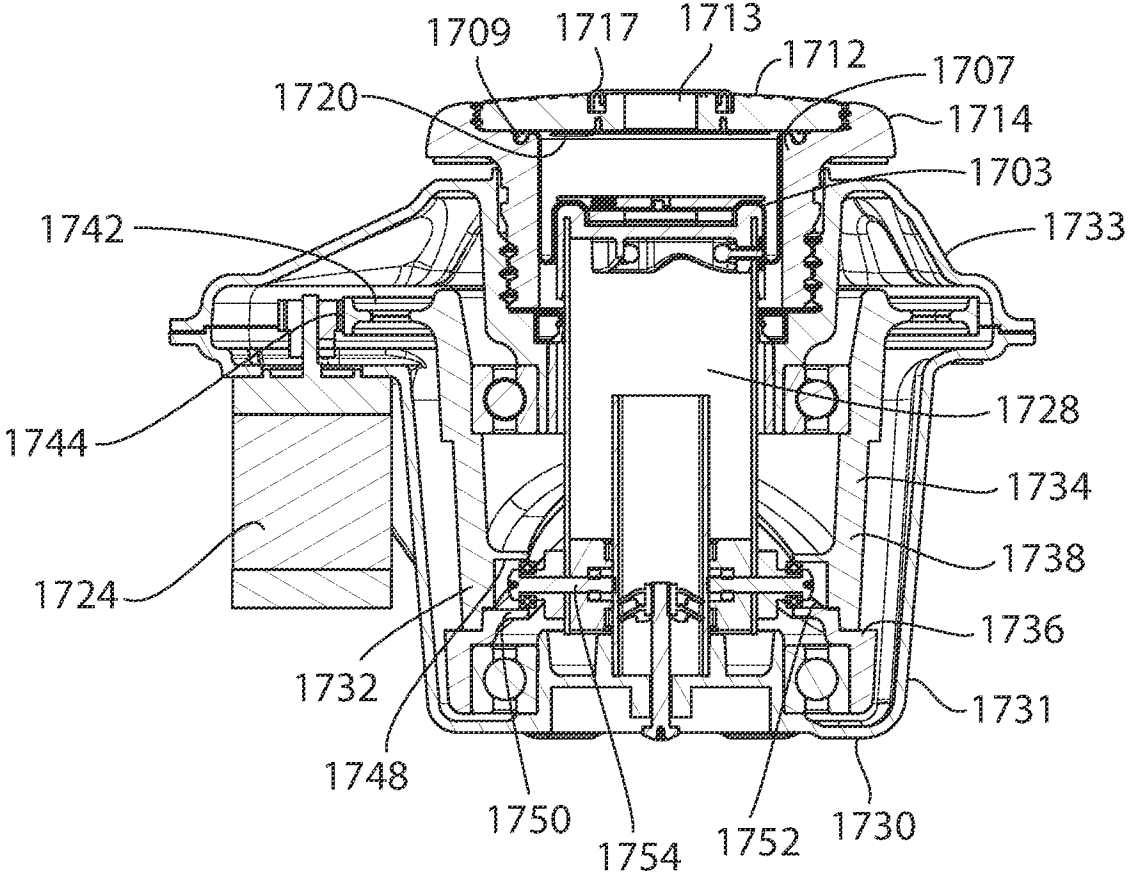
FIG. 46 is a longitudinal cross section view of the jet assembly of FIG. 45.

As shown in FIG. 46, the housing 1712 is threadably engaged with an exciter frame 1730. The exciter frame 1730 includes a lower or bottom half 1731 and an upper half 1733. In the representative embodiment of the invention, an exciter 1724, such as a motor, or other suitable drive source several of which are disclosed elsewhere herein, is coupled to the exciter frame 1730. The exciter 1724 is configured to interact with a cam assembly 1732 disposed within the exciter frame 1730. The cam assembly 1732 is configured to translate the motion of the exciter 1724 into reciprocating axial or lateral motion of the piston 1728 relative to the chamber, the effects of which are further described above.

The cam assembly 1732 includes an upper cam element 1734 and a lower cam element 1736 that slidably interact with one another to effectuate oscillation of the piston 1728. The upper cam element 1734 is shown in both FIGS. 46 and 47. The upper cam element 1734 includes a main body 1738. At a first end 1740 of the main body 1738, the upper cam element 1734 includes an extension element 1742 that extends outwardly from the main body 1738. The extension element 1742 increases the diameter of the upper cam element 1734 at its first end 1740. As shown in FIG. 46, the extension element 1742 of the upper cam element 1734 extends toward the exciter 1724. In turn, an outer surface 1744 of the extension element 1742 is placed in contact with the exciter 1724 so that rotational motion of the exciter 1724 is rotates the extension element 1742 and thereby the upper cam element 1734. It is contemplated that the outer surface 1744 of the extension element 1742 may include gears formed therein and be configured to interact with a geared feature of the exciter 1724 to effectuate the desired rotation therebetween.

Figure 47:
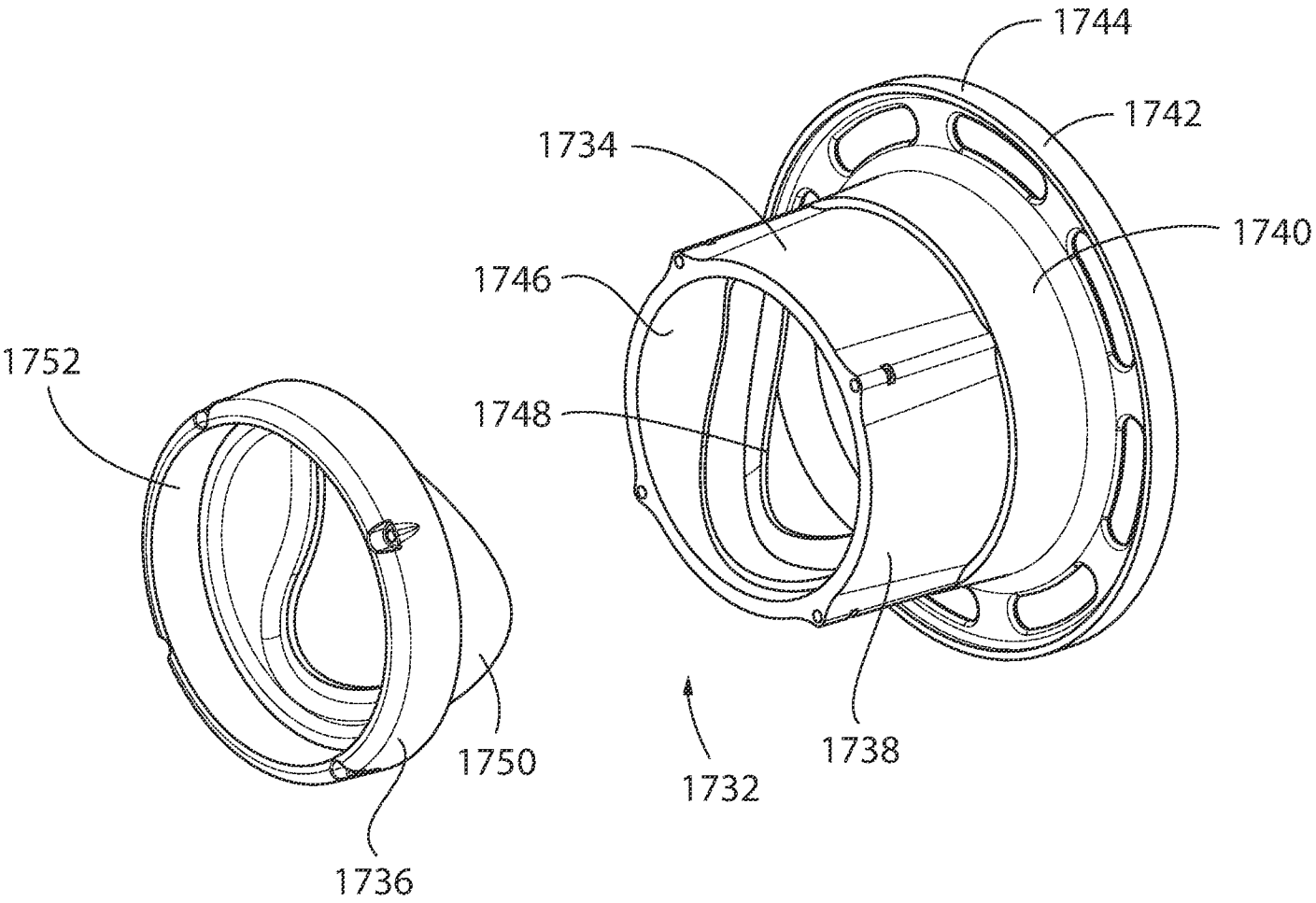
FIG. 47 is an exploded perspective view of a cam and follower drive arrangement of the jet assembly of FIG. 45.

FIG. 47 further shows an inner surface 1746 of the main body 1738 of the upper cam element 1734. In the representative embodiment of the invention, an upper guide surface 1748 extends inward from the inner surface 1746. The upper guide surface 1748 of the upper cam element 1734 is configured to interact with a lower guide surface 1750 of the lower cam element 1736. As shown in FIG. 47, the guide surface 1750 of the lower cam element 1736 extends inward and upward from a main body 1752 of the lower cam element 1736.

The lower cam element 1736 is coupled to the upper cam element 1734 so that rotation of the respective upper cam element 1734 or lower cam element 1736 causes rotation of the cooperating respective cam element 1734, 1736. It is contemplated that the upper and lower cam elements 1734, 1736 may be axially secured together by way of fasteners to prevent axial separation. In turn, the upper and lower guide surfaces 1748, 1750 of the cam elements 1734, 1736 are consistently spaced apart from each other to provide a follower path 1752. The piston 1728 includes followers 1754 extending radially outward therefrom and are configured to be disposed within the follower path 1752. In the representative embodiment of the invention, the followers 1754 are shown as rotational elements such as ball bearings or the like fastened to the piston 1728 via a bolts, but may be in the form of any extrusion or attachment in varying embodiments of the invention. Rotation of the cam elements 1734, 1736 causes the followers 1754 to move along the follower path 1752. Due to the contouring of the guide surfaces 1748, 1750, and, as a result, the contouring of the follower path 1752, as the followers 1754 move along the follower path 1752, the followers are moved laterally or axially, that is either up and down or side to side depending upon the orientation of the jet assembly 1710. Since the followers 1754 extend statically outward from the piston 1728, lateral movement of followers 1754 as they move along the follower path 1752 translates to lateral movement of the piston 1728 relative to housing 1712 and thereby effectuate the expansion and contraction of the volume of the volume associated with jet assembly 1710 in the same manner and to the same effect as disclosed above with respect to the previously described jet assemblies.

The follower path 1752 and the follower 1754 are symmetrically balanced with the piston 1728. In the representative embodiment of the invention, the follower path 1752 is configured to oscillate the piston 1728 twice per every revolution of the cam elements 1734, 1736. In other embodiments of the invention, the follower path 1752 may be adjusted to increase or decrease the number of oscillations of the piston 1782 per revolutions of the cam elements 1734, 1736.

Figure 48:
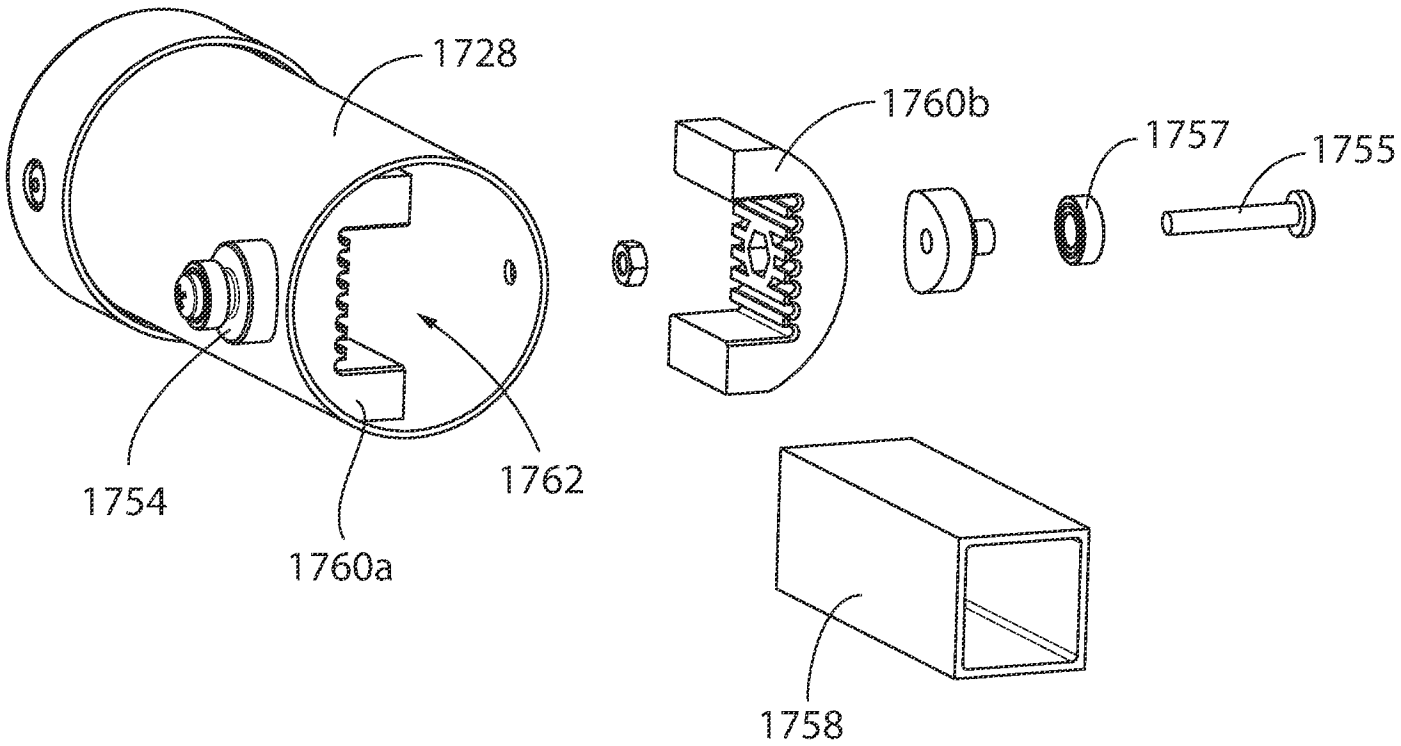
FIG. 48 is a partially exploded perspective view of a piston of the jet assembly of FIG. 45.

FIGS. 46 and 48 each illustrate the use of a retaining element 1758, such as a square stock key, and insert 1760 disposed within the piston 1728 in order to prevent rotation of the piston 1728. Although shown as having a square cross sectional shape, it should be appreciated that other cross sectional shapes are envisioned that would facilitate rotational drive forces effectuating axial operation of piston 1728 while providing a symmetrical balance of the loads communicated therebetween. Regardless of the specific geometry of the cross sectional shape interface, rotation of the cam elements 1734, 1736 causes linear oscillation of the piston 1728 without any rotation of the piston 1728. As shown in FIG. 48, the bolts 1755 retaining the bearings 1757 of the followers 1754 may extend into the piston 1728 and secure the insert 1760 relative to the piston 1728. While the insert 1760 is shown as including two pieces 1760*a*, 1760*b*, it is contemplated that the insert 1760 may include any number of pieces in varying embodiments of the invention. The retaining element 1758 is statically coupled to the exciter frame 1730 and disposed within an opening 1762 of the insert 1760 contoured to match the shape of the retaining element 1758. Statically coupling the retaining element 1758 to the exciter frame 1730 prevents the retaining element 1758 from rotating. Disposing the static retaining element 1758 within the inset 1760 prevents the inset 1760 from rotation. Finally, coupling the insert 1760 to the piston 1728 prevents the piston 1728 from rotating.

The present invention has been described in terms of the preferred embodiment. The several embodiments disclosed herein are related as being related to the assembly as generally shown in the drawings. It is recognized that equivalents, alternatives, and modifications, aside from those expressly stated, the embodiments summarized, or the embodiment shown in the drawings, are possible and within the scope of the appending claims. The appending claims cover all such alternatives and equivalents.

What is claimed is:

1. A water jet assembly comprising:

a faceplate having at least one opening formed therethrough;

a housing constructed to cooperate with the faceplate;

a mover disposed within a chamber of the housing, the mover comprising a piston and one of a bellows or a diaphragm and configured to move between a first position proximate the at least one opening of the face plate and a second position that is offset from the faceplate and the first position to provide a volume within the chamber and wherein a first end of the one of the bellows or diaphragm is secured to a first end of the housing and a second end of the one of the bellows or diaphragm is coupled to the first end of the piston; and an exciter connected to the housing and configured to transition the mover between the first position and the second position to increase and decrease the volume to move fluid into and out of the chamber via the at least one opening;

wherein a ferromagnetic plate is disposed in one of the second end of the one of the bellows or diaphragm and the first end of the piston; and wherein a magnet is disposed in the other of the second end of the one of the bellows or diaphragm and the first end of the piston.

2. The water jet assembly of claim 1 wherein the at least one opening associated with the faceplate is shaped and oriented to generate a torroidal waveform associated with operation of the exciter.

3. The water jet assembly of claim 1 wherein the exciter is further defined as at least one of a solenoid, a pneumatic system, a rotational actuator, and a mechanical actuator.

4. The water jet assembly of claim 3 wherein the exciter is defined as a rotational actuator; and wherein a linkage translates rotational motion of the rotational actuator to an at least partly linear motion of the mover by way of the linkage.

5. The water jet assembly of claim 4 wherein the rotational actuator includes a rotational shaft and a cam disposed at a distal end of the rotational shaft; and wherein the cam is coupled to the linkage.

6. The water jet assembly of claim 3 wherein the exciter is a pneumatic system including a pneumatic valve, a pneumatic chamber, and a pneumatic relief valve;

wherein the pneumatic valve is configured to provide air or another fluid to a pneumatic chamber within the housing; and wherein the pneumatic relief valve is disposed in the mover and configured to relieve pressure within the pneumatic chamber;

wherein an increase pressure in the pneumatic chamber causes the mover to transition toward the first position; and wherein a decrease in pressure in the pneumatic chamber causes the mover to transition toward the second position.

7. The water jet assembly of claim 1 wherein the one of the bellows or diaphragm blocks the at least one opening in the first position; and wherein the one of the bellows or diaphragm allows water to enter the volume within the chamber in the second position.

8. The water jet assembly of claim 1 further comprising a biasing element disposed within the housing and configured to apply a bias force to the mover.

9. A method of manufacturing a water jet assembly, the method comprising:

providing a housing having a chamber disposed therein;

disposing a mover within the chamber, the mover configured to move between a first position adjacent a first end of the housing and a second position offset from the first end of the housing to provide an accessible volume within the chamber;

securing a faceplate to the first end of the housing, the faceplate having at least one opening formed therein to access the accessible volume;

connecting an exciter to the mover, the exciter configured to transition the mover between the first position and the second position to increase and decrease the accessible volume and move fluid into and out of the chamber via the at least one opening;

forming the exciter as a pneumatic system including a pneumatic valve, a pneumatic chamber; and a pneumatic relief valve;

coupling the pneumatic valve to the housing to provide air or another fluid into the pneumatic chamber within the housing; and disposing a pneumatic relief valve into the mover.

10. The method of claim 9 further comprising forming the mover as a diaphragm and a piston; and securing a first end of the diaphragm to a first end of the housing; and securing a second end of the diaphragm to a first end of the piston.

11. The method of claim 10 further comprising disposing a ferromagnetic plate in one of the second end of the diaphragm and the first end of the piston;

disposing a magnet in the other of the second end of the diaphragm and the first end of the piston; and wherein the ferromagnetic plate and the magnet interact to secure the second end of the diaphragm to the first end of the piston.

12. The method of claim 9 further comprising forming the at least one opening in the faceplate so as to generate a toroidal waveform when the fluid is moved out of the chamber.

13. The method of claim 9 further comprising forming the exciter as a rotational actuator; and coupling the rotational actuator to a linkage;

coupling the linkage to the mover.

14. The method of claim 13 wherein the rotational actuator includes a rotational shaft powered by a motor and a cam;

coupling the cam at a distal end of the rotation shaft; and coupling the cam to the linkage.

15. The method of claim 9 further comprising forming the faceplate from a disc and a retainer;

disposing the disc at the first end of the housing; and threadably coupling the retainer to the first end of the housing to secure the disc to the first end of the housing.

16. The method of claim 9 further comprising disposing a biasing element within the housing, the biasing element configured to exert a bias force to the mover.

17. A water jet assembly comprising:

a faceplate having at least one opening formed therethrough;

a housing constructed to cooperate with the faceplate;

a mover disposed within a chamber of the housing, the mover configured to move between a first position proximate the at least one opening of the face plate and a second position that is offset from the faceplate and the first position to provide a volume within the chamber; and an exciter connected to the housing and configured to transition the mover between the first position and the second position to increase and decrease the volume to move fluid into and out of the chamber via the at least one opening, the exciter defined by a pneumatic system that includes a pneumatic valve, a pneumatic chamber, and a pneumatic relief valve;

wherein the pneumatic valve is configured to provide air or another fluid to a pneumatic chamber within the housing;

wherein the pneumatic relief valve is disposed in the mover and configured to relieve pressure within the pneumatic chamber;

wherein an increase pressure in the pneumatic chamber causes the mover to transition toward the first position; and wherein a decrease in pressure in the pneumatic chamber causes the mover to transition toward the second position.

18. A water jet assembly comprising:

a faceplate having at least one opening formed therethrough;

a housing constructed to cooperate with the faceplate;

a mover disposed within a chamber of the housing, the mover configured to move between a first position proximate the at least one opening of the face plate and a second position that is offset from the faceplate and the first position to provide a volume within the chamber; and an exciter connected to the housing and configured to transition the mover between the first position and the second position to increase and decrease the volume to move fluid into and out of the chamber via the at least one opening, the exciter being operable to delay movement of the mover away from a respective one of at least one of the first position and the second position after the mover achieves the respective at least one of the first position and the second position.

19. The water jet assembly of claim 18 wherein the exciter is further defined as at least one of a solenoid, a pneumatic system, a rotational actuator, and a mechanical actuator.

20. The water jet assembly of claim 19 wherein the exciter is defined as a rotational actuator; and wherein a linkage translates rotational motion of the rotational actuator to an at least partly linear motion of the mover by way of the linkage.

21. The water jet assembly of claim 19 wherein the rotational actuator includes a rotational shaft and a cam disposed at a distal end of the rotational shaft; and wherein the cam is coupled to the linkage.

22. The water jet assembly of claim 18 wherein the mover comprises a piston and one of a bellows or a diaphragm; and wherein a first end of the one of the bellows or diaphragm is secured to a first end of the housing and a second end of the one of the bellows or diaphragm is coupled to the first end of the piston.

* * * * *